US009332840B2

(12) United States Patent
Horii et al.

(10) Patent No.: US 9,332,840 B2
(45) Date of Patent: May 10, 2016

(54) RAIL DEVICE AND REFRIGERATOR USING THE SAME

(75) Inventors: Shinichi Horii, Shiga (JP); Hiroki Kawabata, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 1441 days.

(21) Appl. No.: 13/202,942

(22) PCT Filed: Feb. 27, 2009

(86) PCT No.: PCT/JP2009/000873

§ 371 (c)(1),
(2), (4) Date: Aug. 23, 2011

(87) PCT Pub. No.: WO2009/107388

PCT Pub. Date: Sep. 3, 2009

(65) Prior Publication Data

US 2011/0309732 A1 Dec. 22, 2011

(30) Foreign Application Priority Data

| | | |
|---|---|---|
| Feb. 29, 2008 | (JP) | 2008-049087 |
| May 14, 2008 | (JP) | 2008-126775 |
| Jul. 25, 2008 | (JP) | 2008-191947 |
| Sep. 12, 2008 | (JP) | 2008-234711 |

(51) Int. Cl.
*A47B 96/04* (2006.01)
*A47B 88/10* (2006.01)
(Continued)

(52) U.S. Cl.
CPC ..... *A47B 88/10* (2013.01); *F25D 25/025* (2013.01); *A47B 2210/17* (2013.01); *F25D 23/021* (2013.01)

(58) Field of Classification Search
CPC ..... A47B 88/10; F25D 25/025
USPC ..... 312/402, 404, 334.1, 334.7, 334.8, 312/334.9, 334.11, 334.13, 334.16, 334.17, 312/334.18, 334.19, 334.21, 334.22, 312/334.23, 334.24, 334.25, 334.26, 312/334.31, 334.32, 334.33, 334.34, 312/334.36, 334.37, 334.38
See application file for complete search history.

(56) References Cited

U.S. PATENT DOCUMENTS

| | | | | |
|---|---|---|---|---|
| 5,882,100 | A * | 3/1999 | Rock | 312/334.34 |
| 6,244,679 | B1 | 6/2001 | Robertson et al. | |

(Continued)

FOREIGN PATENT DOCUMENTS

| | | | |
|---|---|---|---|
| CH | 652579 | A5 * | 11/1985 |
| CN | 1288143 | | 3/2001 |

(Continued)

*Primary Examiner* — Daniel J Troy
*Assistant Examiner* — Andres F Gallego
(74) *Attorney, Agent, or Firm* — Hamre, Schumann, Mueller & Larson, P.C.

(57) ABSTRACT

A refrigerator with a rail device having a bracket which is fixed to an inner surface of an inner box, and first, second and third rails which are arranged in such a manner that longitudinal directions are identical and have an elongated shape, and supporting a storage container so as to be movable forward and backward. The second rail has flanges protruding right and left in upper and lower sides in the longitudinal direction, the lower flange is held to the first rail so as to be movable in the longitudinal direction, the first rail is bonded to the bracket, and has flanges extended to a height beyond the lower flange of the second rail in right and left sides in the longitudinal direction, and the third rail holds the flange on the second rail so as to be movable in the longitudinal direction.

12 Claims, 31 Drawing Sheets

(51) Int. Cl.
*F25D 25/02* (2006.01)
*F25D 23/02* (2006.01)

(56) References Cited

U.S. PATENT DOCUMENTS

| | | | | |
|---|---|---|---|---|
| 7,108,339 | B2 * | 9/2006 | Berger | 312/333 |
| 2004/0000851 | A1 * | 1/2004 | Lam Harn et al. | 312/334.7 |
| 2007/0084234 | A1 | 4/2007 | Park et al. | |
| 2007/0085457 | A1 * | 4/2007 | Park et al. | 312/402 |
| 2007/0227180 | A1 | 10/2007 | Koons | |
| 2007/0247043 | A1 * | 10/2007 | Simmons et al. | 312/334.1 |
| 2010/0026154 | A1 * | 2/2010 | Johansson | 312/334.9 |

FOREIGN PATENT DOCUMENTS

| | | | |
|---|---|---|---|
| CN | 1435331 | | 8/2003 |
| CN | 1952555 | | 4/2007 |
| CN | 101004315 | | 7/2007 |
| EP | 1 775 534 | | 4/2007 |
| JP | 6-282746 | | 10/1994 |
| JP | 06-282746 | A | 10/1994 |
| JP | 2001-091152 | | 4/2001 |
| JP | 2003-014370 | | 1/2003 |
| JP | 2005-265244 | | 9/2005 |
| JP | 2006-038376 | | 2/2006 |
| JP | 2006-046710 | | 2/2006 |
| JP | 2006-177653 | | 7/2006 |
| JP | 2006-177660 | | 7/2006 |
| JP | 2006177655 | A * | 7/2006 |
| JP | 2007-064580 | | 3/2007 |
| JP | 2007-303780 | | 11/2007 |

* cited by examiner

RAIL DEVICE AND REFRIGERATOR USING THE SAME

TECHNICAL FIELD

The present invention relates to a refrigerator, and, in particular, to a drawer configuration of a storage room.

BACKGROUND ART

Conventionally, the refrigerator includes a plurality of storage rooms such as a refrigerating room, a freezing room and a vegetable room. Moreover, the freezing room and the vegetable room are generally disposed in a lower cases of the refrigerator as drawer-type storage rooms from the viewpoints of cooling efficiency and convenience, etc.

For such drawer-type storage room, smoothness when the storage room is put in and taken out, ease of putting foods in and out of the storage room, ease of attaching and detaching of a container forming the storage room, etc are demanded. Hence, a technique that improves the convenience of the drawer-type storage room is also disclosed (e.g., see Patent Documents 1 and 2).

FIG. 40 is a drawing indicating a cross-sectional side of a conventional refrigerator.

Conventional refrigerator 4051 shown in FIG. 40 includes, within heat insulated box 4019, from the upper part, refrigerating room 4025, temperature-changeable switching room 4026 downward of refrigerating room 4025, an ice making room (not shown) placed in juxtaposition with switching room 4026, vegetable room 4027 downward of switching room 4026 and the ice making room, and freezing room 4028 downward of vegetable room 4027 as a storage room.

Heat insulated box 4019 is formed by outer box 4021, inner box 4020, and foaming and heat insulating material 4022 filled between outer box 4021 and inner box 4020.

Container 4027*a* forming vegetable room 4027 is supported by two rail device 4031 each connected to vegetable room drawing door 4029.

In addition, container 4028*a* forming freezing room 4028 is supported by two rail device 4031 each connected to freezing room drawer door 4030.

Vegetable room 4027 and freezing room 4028 are each configured in such a manner to thereby become drawer-type storage rooms that can be put in and taken out to heat insulated box 4019.

FIG. 41 is an exploded view of rail device 4031 in conventional refrigerator 4051.

FIG. 42 is a front view showing a construction outline of rail device 4031 in conventional refrigerator 4051.

Rail device 4031 shown in FIGS. 41 and 42 includes first rail (fixed rail) 4031*a*, third rail (moving rail) 4031*b*, second rail (intermediate traveling rail) 4031*c* provided between first rail (fixed rail) 4031*a* and third rail (moving rail) 4031*b*, and a plurality of bearings 4031*d* supporting the engagement of second rail (intermediate traveling rail) 4031*c*, first rail (fixed rail) 4031*a* and third rail (moving rail) 4031*b*.

The plurality of bearings 4031*d* are, specifically, rotatably held by ball gauge 4031*e* as illustrated in FIG. 42.

Rail device 4031 in the state of combining each of such components has first rail (fixed rail) 4031*a* fixed to the inside surface of inner box 4020 to thereby be installed in heat insulated box 4019.

Specifically, rail device 4031 are each attached to positions corresponding to right and left of each of vegetable room 4027 and freezing room 4028, in the inside surface of inner box 4020. In other words, two pairs of first rails (fixed rails) 4031*a*, each pair having right and left rails, are installed in the inside surface of inner box 4020.

In addition, each first rail (fixed rail) 4031*a*, as shown in FIG. 42, clipping inner box 4020 with holder rail 4032, is fastened by holder rail 4032 and a bolt.

Further, vegetable room drawing door 4029 is attached to the tips of two third rails (moving rails) 4031*b* of one pair located above, while freezing room drawer door 4030 is attached to the tips of two third rails (moving rails) 4031*b* of the other pair.

Additionally, container 4027*a* in vegetable room 4027 is supported in its right and left by two third rails (moving rails) 4031*b* and moves back and forth together with third rail (moving rail) 4031*b* synchronously with the movement in the back and forth directions of vegetable room drawing door 4029.

Furthermore, when at least vegetable room 4027 is completely opened, that is, when vegetable room drawing door 4029 is drawn to the maximum drawing position, the container is made so as to be readily attachable and detachable upwardly.

When freezing room 4028 is completely opened similarly, container 4028*a* is readily attachable and detachable upwardly.

In conventional refrigerator 4051, the adoption of such configuration for rail device 4031, for example, makes so-called backlash little and attaching and detaching of the container easy, so that the usability of the drawer-type storage room is improved.

Here, in recent years, drawer-type storage rooms such as vegetable rooms in refrigerators receive consumer needs and tend to increase in their capacities that can store by devising, for example, the arrangement of the components within the refrigerator.

Moreover, it is considered that this tendency continues in the future. That is, a larger weight than conventionally is considered to act on the rail device of a drawer-type storage room.

In addition, even if the capacity is increased, the ease of putting foods, etc. in and taking them out of a drawer-type storage room, detaching and attaching of a container forming the drawer-type storage room, etc. should be secured.

In other words, the drawn distance of the storage room should secure at least a distance that does not interfere with the other components of the refrigerator in the attaching and detaching of the container.

Hence, the case where conventional rail device 4031 is adopted is supposed as a drawer mechanism of a further larger-capacity storage room.

In this case, the supporting weight becomes larger and the drawn distance is long, in rail device 4031, whereby, for example, as shown in FIG. 42, the portion surrounded by the dotted line of first rail (fixed rail) 4031*a* is liable to fall in the arrow direction (inside of the refrigerator). That is, first rail (fixed rail) 4031*a* is placed in a condition where the rail is more readily opened.

Thus, when first rail (fixed rail) 4031*a*, etc. constituting rail device 4031 are deformed, the problems of lowering the usability such as the smoothness of putting in and taking out of the storage room are caused.

Certainly, the problem of deformation is considered to be eliminated by, for example, increasing the thickness of components such as first rail (fixed rail) 4031*a* or fabricating components using a specific, high rigid material.

However, such method for solution becomes factors such as a decrease in an available space in the refrigerator, an increase in weight of the refrigerator, an increase in production cost of the refrigerator, etc. Thus, the method is not desirable.

Next, the case where the drawn distance is enlarged is supposed by using the intermediate rail described in Patent Document 2 as a drawer mechanism of a further larger-capacity storage room.

In this case, in the state of maximally drawing the drawer door, the innermost portion (storage room side end face) of the third rail (moving rail) may be located outside the foremost surface part of the outer box, it is desirable that the exposed portion of the innermost portion (storage room side end face) of the third rail (moving rail) be protected.

Moreover, in the state of maximally drawing the drawer door, supposing that a finger is placed between the innermost portion of the third rail (moving rail) and the foremost surface part of the outer box and then drawer door is closed, it is desirable that the exposed portion of the innermost portion (storage room side end face) of the third rail (moving rail) be protected.

Patent Document 1: Unexamined Japanese Patent Publication No. 2006-177653

Patent Document 2: Unexamined Japanese Patent Publication No. 2006-046710

DISCLOSURE OF THE INVENTION

The present invention provides a refrigerator comprising a drawer-type storage room and not losing convenience even if the capacity of the storage room is large. A refrigerator of the present invention includes a heat insulated box comprising an inner box, an outer box and a heat insulator filled between the inner box and the outer box, and a drawer-type storage room, wherein the storage room includes therein a rail device comprising a first rail (first rail (fixed rail)), a second rail (intermediate rail) and a third rail (third rail (moving rail)) that are elongated, and movably back and forth supporting a storage container, and wherein the rail device includes a fall prevention part, and directly and indirectly supports and slidably moves back and forth, the storage container.

Additionally, the present invention is a refrigerator comprising a rail protection component in the storage room side end face of the third rail.

Because of such construction, the rail device includes a fall prevention part, whereby the rail device is configured so as to be hardly opened when force is exerted upon the rail device; even when the rail device in the refrigerator of the present invention completely openably supports the large capacity storage room, the deformation of the rail device is prevented, and therefore good usability of the storage room is kept.

Moreover, even when the inclusion of a rail protection component completely openably supports the large-capacity storage room, the storage room side end face of the third rail can be protected, good usability of the storage room, safety upon use, and dignity of appearance are maintained.

REFERENCE MARKS IN THE DRAWINGS

Figure 1:
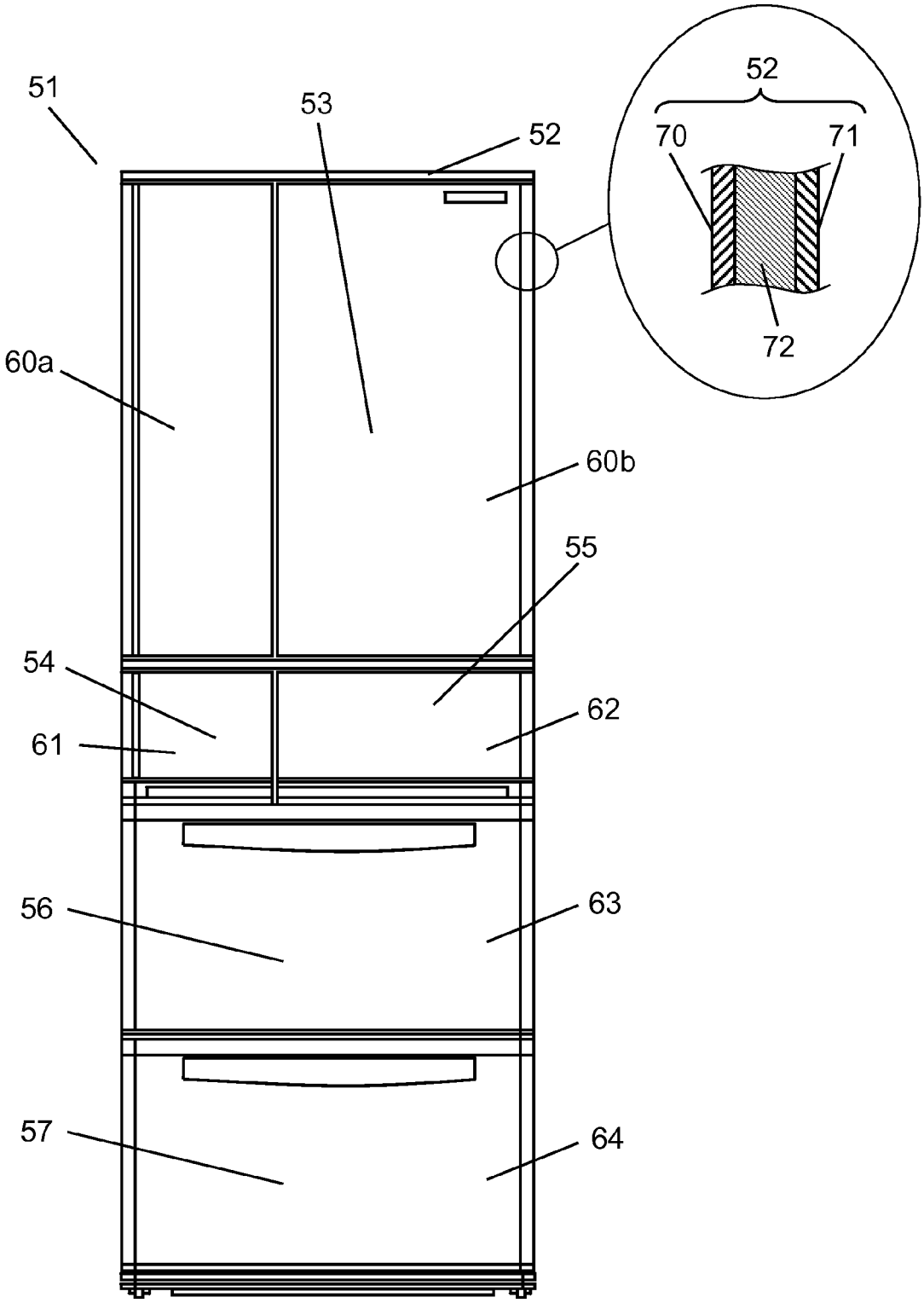
FIG. 1 is a front view of a refrigerator according to a first embodiment of the present invention.

40, 80, 81, 82, 83, 140, 200, 210, 400, 410, 440, 840: Rail device
846: Rail protection component
41, 84, 541: Bracket (fixing member)
41*a*, 900, 902, 905: Rib (reinforcing part)
42, 86, 142, 201, 211: First rail
43, 43*a*, 85, 143, 203, 213: Second rail
43*b*: Upper flange
43*c*: Base plate
43*d*: Lower flange
44, 44*a*, 144, 202, 212: Third rail
45, 145, 204, 631*d*: Bearing (sliding member)
46, 146: Ball gauge
48, 148, 205, 215: Holder rail (auxiliary member)
51, 151, 500, 618, 700, 851: Refrigerator
52, 152, 570, 619, 770, 852: Heat insulated box
53, 153, 510, 625, 710, 853: Refrigerating room
54, 154, 854: Ice making room
55, 155, 626, 855: Switching room
56, 156, 520, 627, 720, 856: Vegetable room
57, 157, 530, 628, 730, 857: Freezing room
60*a*, 160*a*, 860*a*: Left door
60*b*, 160*b*, 860*b*: Right door
61, 62, 63, 64, 161, 162, 163, 164, 629, 630, 861, 862, 863, 864: Door
63*a*, 163*a*: Storage container
70, 170, 571, 620, 870: Inner box
71, 171, 572, 621, 871: Outer box
72, 172, 573, 622, 872: Foam heat insulator
148*a*: Flange
148*b*: Fixing part of auxiliary member
148*c*: Fixing part of rail device
148*d*: Reinforcing shape
148*e*: Vertical flange part
148*g*: Lower surface of vertical flange part
205*a*, 215*a*: Flange part
205*e*, 215*e*: Vertical flange part

PREFERRED EMBODIMENTS FOR CARRYING OUT OF THE INVENTION

The present invention is a refrigerator comprising a heat insulated box formed by an inner box, an outer box and a foam heat insulator filled between the inner box and the outer box, and a drawer-type storage room, wherein the storage room includes therein a rail device comprising a first rail, a second rail and a third rail that are elongated, and movably back and forth supporting a storage container, and wherein the rail device is provided with a collapsing prevention portion of rail device. In addition, the third rail directly or indirectly supports the storage container and is made slidable back and forth, whereby the rail device includes parts of preventing the rail device from falling so as to be configured to be hardly opened when force is exerted upon the rail device. Thus, even when the rail device in the refrigerator of the present invention completely openably supports the large capacity storage room, the deformation of the rail device is prevented, and therefore good usability of the storage room is kept.

In the refrigerator according to the present invention, the second rail includes flanges that protrude to the right and left sides top and bottom in the longitudinal direction, the first rail includes flanges that extends to a height that exceeds the height of the flange at the bottom of the second flange on the right and left sides in the longitudinal direction and is movably held through a sliding member, and the third rail movably holds the flange at the top of the second rail through a sliding member. In addition, the rail device is configured such that a fixing member is fixed to the inside surface of the inner box and then the storage container is directly or indirectly supported to the third rail and is made slidable back and forth and also the fall prevention part is formed by joining the flat portion of the fixing member fixed to the inner box and the flat portion of the outer box of the first rail in advance. Hence, the first rail becomes a section shape to be hardly opened when force is exerted upon the rail device through the second rail movably disposed in the groove; even when the rail device completely openably supports the large capacity storage room, the deformation of the rail device is prevented, and therefore good usability of the storage room is kept.

Moreover, the first rail is symmetrical when viewed from the front, so that when the first rail is, for example, fabricated by roll molding of a plate material, it is easy to fabricate the first rail with good precision.

In addition, since the first rail is different from the fixing member, the length of the fixing member in the depth direction can be determined regardless of the length of the first rail, whereby the length of the fixing member is only a necessary length for fixing the rail device to the inner box, so that the amount (length) of material required for fabrication of the rail device can be made small compared to the amount of conventional device.

In the refrigerator according to the present invention, the first rail is joined to the fixing member on the side of the first rail, whereby the first rail can be joined to the fixing member without increasing the height of the whole rail device, that is, at the same height as that of a rail device (conventional rail device) in which the shape of the fixing member is fabricated by regarding the height of the entire rail device as the whole first rail.

Further, since the portion in which the fixing member extends to the lower surface of the first rail is reduced, the amount (length) of material required for fabrication of the mixing member can be made small as compared with the case where the mixing member is fixed to the lower surface of the first rail.

In the refrigerator according to the present invention, since the first rail is joined to the fixing member in the lower surface of the fixing member, force is exerted mainly from the vertical direction on the joint surface of the fixing member and the first rail, so that the reliability of the joint is improved. In addition, reliability is improved even in strength in the state of having drawn the rail device.

In the refrigerator according to the present invention, the fixing member has at least one bended portion and a reinforcing part connecting two faces that are present to hold the bended portion and are not in parallel. As a result, the amount of bend when force is exerted upon the fixing member is reduced, and the amount of inclination of the rail device when a load is applied to the rail device is decreased as compared with the case where the reinforcing part is not present.

In the refrigerator according to the present invention, the second rail has a longer size than a predetermined size in the up and down directions and the geometrical moment of inertia in a cross section perpendicular to the longitudinal direction is larger than a predetermined value, whereby the alteration of the size of the second rail so as to increase the geometrical moment of inertia of the second rail suppresses the deformation of the second rail.

Moreover, this is effective even when the fixing member and the first rail are integrally molded, i.e., when the first rail is directly fixed to the inner box.

In a refrigerator according to the present invention, the third rail has flanges that sandwich the flange at the top of the second rail and are downward right and left in a longitudinal direction; the flange of the inside surface of the right and left flanges is extended downward of the other flange. As a result, the alteration of the shape of the cross section of the third rail so as to increase the geometrical moment of inertia of the third rail suppresses the deformation of the third rail.

Moreover, this is effective even when the fixing member and the first rail are integrally molded, i.e., when the first rail is directly fixed to the inner box.

In the refrigerator according to the present invention, at least one of the first rail and the third rail supports the second rail from the four directions in a cross section perpendicular to the longitudinal direction, thereby holding the second rail movably in the longitudinal direction. As a result, the strength of the connection portion of the second rail and the first rail or the third rail to the force in the direction into the refrigerator is improved.

In the refrigerator according to the present invention, the second rail includes flanges that protrude to the right and left sides top and bottom in a longitudinal direction, the first rail includes flanges that extends to a height that exceeds the height of the flange at the bottom of the second flange in one of the longitudinal directions and is movably held through a sliding member, and the third rail movably holds the flange at the top of the second rail through a sliding member. In addition, the rail device is configured such that the first rail is fixed to the inside surface of the inner box and then the storage container is directly or indirectly supported to the third rail and is made slidably back and forth and also the fall prevention part is longer in its size in the vertical directions than a predetermined size, whereby the geometrical moment of inertia in a cross section perpendicular to the longitudinal direction is larger than a predetermined value. Thus, the geometrical moment of inertia in a cross section perpendicular to the longitudinal direction is larger than a predetermined value and in the rail device the first rail is fixed to the inside surface of the inner box and then the storage container is directly or indirectly supported to the third rail and is made slidably back and forth, whereby the alteration of the size of the second rail so as to increase the geometrical moment of inertia of the second rail suppresses the deformation of the second rail even when it completely operably supports the large-capacity storage room, so that good usability of the storage room is kept.

In the refrigerator according to the present invention, the second rail includes flanges that protrude to the right and left sides top and bottom in a longitudinal direction, the first rail includes flanges that extends to a height that exceeds the height of the flange at the bottom of the second flange in one of the longitudinal directions and is movably held through a sliding member, and the third rail movably holds the flange at the top of the second rail through a sliding member. In addition, the rail device is configured such that the first rail is fixed to the inside surface of the inner box and then the storage container is directly or indirectly supported to the third rail and is made slidably back and forth, and also the fall prevention part is made to be downward flanges on the right and left sides in the longitudinal direction that hold the flange of the third rail with the flange at the top of the second rail, and the flange of the inside surface of the right and left flanges is extended downward of the other flange. As a result, the alteration of the shape of the cross section of the third rail so as to increase the geometrical moment of inertia of the third rail suppresses the deformation of the third rail even when a large-capacity storage room is completely openably supported, so that good usability of the storage room is kept.

In the refrigerator according to the present invention, an auxiliary member for fixing the rail device to the inner box is provided on the side opposite to the rail device by crossing the inside surface. In addition, the auxiliary member is extended to just below the lower surface of the first rail, thereby having a flange for suppressing a deformation downward of the first rail. As a result, the shape of the auxiliary member for fixing the rail device to the inner box is devised, thereby suppressing the inclination and the like of the rail device when a load is applied to the rail device. In other words, a role of reinforcing the rail device can be further played by the auxiliary member that originally plays the role of immobilizing the rail device.

In the refrigerator according to the present invention, the length of each of the first rail, the second rail and the third rail is a length in which the edge deep inside the storage container is located forward of the front side of the door just above the storage room when the storage container is drawn to the maximally drawn position. As a result, even when the drawn distance of the storage room is elongated, the convenience of the storage room is kept by each of or a combination of a variety of technical features that suppress the deformation of the refrigerator rail device of the present invention.

In a refrigerator according to the present invention, the first rail is joined to the fixing member by spot welding. This allows local welding, thermal deformation (distortion) due to welding of the rail device is prevented as compared with the case where continuous welding is performed in a longitudinal direction, and good usability of the storage room is kept even where a large-capacity storage room is completely openably supported.

In the refrigerator according to the present invention, the second rail includes flanges that protrude to the right and left sides top and bottom in a longitudinal direction, the first rail fixed to the inside surface of the inner box includes flanges that extends to a height that exceeds the height of the flange at the bottom of the second flange in one of the longitudinal directions and is movably held through a sliding member, the third rail movably holds the flange at the top of the second rail through a sliding member, and an auxiliary member for fixing the rail device to the inner box is provided on the side opposite to the rail device by crossing the inside surface. In addition, the rail device is configured such that the first rail is fixed to the inside surface of the inner box and then the storage container is directly or indirectly supported to the third rail and is made slidable back and forth, and also in the fall prevention part the auxiliary member is disposed on the heat insulator side of the inner box provided with the rail device, and in addition a flange part is provided that is extended to at least the center position of the lower surface of the first rail. As a result, in a lower portion of the rail device, the center position relative to the bottom surface of the first rail is received by the auxiliary member and also the contact area of the auxiliary member with the foaming and heat insulating material is made large, so that deformation that is liable to fall to the vertical direction of the rail device can be prevented by resistance by the foaming and heat insulating material. That is to say, the material strength of the auxiliary member itself can be improved and also the deformation of the vertical direction in the foaming and heat insulating material of the auxiliary member can be prevented by devising the shape of the auxiliary member for fixing the rail device to the inner box, whereby the inclination of the vertical direction of the rail device when a load is applied to the rail device is prevented. In other words, a role of reinforcing the rail device can be further played by the auxiliary member that originally plays the role of immobilizing the rail device.

In the refrigerator according to the present invention, the upper surface of the flange part of the auxiliary member directly makes contact with the lower surface of the inner box without the heat insulator. This makes it possible to suppress the deformation of the rail device due to a load by the auxiliary member that is a robust material without a flexible foaming and heat insulating material when a load acts on the rail device, so that the stiffening effect of the auxiliary member can surely be provided.

Additionally, since the auxiliary member can be installed directly in the inner box face, the installation position of the auxiliary member is easily controlled, so that the auxiliary member can be surely installed in a required predetermined position and thus stiffening effect of the auxiliary member can be definitely obtained.

In the refrigerator according to the present invention, the lower surface of the first rail directly comes in contact with the upper surface of the inner box. As a result, where a load is imposed on the rail device, when there is space between the back surface of the first rail and the upper surface of the inner box, the rail device continues to deform without receiving any obstruction. However, since the lower surface of the first rail directly comes in contact with the upper surface of the inner box, there is no space between the back surface of the first rail and the upper surface of the inner box, so that the deformation of the rail device due to its load can be restrained by the auxiliary member installed in the foaming and heat insulating material of the inner box, thereby surely providing the stiffening effect of the auxiliary member.

In a refrigerator according to the present invention, the auxiliary member has the vertical flange part, which extends in the same direction as the direction of the force that is applied to the rail device when the drawer door is drawn, on the bottom surface side of the rail device. As a result, the strength development by an increase in the longitudinal cross-sectional moment of inertia as the shape of the auxiliary member is achieved, and also the contact area with the foaming and heat insulating material of the vertical flange part of the auxiliary member in the horizontal direction is added. As such, the deformation that starts moving to the horizontal direction in the vertical flange part of the auxiliary member can be prevented by resistance by the foaming and heat insulating material. That is to say, the material strength of the auxiliary member itself can be improved and also the deformation of the horizontal direction in the foaming and heat insulating material of the auxiliary member can be prevented by devising the shape of the auxiliary member for fixing the rail device to the inner box. Therefore, the inclination of the horizontal direction of the rail device where a load is applied to the rail device is prevented.

In the refrigerator according to the present invention, the auxiliary member is molded with the metallic material. As a result, the strength necessary for the fixing part of the rail device installed in the auxiliary member is readily secured, so that the fixation of the rail device that is used inherently can be surely carried out. In other words, the auxiliary member having both the fixation and reinforcement of the rail device can be molded with one part.

In the refrigerator according to the present invention, the auxiliary member has the reinforcing shape in the bend section between two planes with an angle, whereby the deformation of the bend section of the auxiliary member when a load is applied to the flange part of the auxiliary member can be prevented through the shape of the auxiliary member itself, the strength of the auxiliary member can be improved, and the deformation of the rail device can be prevented.

In a refrigerator according to the present invention, the auxiliary member has a shape that is able to be used both in right and left sides, so that the auxiliary member need not be used selectively when right and left auxiliary members are installed in the inner box, operability can be improved, and also molding cost for molding the auxiliary member can be prevented.

In the refrigerator according to the present invention, a constant distance is given between the lower surface of the vertical flange part and the inner box facing the lower surface of the vertical flange part. The deformation of the rail due to a load affects the auxiliary member when a load is applied to the rail device, and there is a constant distance between the lower surface of vertical flange part of the auxiliary member that starts to deform in the same direction as that of the load applied to the rail device and the inner box. Therefore, the back surface of the vertical flange part is not directly in contact with the inner box and the foaming and heat insulating material is present, and hence the shape of the surface of the inner box can be maintained good without causing damage such as breakthrough of the inner box in the lower surface of vertical flange part of the auxiliary member due to the deformation of the auxiliary member.

In the refrigerator according to the present invention, the vertical flange part is inclined to a side opposite to the refrigerator inside. In the case where a load is applied to the rail device, the deformation of the rail due to the load also affects the auxiliary member and the deformation of the vertical flange part of the auxiliary member suppresses its deformation to the refrigerator inside including the inner box therein. The inner box is not surely present, but the foaming and heat insulating material is present, to the traveling direction of the vertical flange part of the auxiliary member and hence the shape of the surface of the inner box can be maintained good without causing damage such as breakthrough of the inner box in the end face of the auxiliary member due to the deformation of the auxiliary member.

In the refrigerator according to the present invention, the length of each of the first rail, the second rail and the third rail is a length in which the edge deep inside the storage container is located forward of the front side of the door just above the storage room when the storage container is drawn to the maximally drawn position. As a result, even when the drawn distance of the storage room is elongated, the deformation of the refrigerator rail device of the present invention is prevented and thus the convenience of the storage room is kept.

A refrigerator according to the present invention includes a heat insulated box comprising a front side opening including an inner box, an outer box and a foaming and heat insulating material filled between the inner box and the outer box, a drawer-type storage room formed within the heat insulated box, a drawer door freely openly and closely blockading the front side opening of the storage room, a first rail, a third rail, and a second rail provided between the first rail and the third rail. In addition, the refrigerator includes a rail device which makes a container installed inside the storage room movable back and forth and in which the first rail, the third rail and the second rail are each supported by a rotational support member, the first rail is fixed to the sidewall of the inner box with the first rail, the third rail and the second rail being incorporated in advance, and the container installed inside the storage room is made movable back and forth. Additionally, the storage room side end face of the third rail includes a rail protection component, whereby the rail protection component installed in the storage room side end face of the third rail protects the exposed portion of the innermost portion of the third rail (storage room side end face) by adopting the second rail, even where the innermost portion of the third rail (storage room side end face) is located outside the foremost surface part of the outer box. Thus, a hand is prevented from making contact with the end face of the third rail, the safety can be improved, and safety for use and dignity of the appearance can be maintained even where a large-capacity storage room is completely openably supported.

In the refrigerator according to the present invention, the rail protection component is increased in its drawing amount by disposing a slope in the rear end, and the drawer door is drawn until the place where the innermost portion (storage room side) of the rail protection component is located outside the foremost surface part of the outer box. A finger can be escaped like extrusion outside the slope thanks to the slope even if the finger is put in the clearance made in the innermost portion of the rail protection component and the foremost surface part of the outer box, and therefore the safety when the drawer door is closed can be improved.

In the refrigerator according to the present invention, the slope has an angle from 10 to 45 degrees both inclusive. If the angle of gradient of the slope is too small, the slope disposed in the rail protection component becomes large and the size of the rail protection component also becomes large, so that the shape might not be settled within a demanded size and the strength is difficult to secure since the geometrical thickness is small in the tip of the slope. Moreover, inversely, if the angle of gradient of the slope is too large, a finger might not be smoothly extruded outside the slope where the finger is placed in the interior of the rail protection component. Therefore, the angle of gradient of the slope is made to be 10 to 45 degrees both inclusive, whereby the safety can be improved without need for the rail protection component being unduly large.

In the refrigerator according to the present invention, the drawer door includes a door frame fixed to the drawer door, the door frame is fixed to the third rail, and the rail protection component is affixed to the storage room side end face of the door frame. This enables the rail protection component to be affixed to the door frame, and in the manufacturing process, since the drawer door that installs the door frame and the rail protection component can be joined to the rail device, thereby being capable of improving operability.

In the refrigerator according to the present invention, the rail protection component protects the fixing part of the third rail and the door frame. Touching of a hand or the like to the fixing part is prevented by enshrouding the fixing part of the door frame and the third rail as well, during opening and closing of the drawing door, which can improve safety. Moreover, generation of rust in the end face of the fixing part can be prevented as well.

In the refrigerator according to the present invention, for the rail protection component, an operation for removing burrs generated around a lift eye for coating a door flame need not be performed by protecting the lifting eye disposed in the door frame for coating the door flame. In addition, the generation of rust in a lifting eye for coating can also be restrained.

In the refrigerator according to the present invention, the rail protection component is formed using resin material. This makes it possible to mold the rail protection component even if the shape is complicated. Its coloring is also easy and thus coating is not required and a round shape can be made. Because of this, even if a finger, or the like is touched, the pain at its contact is alleviated, whereby safety is improved.

In the refrigerator according to the present invention, the rail protection component is made similar color to that of the door frame, so that the rail protection component can be set without being distinguished.

In the refrigerator according to the present invention, the upper surface of the rail protection component has substantially the same height as the upper surface of the door frame, whereby the rail protection component does not hinder container installation when a container is installed in the door flame, thereby being capable of improving convenience. In addition, the upper surface of the rail protection component has substantially the same height as the upper surface of the door frame, and therefore a container can also be installed in the rail protection component, so that the load of the container can be applied to both the door frame and the rail protection component in balance; as a result, the durability of the rail device can be improved.

In the refrigerator according to the present invention, the length of each of the third rail and the first rail is a length in which the edge deep inside the container is located forward of the foremost surface portion of the outer box when the storage container is drawn to the maximally drawn position. As a result, the container can be taken off and installed readily when the container is taken off and installed since the container does not interfere with the door in the upper portion.

In the refrigerator according to the present invention, the rail protection component is installed and fixed to the door flame like covering the door frame from thereabove. As a result, the rail protection component is readily installed during its installation, and also the strength of the rail protection component can be secured relatively readily to the load applied from the upper portion of the rail protection component when the container is fixed on the rail protection component, or the like.

In the refrigerator according to the present invention, part of the rail protection component makes contact with the third rail. As a result, the strength of the rail protection component can be secured relatively readily since the load applied from the upper portion of the rail protection component can be supported by the third rail of being a rigid body when the container is fixed on the rail protection component, or the like.

In the refrigerator according to the present invention, a rib is disposed inside the rail protection component. As a result, the deformation of the rail protection component itself can be prevented and also the strength of the rail protection component can be secured relatively readily to the load applied from the upper portion of the rail protection component by the rib when the container is fixed on the rail protection component, or the like.

In the refrigerator according to the present invention, a plurality of engagement portions that join the rail protection component to the door frame are disposed in the rail protection component, whereby the strength of installation of the rail protection component is improved and also the rail protection component is hardly disconnected even if loads are applied from all directions, thereby being capable of surely protecting the end face of the rail device.

The rail device according to the present invention is installable in a refrigerator that comprises a heat insulated box formed by an inner box, an outer box, a heat insulator filled between the inner box and the outer box and the storage room of a drawer type. Moreover, the rail device movably supports back and forth the storage container forming the storage room. In addition, the rail device includes the fixing member fixed to the inside surface of the inner box, and the first, second and third rails that are elongated and disposed such that the longitudinal directions are the same. The second rail has flanges, which protrude right and left, top and bottom of the longitudinal direction; the bottom flange is movably held to the first rail in the longitudinal direction; the first rail is joined to the fixing member, and has flanges extended to a height that exceeds the height of the flange below the second rail on the right and left sides in the longitudinal direction; and the third rail movably holds the flange above the second rail in the longitudinal direction, and supports the storage container; as a result, the rail device is achieved as a rail device installable in various refrigerators.

Hereafter, embodiments of the present invention will be described with reference to the drawings. The same reference numerals are each assigned to the same constructions as the conventional example or the previously described embodiment, and their detailed descriptions are omitted. In addition, the present invention is not limited by this embodiment.

First Embodiment

A refrigerator according to a first embodiment of the present invention will be described below with reference to the drawings. FIG. 1 shows a front view of the refrigerator according to the first embodiment of the present invention. As shown in FIG. 1, refrigerator 51 is a refrigerator having double doors hinged on outer sides respectively, and comprises a storage room partitioned into a plurality of rooms inside heat insulated box 52.

Specifically, from an upper part, refrigerating room 53, ice making room 54, switching room 55 arranged adjacent to ice making room 54 and in which a room temperature can be changed, vegetable room 56, and freezing room 57 are provided as the storage room.

At an opening of each storage room, an insulated door foam-filled with a foam heat insulator such as urethane is arranged. Specifically, at refrigerating room 53, left door 60*a* and right door 60*b* that open and close the opening of heat insulated box 52 are provided.

Moreover, door 61, door 62, door 63, and door 64 of the drawer type are arranged at ice making room 54, switching room 55, vegetable room 56, and freezing room 57, respectively.

Of the aforesaid rooms, the storage rooms other than refrigerating room 53 are the drawer type storage rooms.

Moreover, as shown in FIG. 1, heat insulated box 52 is composed of insulated walls composed by filling foam heat insulator 72 in a space formed by inner box 70 made of a vacuum-molded resin body such as ABS, and outer box 71 using a metal material such as a precoat steel plate.

A radiator (not shown) and a fan (not shown) are arranged behind vegetable room 56 and freezing room 57. The radiator is driven by a compressor (not shown) disposed under the main body of refrigerator 51, and cooled air from the radiator is sent to each of the rooms. Further, a cooling control at a predetermined temperature is performed for each of the storage rooms.

Figure 2:
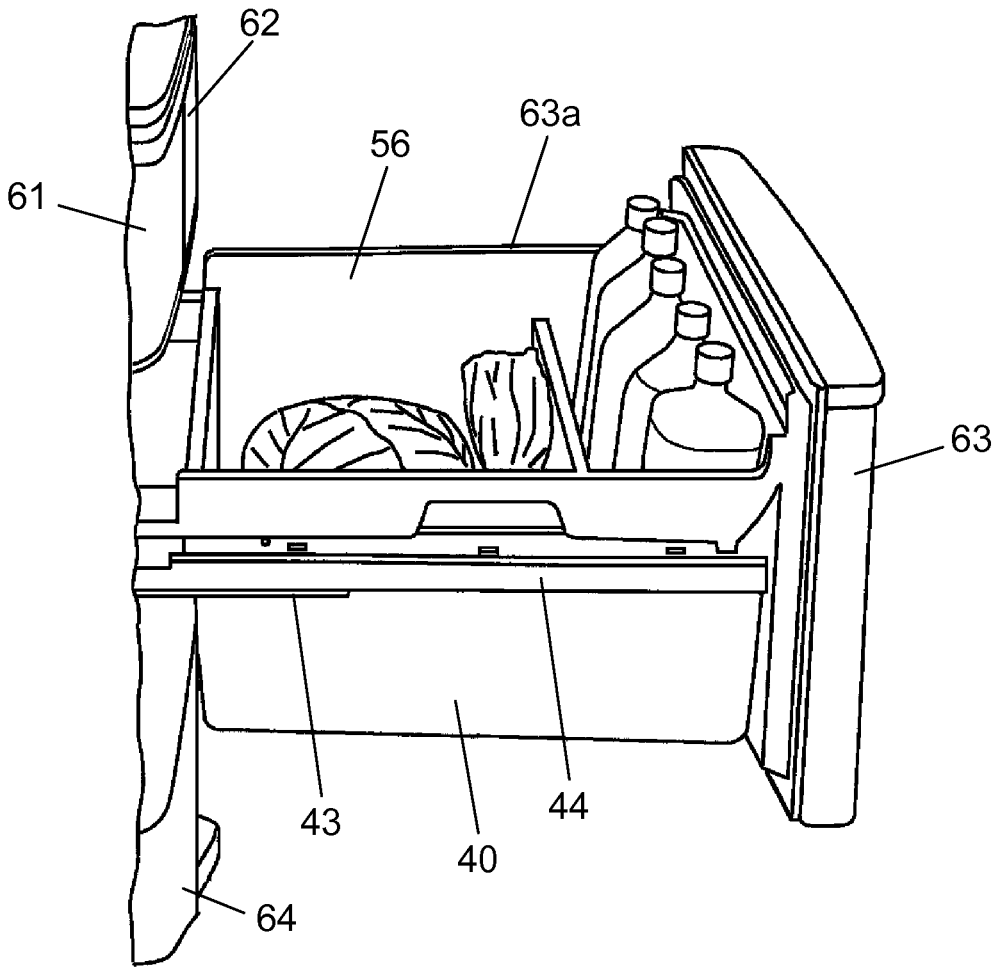
FIG. 2 is a perspective view showing a state that a vegetable room is drawn out from the refrigerator according to the first embodiment of the present invention.

FIG. 2 is a perspective view showing a state that vegetable room 56 is drawn out from refrigerator 51 according to the first embodiment.

FIG. 2 is the perspective view showing the state that the vegetable room is drawn out from the refrigerator according to the present invention. As shown in FIG. 2, vegetable room 56 is the drawer type storage room, and storage container 63*a* composing vegetable room 56 is arranged capable of being drawn out from and into heat insulated box 52 by rail device 40.

Specifically, storage container 63*a* is supported on its right and left sides (corresponding to a front side and a rear side of FIG. 2) each by third rail (top rail) 44 that can move in a back and forth direction of refrigerator 51 via second rail (middle rail) 43.

Second rail (middle rail) 43 is movably supported by first rail (cabinet rail) 42 not shown in FIG. 2. Moreover, bracket 41 is fixed to an inner surface of inner box 70.

An edge of third rail (top rail) 44 that supports each of the right and left sides of storage container 63*a* is connected with door 63. Further, a maximum draw-out distance of door 63 is a length by which storage container 63*a* is completely opened.

That is, the maximum draw-out distance of door 63 is a length that a rear side end face of storage container 63*a* (that is on a left side of FIG. 2) is positioned more toward a front side than front surfaces of door 61 and door 62 that are above vegetable room 56 when vegetable room 56 is completely opened.

In this case, food can easily be put into a rear part of storage container 63*a*, and taken out from the rear part of storage container 63*a*. Moreover, storage container 63*a* doesn't interfere with door 61 and door 62 arranged above when storage container 63*a* is taken out or installed. Therefore, take-out and installation of storage container 63*a* can easily be performed.

Similar to the case of vegetable room 56, a maximum draw-out distance is decided for freezing room 57 as well, and a user can easily take out and install a storage container composing freezing room 57.

Vegetable room 56 and freezing room 57 are drawn out to such positions by rail device 40 extending.

Figure 3:
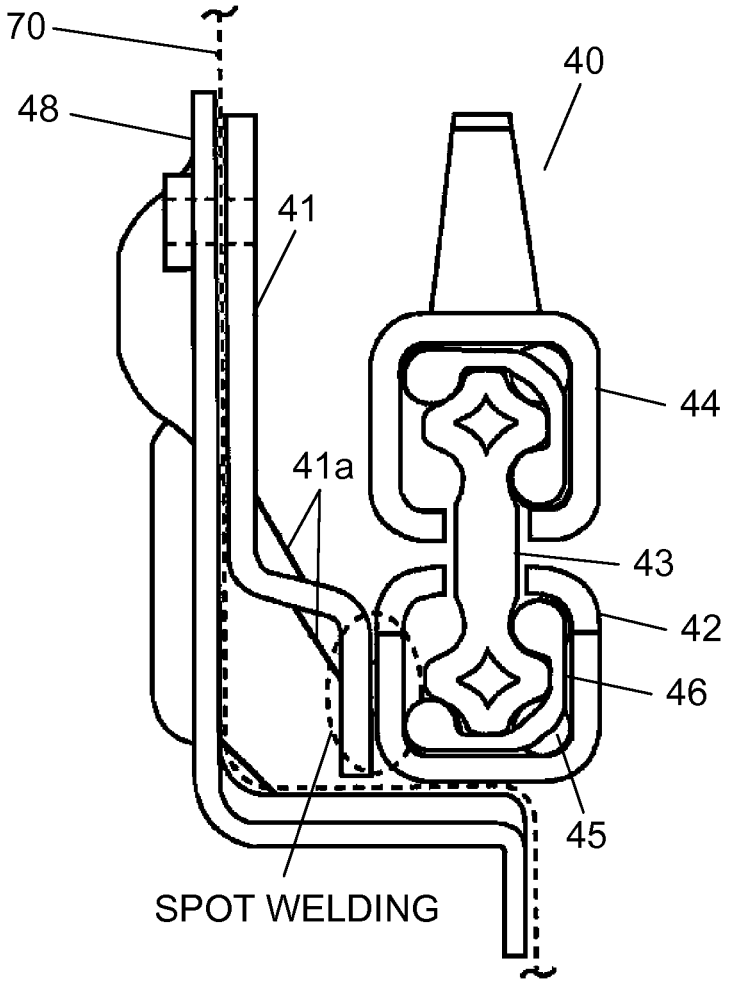
FIG. 3 is a front view showing a configuration outline of a rail device according to the first embodiment.

FIG. 3 is a front view showing a configuration outline of the rail device of the first embodiment. As shown in FIG. 3, rail device 40 is an device that supports the storage container composing the drawer type storage room in a manner that the storage container can move back and forth, and comprises bracket 41, first rail (cabinet rail) 42, second rail (middle rail) 43, and third rail (top rail) 44.

First rail (cabinet rail) 42, second rail (middle rail) 43, and third rail (top rail) 44 have elongated shapes, and are arranged so that their longitudinal directions are identical.

Bracket 41 is one example of a fixing member in the refrigerator of the present invention. Bracket 41 is joined with holder rail 48 by a bolt (not shown) with inner box 70 shown with the dotted line interposed in between. As a result, rail device 40 is fixed to the inner surface of inner box 70.

Moreover, rib 41*a* that connects two faces that are not parallel and exist with a bending position interposed in between is arranged in each of two bending parts included in bracket 41.

Rib 41*a* is one example of a reinforcing part in the refrigerator of the present invention, and strength against bending of bracket 41 is reinforced thereby.

Alternatively, rib 41*a* may be formed integrally with bracket 41 e.g. by embossing a main body of bracket 41. Moreover, for example, independently prepared rib 41*a* may alternatively be welded to bracket 41.

Moreover, bracket 41 connects the first rail 42 and the fixing member while configuring a height of rail device 40 to be the same height as first rail (cabinet rail) 42 (conventional example) that forms the shape of the fixing member that is integral with first rail (cabinet rail) 42. As a result, with components other than rail device 40 being left untouched, it becomes possible to replace the conventional rail device. That is, it becomes easier to share the components other than the rail device.

Specifically, in a case where the fixing member is fixed to a lower surface of the first rail, the height of the entire rail device increases by a plate thickness of the fixing member; however, since a side surface of the first rail is connected to the fixing member and the fixing member does not exist under the first rail, the first rail and the fixing member can be connected having the height of the entire rail device at the same height as the rail device having formed the shape of the fixing member integrally with the first rail (the rail device of the conventional example).

Moreover, an amount (length) of a material necessary for making bracket 41 can be reduced than the conventional ones compared to a case in which bracket 41 extends to below first rail (cabinet rail) 42.

Holder rail 48 is one example of a supplemental member in the refrigerator of the present invention, and is a member for fixing rail device 40 to the inner surface of inner box 70.

As shown in FIG. 3, holder rail 48 has a flange arranged extending to just below the lower surface of first rail (cabinet rail) 42. As a result, the bend of first rail (cabinet rail) 42 toward the lower side can be controlled.

Specifically, by including the flange extending at least to a center position of the lower surface of first rail (cabinet rail) 42, holder rail 48 receives the center position relative to the lower surface of first rail (cabinet rail) 42 by holder rail 48 under first rail (cabinet rail) 42. Moreover, due to holder rail 48 being arranged on foam heat insulator 72 side and holder rail 48 being embedded in foam heat insulator 72, a contacting area between holder rail 48 and foam heat insulator 72 is enlarged, and rail device 40 is prevented from a deformation of bending toward its vertical direction by a resistance of foam heat insulator 72. That is, by devising the shape of holder rail 48 for fixing rail device 40 to inner box 70 as above, a material strength of holder rail 48 can be improved, and the deformation of holder rail 48 toward the vertical direction within foam heat insulator 72 is prevented; and it becomes possible to control an inclination of rail device 40 toward the vertical direction when a load is imposed on rail device 40, and as a result, opening of first rail (cabinet rail) 42 can be controlled. That is, in addition to a role of fixing rail device 40 as originally played by holder rail 48, another role of reinforcing rail device 40 can further be imparted.

Moreover, due to being provided with a vertical flange part extending in the same direction as a force imposed on rail device 40 when the drawer door is drawn out at the lower surface side of rail device 40, holder rail 48 is capable of improving in its shape a strength against a vertical cross-sectional secondary moment, and in addition, a contacting area with the foam heat insulator 72 and the vertical flange part of holder rail 48 is added. The deformation of the vertical flange part that enhances to move along a horizontal direction can be prevented by the contact resistance with foam heat insulator 72. That is, by devising the shape of the holder rail for fixing the rail device to the inner box as above, the material strength of the holder rail can be improved, and the deformation of the holder rail toward the vertical direction within the foaming and heat insulating material is prevented; and it becomes possible to control an inclination of the rail device toward the horizontal direction when the load is imposed on the rail device.

As stated above, by devising the shape of holder rail 48 for fixing rail device 40 to inner box 70, that is, arranging holder rail 48 on foam heat insulator 72 side of inner box 70 to which rail device 40 is attached and having the flange part extending at least to the center position of the lower surface of first rail (cabinet rail) 42 as a fall prevention part of the rail device, the deformation such as inclination of rail device 40 upon the load being imposed is prevented.

That is, in addition to the role of fixing rail device 40 as originally played by holder rail 48, another role of reinforcing rail device 40 can further be imparted.

First rail (cabinet rail) 42 is one example of the first rail in the refrigerator of the present invention, having its side surface making a face-contact with bracket 41. Specifically, bracket 41 and first rail (cabinet rail) 42 are connected by spot welding, and bracket 41 and first rail (cabinet rail) 42 correspond to first conventional rail (fixed rail) 131*a* (see FIG. 12).

Specifically, rail device 40 is composed by a planar section of bracket 41 that is fixed relative to inner box 70 being predeterminedly fixed with a planar section on an outer circumference of first rail (cabinet rail) 42. That is, the planar section that composes bracket 41 and the planar section that composes the outer circumference of first rail (cabinet rail) 42 are opposing one another. The planar section of bracket 41 and the planar section of the outer circumference of first rail (cabinet rail) 42 are facing one another, and the edge of bracket 41 is not opposingly connected to the planar section of the outer circumference of first rail (cabinet rail) 42.

In addition, bracket 41 is fixed to inner surface of inner box 70 and, rail device 40 supports storage container 63*a* in a manner slidable in the back and forth direction directly or indirectly on third rail (top rail) 44.

Due to this, strength of bracket 41 itself that should be reinforced in its strength property can easily be improved. Specifically, a thickness of a material thereof could be increased, and the material could be changed easily.

This spot welding is formed at three positions with regular intervals. Specifically, the spot welding is formed in the vicinity of the respective ends of bracket 41 and a center position of bracket 41, respectively.

Further, first rail (cabinet rail) 42 has flanges extending toward an upper direction arranged at left and right sides respectively in its longitudinal direction (hereinafter, corresponding to a vertical direction relative to a sheet surface of FIG. 3).

Second rail (middle rail) 43 is one example of the second rail in the refrigerator of the present invention. Second rail (middle rail) 43 has an I-shaped vertical cross section in a longitudinal direction, and a shape in which the flanges that project toward the right and left are arranged on an upper side and a lower side respectively along the longitudinal direction.

Between these upper and lower flanges, the lower flange is supported by first rail (cabinet rail) 42 in a manner movable along the longitudinal direction.

Specifically, as shown in FIG. 3, the left and right flanges of first rail (cabinet rail) 42 are extended to a height that exceeds the lower flange of second rail (middle rail) 43. As a result, Second rail (middle rail) 43 is supported movably and stably.

Third rail (top rail) 44 is one example of third rail in the refrigerator of the present invention, and is the rail for supporting the container composing the drawer type storage room such as storage container 63*a*, etc.

Third rail (top rail) 44 has a section shape similar to that of first rail (cabinet rail) 42, and supports the upper flange of second rail (middle rail) 43 in a manner movable in the longitudinal direction.

Each of first rail (cabinet rail) 42 and third rail (top rail) 44, specifically, movably supports second rail (middle rail) 43 via a plurality of bearings 45 retained via ball gauges 46. Here, bearing 45 is one example of the sliding member in the refrigerator of the present invention.

Describing more in detail, between the upper and lower flanges of second rail (middle rail) 43, a part having the lower flange as a center thereof is supported by first rail (cabinet rail) 42 via the plurality of bearings 45.

Further, first rail (cabinet rail) 42 in the aforesaid cross section supports second rail (middle rail) 43 from three directions via the plurality of bearings 45, and thereby supports second rail (middle rail) 43 in a manner movable in the longitudinal direction.

Further, third rail (top rail) 44 supports the part having the upper flange as the center of second rail (middle rail) 43 via the plurality of bearings 45. Moreover, third rail (top rail) 44 in the aforesaid cross section supports second rail (middle rail) 43 from the three directions via the plurality of bearings 45, and thereby supports second rail (middle rail) 43 in the manner movable in the longitudinal direction.

According to the aforementioned combination of first rail (cabinet rail) 42, second rail (middle rail) 43, and third rail (top rail) 44, second rail (middle rail) 43 can move on first rail (cabinet rail) 42 in the longitudinal direction thereof.

In addition, third rail (top rail) 44 can move on second rail (middle rail) 43 in the longitudinal direction thereof. That is, third rail (top rail) 44 can move on first rail (cabinet rail) 42 in the longitudinal direction thereof via second rail (middle rail) 43.

Moreover, upon moving as aforesaid, second rail (middle rail) 43 and third rail (top rail) 44 can move smoothly by the rotation of the pluralities of bearings 45.

Figure 4:
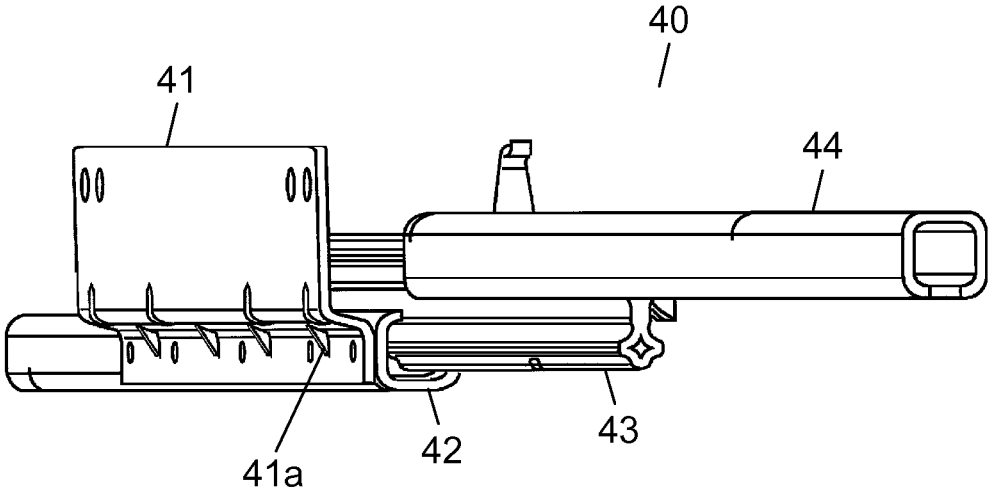
FIG. 4 is a first perspective view showing an appearance of the rail device according to the first embodiment.
Figure 5:
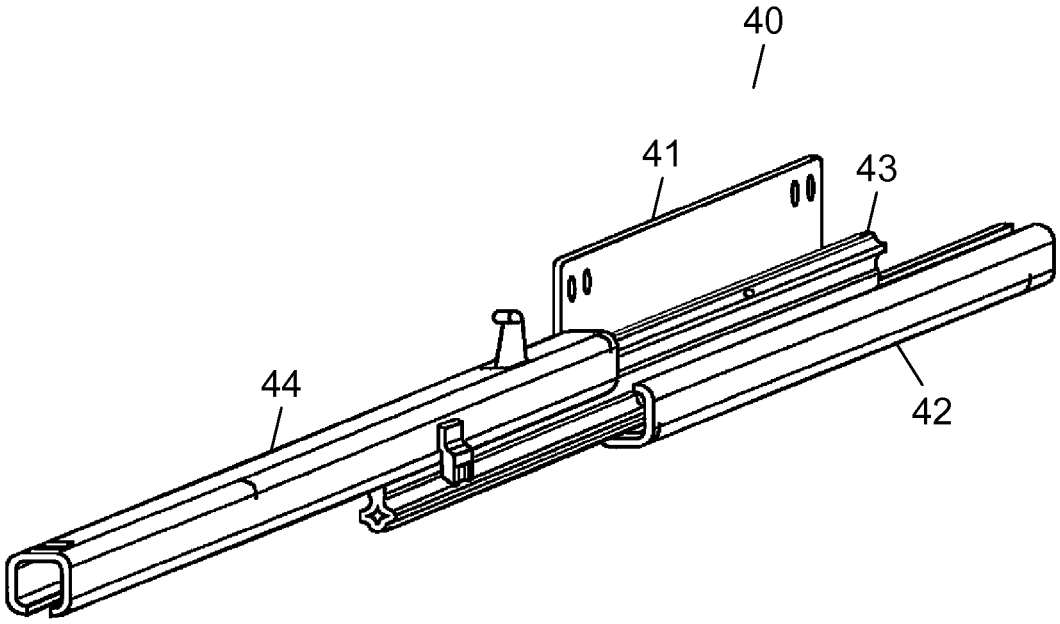
FIG. 5 is a second perspective view showing an appearance of the rail device according to the first embodiment.

FIG. 4 is a first perspective view showing an appearance of the rail device of the first embodiment. FIG. 5 is a second perspective view showing an appearance of the rail device of the first embodiment. As shown in FIG. 4 and FIG. 5, third rail (top rail) 44 moves relative to first rail (cabinet rail) 42 via second rail (middle rail) 43. That is, rail device 40 as a whole expands and contracts.

Specifically, in a case with vegetable room 56, by the user drawing door 63 out, third rails (top rails) 44 on the left and right connected with door 63 are drawn out.

As a result, as shown in FIG. 2, storage container 63*a* supported on third rails (top rails) 44 are drawn out to an outside of heat insulated box 52. That is, vegetable room 56 is opened completely.

Each of lengths of first rail (cabinet rail) 42, second rail (middle rail) 43, and third rail (top rail) 44 is a length that a rear side edge of storage container 63*a* is positioned more toward the front side than the front surface of the door above vegetable room 56 when storage container 63*a* is drawn out to its maximum draw-out position.

As aforementioned, in refrigerator 51 of this embodiment in which vegetable room 56 of the drawer type storage room can open completely, rail device 40 does not lose its convenience of usage, e.g., smoothness of its movement, etc. according to various technical features comprised thereby.

Specifically, as shown in FIG. 3, the right and left flanges of first rail (cabinet rail) 42 are both extendingly arranged to the height that exceeds the lower flange of second rail (middle rail) 43.

That is, a vertical cross section in the longitudinal direction of first rail (cabinet rail) 42 is substantially symmetric.

Further, first rail (cabinet rail) 42 is surface connected with bracket 41 fixed to inner box 70.

Figure 42:
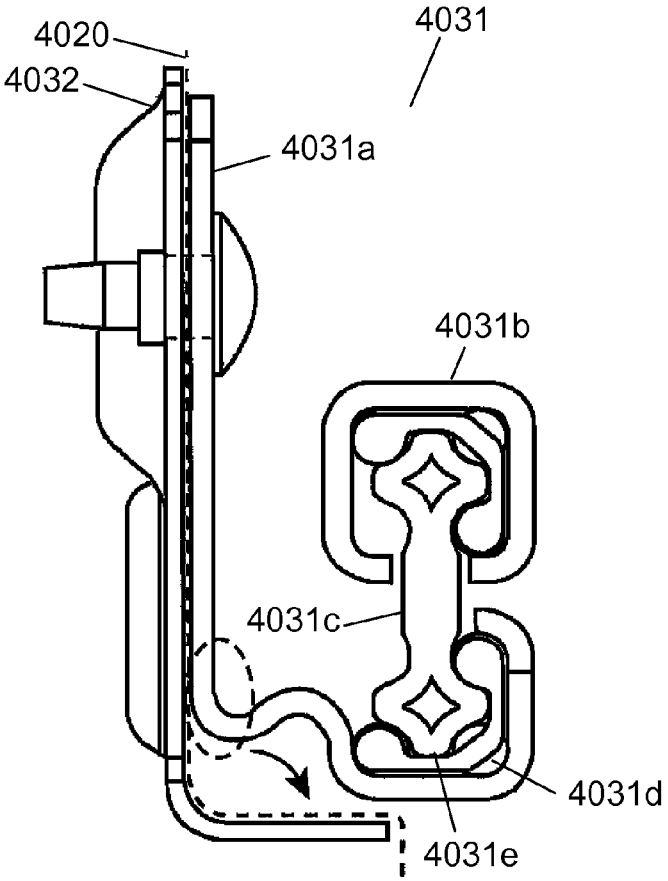
FIG. 42 is a front view showing a configuration outline of rail device 4031 in conventional refrigerator 4051.

Due to this, compared with conventional first rail (fixed rail) 4031*a* as shown in FIG. 42, because the vertical cross section in the longitudinal direction of first rail (cabinet rail) 42 is substantially symmetric, the load on first rail (cabinet rail) 42 from second rail (middle rail) 43 is imposed evenly to the left and right sides, and thus, there is a feature of not being easily opened by a load having a vector in a direction toward inside the room.

Moreover, the load imposed on first rail (cabinet rail) 42 is transmitted to bracket 41 connected to first rail (cabinet rail) 42 by the spot welding.

However, as shown in FIG. 3 and FIG. 4, a plurality of ribs 41*a* is arranged at the bending part of bracket 41. Therefore, an amount of bending relative to the same load is controlled small compared with a case without rib 41*a*.

Moreover, as shown in FIG. 3, a part of the part of holder rail 48 that is inwardly-bent toward inside of the room extends to under first rail (cabinet rail) 42.

Due to this, the amount of inclination of rail device 40 toward the inside of the room and of the amount of bending in a perpendicular direction, etc. are controlled. The length of the part of holder rail 48 bent toward the inside of the room preferably is a length that exceeds a center of first rail (cabinet rail) 42 in the right and left direction.

Further, since the first rail (cabinet rail) 42 is substantially symmetric, it is suited for a rollforming. That is, a manufacture with a high accuracy can be performed easily.

The joint of first rail (cabinet rail) 42 and bracket 41 is spot welded, and thereby, is partially welded. Compared to a case of being successively welded in the longitudinal direction, the deformation (distortion) in the longitudinal direction in the rail device caused by the heat upon welding is controlled, and even in a case of supporting a storage room with a large-volume in an openable manner, the convenience of the usage of the storage room is maintained.

That is, in the first embodiment of the embodiments, by composing the fall prevention part of the rail device by predeterminedly joining the planar section of bracket 41 fixed to inner box 70 and the planar section of first rail (cabinet rail) 42, first rail (cabinet rail) 42 comes to have a section shape that is unlikely to open in a case where a force is applied to first rail (cabinet rail) 42 via second rail (middle rail) 43 that is movably arranged in a groove. Even in the case of supporting the storage container with the large-volume in a completely-openable manner, the deformation of the rail device is prevented, and the convenience of the usage of the storage room is maintained.

Further, since first rail (cabinet rail) 42 is symmetric when seen from its front, it may easily be manufactured with a high accuracy e.g. by rollforming a plate material to fabricate first rail (cabinet rail) 42.

Further, since first rail (cabinet rail) 42 and bracket 41 are independent components, the length of bracket 41 in a depthwise direction can be determined irrelevant to the length of first rail (cabinet rail) 42; and the length of bracket 41 suffices to be long enough to fix the rail device 40 to the inner box, and the amount (length) of the material required for manufacturing the rail device 40 can be reduced than the conventional ones.

As aforementioned, due to both of the two flanges of first rail (cabinet rail) 42 that interpose second rail (middle rail) 43 therebetween being higher than a predetermined height, rib 41*a* being formed at the bending part, and having a configuration in which holder rail 48 supports first rail (cabinet rail) 42 from underneath, the deformation of rail device 40 such as rail device 40 is tilted, bent, or deflected is prevented.

As a result, even when a large quantity of foods etc. is stored in vegetable room 56 having the large volume and capable of being completely opened as shown in FIG. 2, the smoothness in drawing out or drawing in vegetable room 56 is not lost. Further, the user can easily put in and take out the food, and can easily take out and install storage container 63*a* for cleaning of storage container 63*a*, etc.

Further, the rail device of freezing room 57 can employ a configuration similar to that of vegetable room 56.

As aforementioned, refrigerator 51 of the first embodiment of the present embodiments is a refrigerator provided with drawer type storage rooms, and does not lose its convenience of usage even with the large-volume storage rooms.

Moreover, first rail (cabinet rail) 42 is an independent component from bracket 41 that fixes rail device 40 to inner box 70. Therefore, bracket 41 suffices to have only the length necessary for the fixation of rail device 40 to inner box 70. As a result, an advantageous effect that the material necessary for rail device 40 is reduced can be achieved.

In the first embodiment of the present embodiments, the joint of first rail (cabinet rail) 42 and bracket 41 is spot welded, however, they may be successively joined in the longitudinal direction by arc welding, etc.

Moreover, by having a top surface of the flange part of holder rail 48 and a bottom surface of inner box 70 being in direct contact without any heat insulating material in between, when a load is imposed on rail device 40, the deformation of rail device 40 by the load can be prevented by holder rail 48, which is made of stiff material, without having pliable foam heat insulator 72 being interposed, and thereby the reinforcing effect of holder rail 48 can surely be achieved.

Moreover, since holder rail 48 can be attached directly on a surface of the inner box, it becomes easy to control an attachment position of holder rail 48. Holder rail 48 can securely be attached to the predetermined position, and the effect of reinforcement of holder rail 48 can surely be achieved.

Furthermore, due to the lower surface of first rail (cabinet rail) 42 being directly in contact with the upper face of inner box 70, in the case where a load is imposed on rail device 40, if a space exists between the lower surface of first rail (cabinet rail) 42 and the upper face of inner box 70, the rail device will keep deforming without having anything obstructing. The space does not exist between the upper face of inner box 70 and the lower surface of first rail (cabinet rail) 42 due to the upper face of inner box 70 and the lower surface of first rail (cabinet rail) 42 making direct contact, and the deformation of rail device 40 by the aforesaid load becomes possible to suppress by holder rail 48 attached within foam heat insulator 72 of inner box 70. The reinforcement effect of holder rail 48 can surely be achieved.

Although there may be a case in which the lower surface of first rail (cabinet rail) 42 and the upper face of inner box 70 does not necessarily be in direct contact due to an influence of variability in an assembling process of rail device and variability in products, if a gap between the lower surface of first rail (cabinet rail) 42 and the upper face of inner box 70 is equal to or less than 1 mm, compared to the case of making direct contact, a degradation in the reinforcement effect of holder rail 48 is small; with the gap between the lower surface of first rail (cabinet rail) 42 and the upper face of inner box 70 being equal to or less than 1 mm, almost the same working effect as that of the direct contact can be achieved.

Further, rail device 40 according to the first embodiment shown in FIGS. 3 to 5 is one example of a rail device that can maintain the convenience in usage of a storage room even when the storage room is of a large-volume, and is drawn out to be completely opened.

Note that the rail configuration of the present invention is not limited to refrigerators; it may be applied to anything having a drawer mechanism, e.g., a system kitchen, a cupboard, a dish washer, and a desk, but is not limited hereto.

In the first embodiment, an edge part of third rail (top rail) 44 is connected to door 63, and storage container 63*a* is supported by this third rail (top rail) 44. That is, storage container 63*a* is directly supported by third rail (top rail) 44.

However, storage container 63*a* may e.g. be supported by a door frame (not shown) that is connected to door 63. That is, storage container 63*a* may be indirectly supported by third rail (top rail) 44. This door frame is formed from a metal material e.g. iron, and is fixedly connected substantially vertical to door 63 using a screw and the like (not shown) to a surface of door 63 on a storage room side. Further, the door frame is connected to third rail (top rail) 44.

Note that, storage container 63*a* being indirectly supported by third rail (top rail) 44 via this door frame applies similarly to a second embodiment to be described later.

In a storage room having a door for taking out and putting in the storing goods that supports a drawer type container, conventionally, with an aim to provide the user with a certain degree of satisfaction regarding easy handling of the storing goods and easy overview of the inside of the container, a draw-out length had typically been determined according to the convenience in usage. In recent years, in a case of using a storage room e.g. as a vegetable room, in addition to the situation in which a storing amount of vegetables is increasing due to user's preference for healthy diet, due to a further increase of bottled beverages, by the heavy bottled beverages being moved from the refrigerating room to the vegetable room, a great amount of load may be imposed on the storage container of the vegetable room. Under such a circumstance, if the draw-out length is set large for the drawer type container according to the convenience of usage as aforesaid, the load imposed on the rail member which ultimately supports the storage container becomes large, and there is a background which is requiring a rail device with a higher resistance with respect to the load.

This applies also to the freezing room, in which a large amount of food bought at once is frozen.

In the present invention, to be able to take out the container and wash the same any time at the position of usage that is identical to the state of normal use of taking out and putting in the storing goods, such requires a design concept of a dimensional relationship in the front and rear direction of a main body of the refrigerator by which the container can be drawn out to a position that the container can be taken out toward the upper direction by a single drawing action (one time) by the user, a rail device with high load resistivity and a high accuracy that can endure a state that the draw-out length being large, a fixation and attaching configuration with less variability to the refrigerator main body and the door which enhances the merit of the rail device. The present invention provides an assembling configuration of a drawer type rail device to the refrigerator that can comprehensively resolve the technical problem.

The refrigerator according to the first embodiment of the present invention will be described below in more detail with reference to the drawings.

Figure 6:
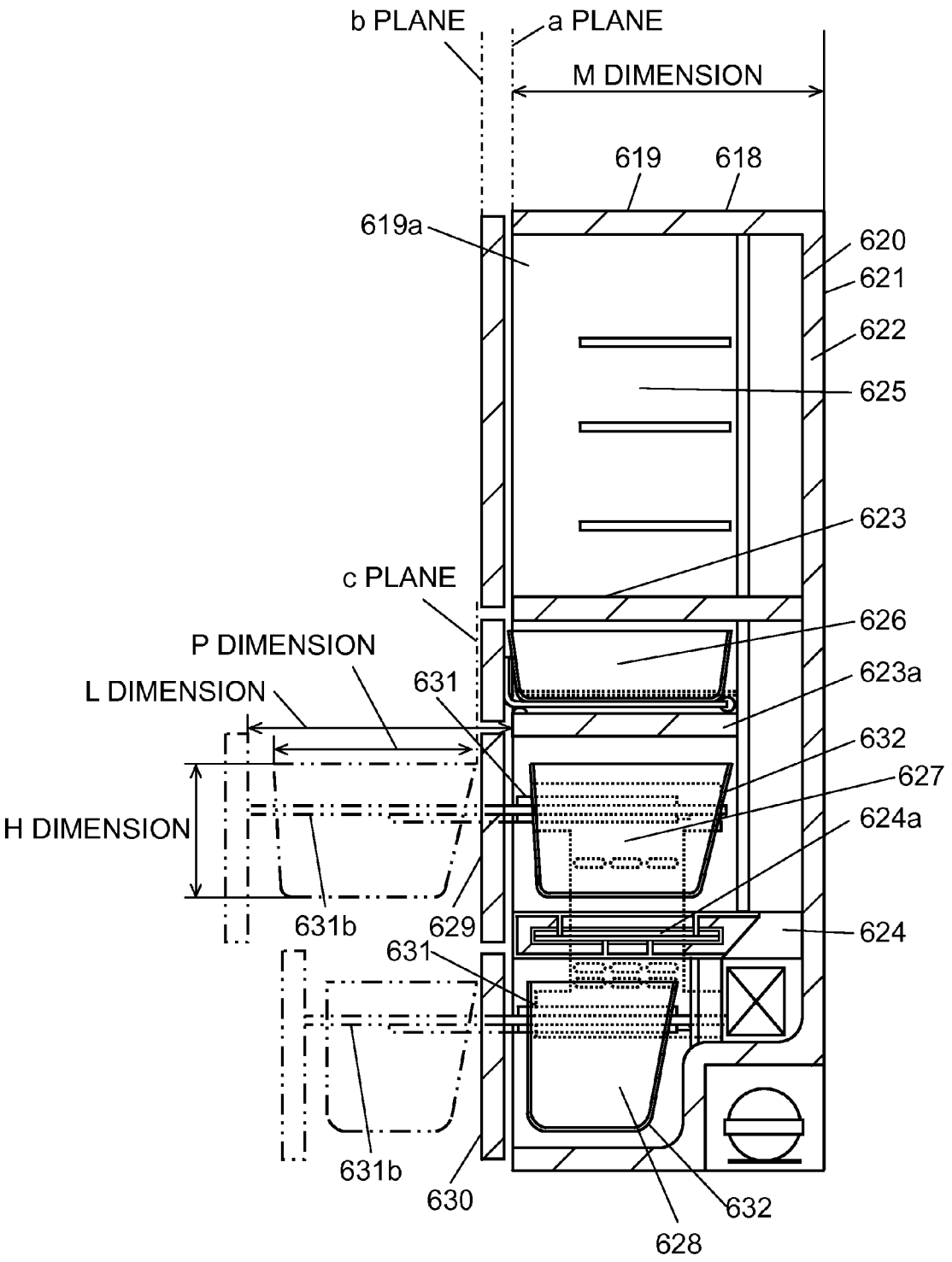
FIG. 6 is a section view seen from a side of the refrigerator according to the first embodiment of the present invention.
Figure 7:
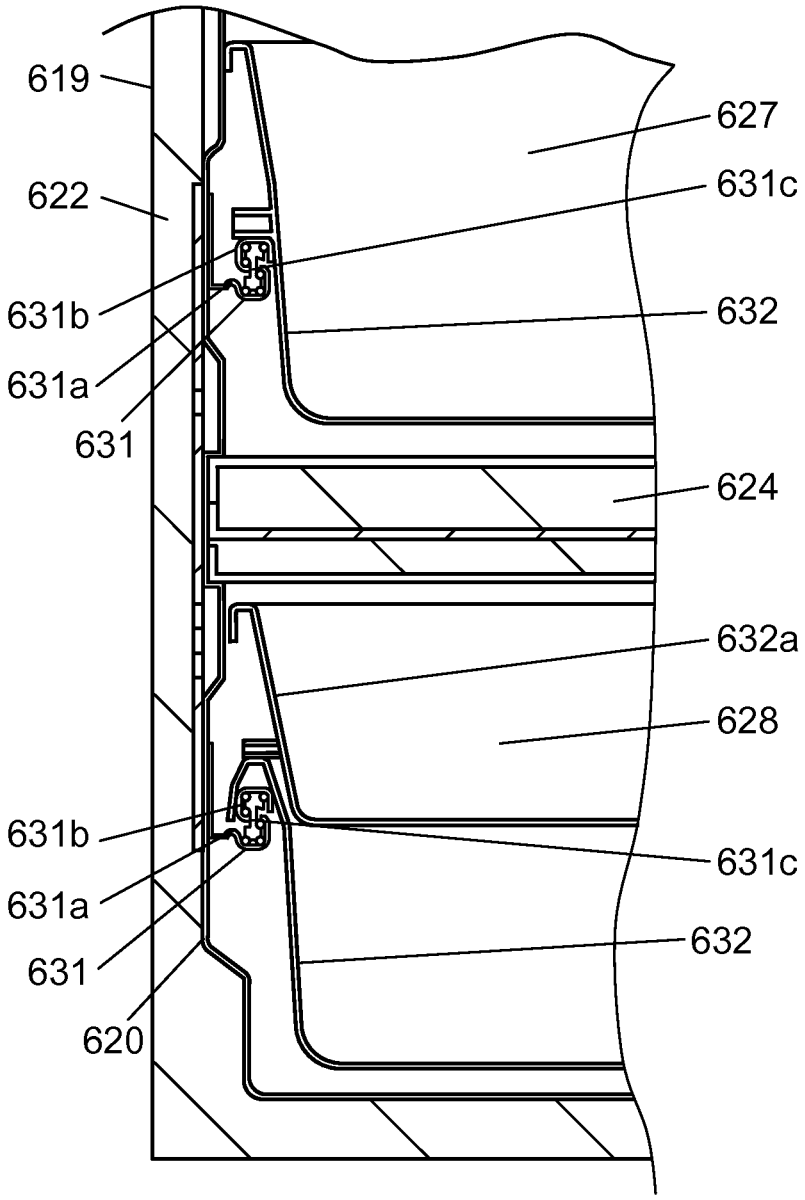
FIG. 7 is a section view seen from a front of the refrigerator according to the first embodiment of the present invention.
Figure 8:
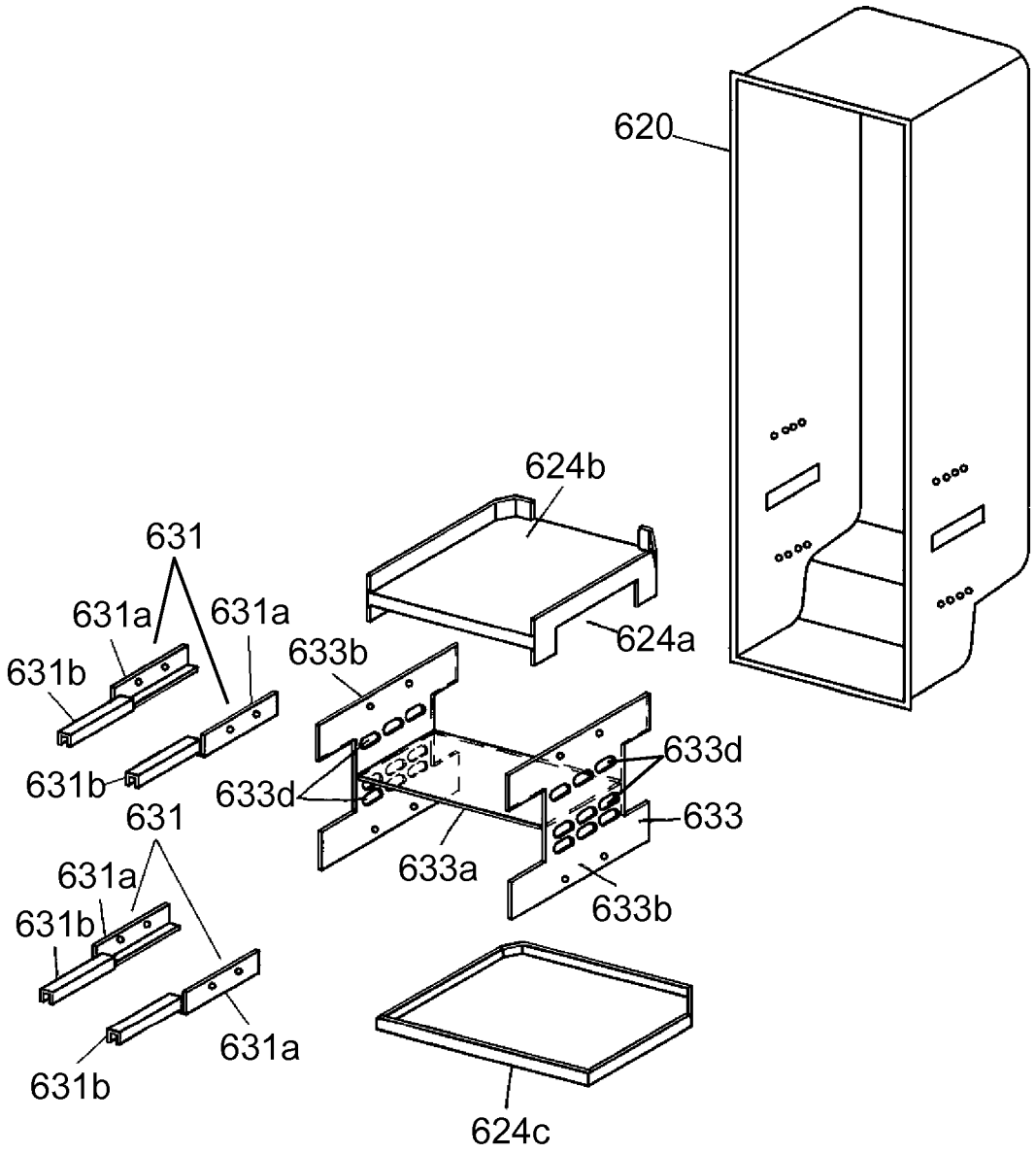
FIG. 8 is an exploded view of the refrigerator according to the first embodiment of the present invention.
Figure 9:
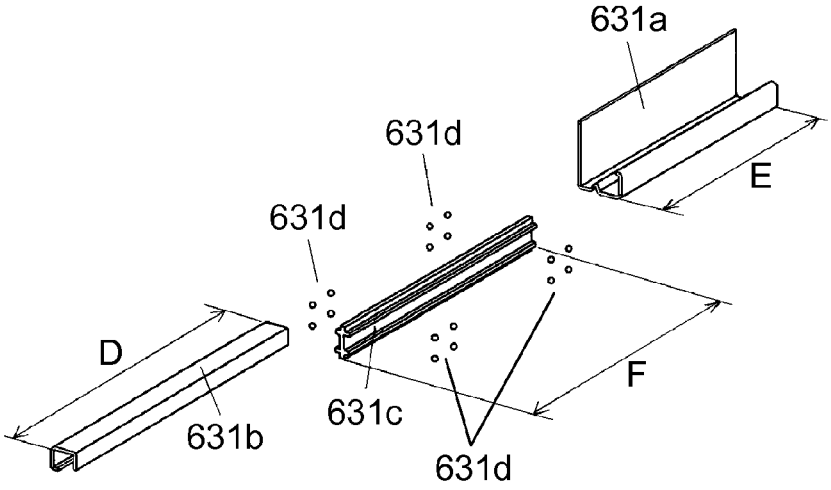
FIG. 9 is an exploded view of the rail device according to the first embodiment of the present invention.
Figure 10:
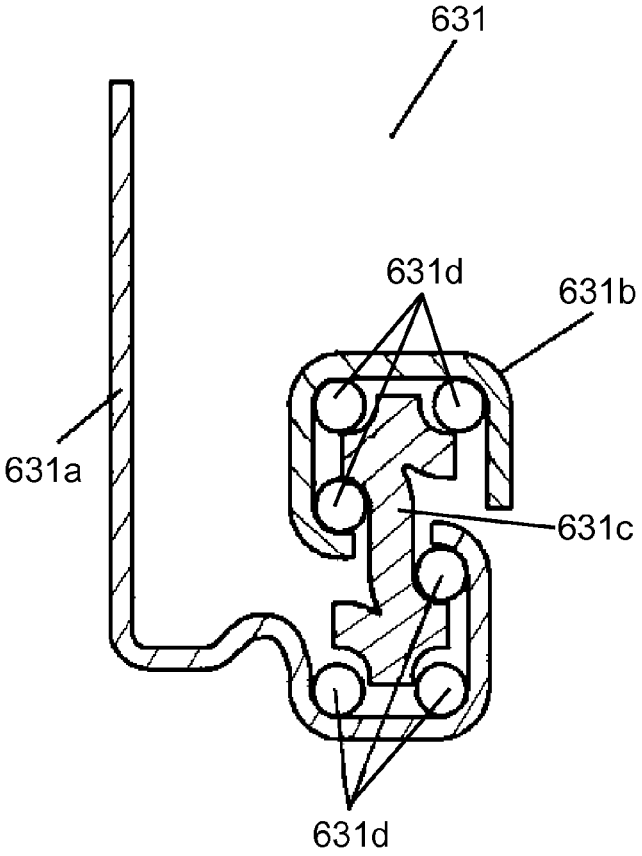
FIG. 10 is a front view showing a configuration outline of the rail device according to the first embodiment of the present invention.

FIG. 6 is a cross sectional side view of the refrigerator according to the first embodiment of the present invention. FIG. 7 is a cross sectional front view of the refrigerator according to the first embodiment of the present invention. FIG. 8 is an exploded view of the refrigerator according to the first embodiment of the present invention. FIG. 9 is an exploded view of the rail device of the first embodiment of the present invention. FIG. 10 is a front view showing schematic configuration of the rail device of the first embodiment of the present invention.

In FIGS. 6-10, a heat insulated box 619 of a refrigerator 618 has foam heat insulator 622 filled in between inner box 620 and outer box 621, comprises front opening 619*a*, and forms from its top part, refrigerating room 625, switching room 626, vegetable room 627, and freezing room 628 by partition walls 623, 623*a*, 624.

Further, both side surfaces of the partition wall 624 comprises opened part 624*a*, and inside partition wall 624, foam heat insulator 622 is filled therein similar to heat insulated box 619.

Further, with partition wall 624 interposed in between, different temperature ranges are set at above and below; e.g., vegetable room 627 arranged above partition wall 624 has a cooling temperature of about 5° C., freezing room 628 has a cooling temperature of about −20° C. that is a freezing temperature range.

Vegetable room 627 and freezing room 628 are drawer type storage rooms having front opening 619*a* with vegetable room drawing door 629 and freezing room drawer door 630, respectively. Further, vegetable room 627, vegetable room drawing door 629 and freezing room drawer door 630 are each capable of sliding in the front and rear direction by being connected by rail member 631 respectively. Further, switching room 626 is also of the drawer type storage room.

Further, an upper end part of vegetable room drawing door 629 is set to be equal to or less than 1000 mm, which corresponds to a height of an elbow of a human from a floor surface.

Rail member 631 is composed of first rail (fixed rail) 631*a*, third rail (moving rail) 631*b*, second rail (intermediate running rail) 631*c* arranged between first rail (fixed rail) 631*a* and third rail (moving rail) 631*b*, and a plurality of bearings 631*d* which is a rotating support member that supports joints of second rail (intermediate running rail) 631*c*, first rail (fixed rail) 631*a* and third rail (moving rail) 631*b*. Further, in a state where first rail (fixed rail) 631*a*, third rail (moving rail) 631*b*, second rail (intermediate running rail) 631*c* and bearings 631*d* being assembled in advance, first rail (fixed rail) 631*a* is fixed to both side walls of inner box 620, and third rail (moving rail) 631*b* is connected to vegetable room drawing door 629 and freezing room drawer door 630 arranged above and below partition wall 624.

Further, container 632 of the respective storage room is supported by third rail (moving rail) 631*b* of rail device 631 after the fixation of rail device 631 to inner box 620, and synchronous to drawing each storage room drawer door out along the front and rear direction, moves together with third rail (moving rail) 631*b* in the front and back, and is further configured such that container 632 can easily be taken out to the upper direction at least when each room drawer door is completely opened.

The operation upon opening this drawer type door enables to be drawn out to the maximum draw-out position by a single drawing action by the user. Although not depicted in the drawings, rail device 631 may be arranged on partition wall 624.

Further, rail device 631 composed of first rail (fixed rail) 631*a*, third rail (moving rail) 631*b*, and second rail (intermediate running rail) 631*c* having bearings 631*d* interposed between the first rail (fixed rail) 631*a* and third rail (moving rail) 631*b* is assembled in advance. By using a high accuracy rail predeterminedly assembled, a clearance between the rails can be set to its minimum.

Further, a horizontal depth (P dimension) of container 632 is set larger than a vertical depth (H dimension), and the draw-out length (L dimension) of vegetable room drawing door 629 and freezing room drawer door 630 is set larger than the depth (P dimension) of container 632.

Further, when vegetable room drawing door 629 and freezing room drawer door 630 are opened to their maximum, inner surface wall on a rear side of container 632 (c plane) is set to position toward the front than front opening 619*a*, that is, a front opening plane (a plane) of heat insulated box 619.

Further, with respect to a depth dimension (M dimension) of heat insulated box 619, the depth (P dimension) of the container 632 provided in vegetable room 627 is about 60%; and is a drawer type storage room having deep length depthwise.

Further, vegetable room 627 is the largest storage room among the plurality of drawer type storage rooms.

Moreover, in order to perform the aforesaid door closing/opening, an entire length (D dimension) of third rail (moving rail) 631*b* of rail device 631 is set larger than an entire length (E dimension) of first rail (fixed rail) 631*a*.

Further, an entire length (F dimension) of second rail (intermediate running rail) 631*c* arranged between first rail (fixed rail) 631*a* and third rail (moving rail) 631*b* via bearings 631*d* is substantially the same as that of first rail (fixed rail) 631*a* (E dimension). Moreover, when vegetable room drawing door 629 and freezing room drawer door 630 are closed, distal ends of first rail (fixed rail) 631*a* and third rail (moving rail) 631*b* are positioned on a substantially the same plane, and rear ends of third rail (moving rail) 631*b* and second rail (intermediate running rail) 631*c* are positioned on a substantially the same plane. Moreover, when vegetable room drawing door 629 and freezing room drawer door 630 are completely open, second rail (intermediate running rail) 631*c* slidably moves such that the distal end of first rail (fixed rail) 631*a* is at substantially the same position as the rear end of third rail (moving rail) 631*b*, and lapping length of second rail (intermediate running rail) 631*c* that lap over with first rail (fixed rail) 631*a* and third rail (moving rail) 631*b* respectively have substantially the same dimension.

Note that, left and right rail device 631 fixed on both side wall surfaces of inner box 620 respectively have symmetric shape with respect to the left and right sides, and by arranging on both of the left and right sides, an excellent slidability is realized thereby.

Further, at the upper part of container 632 of freezing room 628, small-article container 632*a* that is shallower than container 632 is arranged; and this allows distinctive storing of foods.

Further, first rails (fixed rails) 631*a* of rail device 631 paired on the left and right sides are restricted of their fixed positions via inner box 620 by joint member 633, which is a position restricting member.

Joint member 633 includes horizontal portion 633*a* and vertical portions 633*b* arranged on respective ends of horizontal portion 633*a*, and has H-shape in its cross section. Horizontal portion 633*a* is fixed by being interposed between upper partition wall 624*h* and lower partition wall 624*c* inside partition wall 62, and vertical portions 633*b* protrude from opened part 624*a* of partition wall 624 to an outside of partition wall 624, and are arranged on sides of inner box 620 that is filled with foam heat insulator 622; therefore, joint member 633 has a configuration that is not exposed to an inside of the respective storage room.

Further, both ends of each vertical portion 633*b* reach near a central position in an up and down direction of vegetable room 627 and freezing room 628. First rails (fixed rails) 631*a* of rail device 631 on the left and right sides within the respective storage room are fixed to fixing parts 633*c* (not shown) of vertical portions 633*b*, and at least fixing parts 633*c* of vertical portions 633*b* are in contact with the surface of inner box 620 on the side to which foam heat insulator 622 had been filled. Moreover, vertical portions 633*b* on the left and right sides are provided with holes 633*d*.

Further, in a case where joint member 633 becomes large, it can be divided in to plural sections on the front and rear, and each can include horizontal portion 633*a*, vertical portions 633*b* and fixing parts 633*c*, and optionally include holes 633*d* as needed; thereby, same effect as in the case of configuring integral joint member 633 can be achieved. Moreover, bearings 631*d* merely need to be the rotating support member, and a roller, etc. may alternatively be used.

Regarding a refrigerator configured as above, its operation and working effect will be described below.

Firstly, when each of the storage room drawer doors is drawn out toward the front, third rail (moving rail) 631*b* and second rail (intermediate running rail) 631*c* of rail member 631 arranged on each side of the respective storage room smoothly slide toward the front side by the rotation of bearings 631*d*.

In accordance with this, container 632 supported by rail device 631 is drawn out to the front, and cooled goods stored in container 632 can be taken out, and new cooled goods can be stored therein.

As aforementioned, by fixing high accuracy rail device 631, which is in the state of having first rail (fixed rail) 631*a* and third rail (moving rail) 631*b* assembled in advance, to the surfaces of the both side walls of inner box 620, the clearance between first rail (fixed rail) 631*a* and third rail (moving rail) 631*b* can be made small; and a high-quality drawer with less ricketiness can be configured. Moreover, by making the clearance small, the variability in the attachment can also be made small, so that undesirable conditions on the appearance such as a tilting due to bad quality of the attachment of the drawer door and uneven intervals relative to other drawer doors can be prevented. These effects are more prominent when the draw-out tab of rail device 631 is larger. As in the case with the drawer type storage room in the first embodiment, with ones having a large draw-out tab in which the inner wall surface (c plane) of container 632 on the rear side is positioned more toward the front than the front opening plane (a plane) of heat insulated box 619 when opened to its maximum, when the moving rail and the fixed rail are independent device as described in the background art, and a rail that inserts the moving rail arranged on the door side into the groove of the fixed rail arranged on the heat insulated box side from the rear side is used, if the clearance between the rails upon insertion is small, the insertion of the rail becomes extremely difficult. Thus, the clearance between the rails inevitably had to be made large.

Thus, in the case of using the independent rails as in the background art, the variability in the attachment becomes large due to the clearance between the rails are large; and moreover, by the undesirable conditions on the appearance such as the tilting due to bad quality of the attachment of the drawer door and the uneven intervals relative to other drawer doors occurring, a biased load is generated in the rails with this rickety section as a center. Deformations of the rails and an attachment surface due to this biased load are concerned, and an application to a drawer type storage room in which a large load is imposed by a drawer type door having a large draw-out tab as in the first embodiment has been difficult. However, by having high accuracy rail device 631 which is in the state of having first rail (fixed rail) 631*a* and third rail (moving rail) 631*b* assembled in advance, a sufficient reliability can be secured even in the application to the storage room having the large draw-out length.

Further, in the first embodiment, at the maximum draw-out position of vegetable room 627, which is the drawer type storage room having the largest capacity among the plurality of drawer type storage rooms comprised by heat insulated box 619, the inner wall surface (c plane) of container 632 on the rear side is positioned more toward the front than the front opening plane (a plane) of heat insulated box 619.

Due to this, even in the drawer type storage room to which large load is imposed by the drawer type door due to the weight upon storage becoming heavy for having the largest capacity, the occurrence of the biased load generating in the rails with the rickety section being the center is prevented, and the deformations of the rails and the attachment surface due to this biased load, etc. can be reduced. The upper face opening of the container upon opening the drawer door can be maximized without having decreasing the reliability of the refrigerator, and an easiness in taking the food out from the container and an easiness in the take-out and installation of the container itself can be improved.

Further, in the first embodiment, with respect to a dimension of the horizontal depth (M dimension) of heat insulated box 619, the horizontal depth (P dimension) of container 632 of vegetable room 627 is about 60%; and is a drawer type storage room having a large horizontal depth.

Due to this, even in the drawer type storage room having the large horizontal depth which had conventionally been difficult to enlarge its draw-out length, by applying high accuracy rail device 631, which is in the state of having first rail (fixed rail) 631*a* and third rail (moving rail) 631*b* assembled in advance, container 632 provided in the drawer type storage room can be drawn out smoothly to its rear part. Accordingly, a storage ability of the refrigerator for the user can be improved, and a refrigerator with a convenient in its usage can be provided.

Note that, when a ratio of horizontal depth (P dimension) of container 632 comprised by vegetable room 627 relative to horizontal depth dimension (M dimension) of heat insulated box 619 is within a range of about equal to or greater than 55% and equal to or less than 90%, it is a drawer type container of having a large horizontal depth, and by opening the upper face of the container within this range by a large draw-out length, the convenience for the use of the user is dramatically improved compared to the conventional ones.

Further, in ones with the above ratio exceeding 70%, a slim type refrigerator is realized easily with freezing cycle components such as the compressor, the radiator and a condenser not being arranged behind the drawer type storage room, or even with the aforesaid being arranged, a differentiation can easily be made over the conventional refrigerators.

Further, in ones with the above ratio not exceeding 80%, the configuration related to securing the reinforcement against the load to the drawer type container and the rail configurations can be dealt within a relatively reasonable range, and can be realized with a small cost burden.

Moreover, vegetable room 627 which is the drawer type storage room can be drawn out to its maximum draw-out position by a single drawing operation performed by the user.

According to this, since the user can draw out vegetable room 627 to the maximum draw-out position by the single drawing operation, it can be drawn out to the maximum draw-out position smoothly by a one-handed operation, e.g. while holding goods to be stored in the refrigerator, and a refrigerator that can be used conveniently can be provided.

Further, by supporting between first rail (fixed rail) 631*a* and third rail (moving rail) 631*b* by bearings 631*d* that are the rotating support member, even when a load is imposed on container 632, third rail (moving rail) 631*b* can move smoothly, and thereby an operation force for drawing can be reduced, and the convenience in the usage can be improved.

Further, by being able to maintain width dimensions or degrees of parallelism of the pair of rail device 631 on the left and right sides as determined by restricting the attaching positions of first rails (fixed rails) 631*a* of rail device 631 by joint member 633, and by suppressing a dimensional change in heat insulated box 619 by joint member 633, the dimensional change of which is caused by a heat contraction, etc. upon cooling after having filled foam heat insulator 622, even with a specification in which rail device 631 having the clearance between first rail (fixed rail) 631*a* and third rail (moving rail) 631*b* set small being assembled in advance are fixed to both side wall surfaces of inner box 620, the dimensional accuracy between the pair of left and right rail device 631 can be maintained high. Due to this, the easiness in operation upon drawing of container 632 can be increased by joint member 633 which is the position restricting member. Moreover, an operational reliability can be secured over a long period of time.

Further, by comprising second rail (intermediate running rail) 631*c* and setting the entire length (D dimension) of third rail (moving rail) 631*b* of rail device 631 to be larger than that of first rail (fixed rail) 631*a* (E dimension), when vegetable room drawing door 629 and freezing room drawer door 630 are opened to their maximum, the draw-out length (L dimension) can be set larger than horizontal depth (P dimension) of container 32, and the inner wall surface (c plane) on the rear side of container 632 can be positioned more toward the front than the front opening plane (a plane) of heat insulated box 619.

Accordingly, when using vegetable room 627 and freezing room 628, containers 632 moving in connection with vegetable room drawing door 629 and freezing room drawer door 630 can be drawn out to their rear parts, and a thorough view of containers 32 to their rear parts can be obtained. Losses due to forgetting to use the cooled goods within containers 632 can be prevented, and it becomes easy to take out and install container 632 to rail device 631, hence the convenience in the usage can be improved.

Further, in the first embodiment, since the draw-out length of vegetable room 627 which is the drawer type storage room is large, at the maximum draw-out position, container 632 provided in vegetable room 627 can be taken out by lifting upward along a substantially vertical direction.

Due to this, the container can easily be taken out and installed when the user takes out the container upon cleaning the container, etc., the convenience in the usage for the user in keeping the refrigerator clean, in which food is stored, and to which spots etc. adhere easily, can be dramatically improved.

Further, in the first embodiment, at the maximum draw-out position of vegetable room 627, which is the drawer type storage room having the largest capacity among the plurality of drawer type storage rooms comprised by heat insulated box 619, the inner wall surface (c plane) of container 632 on the rear side is positioned more toward the front than the front opening plane (a plane) of heat insulated box 619, and thereby the easiness in taking the food out and the easiness in taking out and installing container 632 can be enjoyed. However, among the plurality of drawer type storage rooms, such configuration can be comprised at least by the drawer type storage room that most requires such an effect, and a distinction in use can be made from the drawer type storage rooms that do not necessarily require this container, then, a reasonable configuration can be selected for a refrigerator having many drawer type storage rooms. For example, in a drawer type container that is relatively compact and has a small capacity, a necessity for such becomes low; and in a case where the door positioned directly above is not a drawer door but is a hinged, rotating type door, under a state that this upper door being opened, the container can be taken out and installed relatively easy. When thoughts are given to a balance with opportunities of the taking out and installing, even with a container not having the above configuration, not so much inconvenience may be recognized thereby.

Further, in the first embodiment, at the maximum draw-out position of vegetable room 627, which is the drawer type storage room having the largest capacity among the plurality of drawer type storage rooms comprised by heat insulated box 619, the inner wall surface (c plane) of container 632 on the rear side is positioned more toward the front than the front opening plane (a plane) of heat insulated box 619. However, more preferably, as shown in FIG. 6, at the maximum draw-out position of vegetable room 627 which is the drawer type storage room, by making the rear end face of container 632 to be positioned more toward the front than the front face (b plane) of the door provided to the storage room located above and adjacent to the drawer type storage room, the door and the like will not be existing at the upper part of the container when the user takes out and put in the stored goods to and from vegetable room 627, thereby an easiness in taking out foods from container 632 can be further improved.

Further, when container 632 is taken out in order for the user to clean container 632 and the like, container 632 can be taken out and installed easily merely by lifting container 632 upward without any obstacles, the convenience in the usage for the user in keeping the refrigerator clean, in which the food is stored, and to which spots etc. adhere easily, can be dramatically improved.

Further, at the upper part of container 632 of freezing room 628, the small-article container 632*a* that is shallower than container 632 is arranged; and this allows distinctive storing of foods. The convenience in the usage is further improved.

By setting a positional relationship of the inner wall surface on the rear side of this shallow, small-article container 632*a*, the front opening plane (a plane) of heat insulated box 619 and the front face (b plane) of the door interposed between the rear end face and the upper part similar to those of container 632, the identical operation and effect can be achieved for shallow small-article container 632*a*.

Further, since the upper end part of vegetable room drawing door 629 is set equal to or below 1000 mm, which is lower than an elbow position of a man, foods can easily be put into and taken out from the foods in container 632.

Further, by making joint member 633 not to expose inside the respective room, compared to the case in which joint member 633 is arranged in the respective room, a reduction in the storage capacity can be prevented.

Further, an injury by an edge of an end face of joint member 633 made of a metal material can be prevented, and thus a safety can be improved; furthermore, edge deletion processing can be banned, and a cost can be reduced.

Further, since joint member 633 joining the left and right first rails (fixed rails) 631*a* is embedded inside foam heat insulator 622 of heat insulated box 619, a condensation and a frosting of joint member 633 upon the use of refrigerator 618 can be prevented, and further, since joint member 633 does not make contact with air, a resistivity to corrosion of joint member 633 can be improved, thereby, since an anti-rust processing can also be decreased, and the cost can be lowered.

Further, by having foam heat insulator 622 around joint member 633, attachment strength of joint member 633 is improved, and the reliability in the positional restriction and the attachment strength of rail device 631 can be improved.

Further, by arranging partition wall 624 that partitions heat insulated box 619 into vegetable room 627 and freezing room 628, and joint member 633 for joining the left and right first rails (fixed rails) 631*a* to be inside partition wall 624, the reduction in the storage capacity due to arranging joint member 633 in the case of having the plurality of storage spaces can be prevented.

Further, by having rail device 631 respectively for vegetable room 627 and freezing room 628 that are adjacent in on the top and below, and integrally fixing first rails (fixed rails) 631*a* of each rail device 631 by joint member 633, the easiness in the operation of the plurality of storage rooms can simultaneously be improved.

Further, by configuring joint member 633 having vertical portions 633*b* and having H-shape in its cross section, and integrally fixing first rails (fixed rails) 631*a* of rail device 631 of vegetable room 627 and freezing room 628 that are adjacent above and below vertical portions 633*b*, the cost can be reduced by reducing a number of components by fixing a plurality of fixing first rails (fixed rails) 631*a* of rail device 631 to a single joint member 633.

Further, in the first embodiment, joint member 633 has the H-shape of having vertical portions 633*b* on both ends and horizontal portion 633*a* therebetween. However, in the case where joint member 633 having holes 633*d* on the right and left vertical portions 633*b* becomes large, it can be divided into the plural sections on the front and rear, and each can include horizontal portion 633*a*, vertical portions 633*b* and fixing parts 633*c*, and optionally include holes 633*d* as needed; thereby, the same effect as in the case of configuring integral joint member 633 can be achieved.

Further, horizontal portion 633*a* of joint member 633 may not necessarily be required depending on a design of the refrigerator; e.g., joint member 633 may not comprise horizontal portion 633*a*, and may comprise a pair of left and right vertical portions 633*b* on the side of inner box 620 to which foam heat insulator 622 has been filled. In this case, vertical portions 633*b* are not connected to each other but are independent components, even in this case also, by arranging the position restricting member by some means so as to determine left and right positions of vertical portions 633*b*, the accuracy in the left and right attachment positions of rail device 631 can be improved. Omitting horizontal portion 633*a* and reducing its resources, a high accuracy rail device can be provided.

Further, by arranging holes 631*c* in vertical portions 631*b* on both ends of joint member 633, a heat transmission from joint member 633 in a case where temperature ranges of the plurality of storage rooms are different is prevented. A condensation on a side of the storage room having a high temperature range can be prevented, and an increase in a consumption of electricity due to heat leaking can be prevented.

Further, as for holes 631*c* to be formed in vertical portions 631*b*, a plurality thereof may be arranged at a degree that the strength can be maintained, and an amount in the heat transmission can effectively be reduced.

Further, in the case where first rails (fixed rails) 631*a* of the pair of left and right rail device 631 are joined by the plurality of joint device 633 in the front and rear direction, especially in a case where these rail device 631 are used in a large-sized refrigerator, joint member 633 can be made smaller by dividing joint member 633 into the plural components, and thereby the cost can be reduced.

Further, in the first embodiment, rail device 631 were same between vegetable room 627 and freezing room 628, however, according to the storing style in a practical use, etc., if ones in which each of the storage rooms is formed by different materials is used, the cost can further be reduced, and the reliability can be improved.

Further, joint member 633 is of a material having a linear expansion rate of 1.0 to $3.0\times10^{-6}$ cm/cm·° C. and a heat conduction rate of 0.1 to 0.2 W/m·K, however, in general, as for the linear expansion rate, metal group is 1.0 to $3.0\times10^{-6}$ cm/cm·° C., and resin group is 1.0 to $15.0\times10^{-5}$ cm/cm·° C.; and the heat conduction rate of the metal group is 1.0 to 400.0 W/m·K, and the resin group is 0.1 to 0.2 W/m·K.

Therefore, as the material of joint member 633, preferably, the metal group having small linear expansion rate may be used in cases where the accuracy in the attachment position of rail device 631 upon operation of refrigerator 618, and the resin group having small heat conduction rate may be used in cases where the prevention of the condensation on the side of the storage room having the high temperature range and the suppression of the increase in the consumption of electricity due to heat leaking are required. Moreover, both may be integrally formed for use with respect to the plurality of storage rooms.

Further, in the first embodiment, the description has been given based on the example of having rail device 631 used in vegetable room 627 and freezing room 628, however, it may be applied to a storage room comprising the drawer container as needed. For example, it may be used in the drawer type storage room such as switching room 626 arranged above vegetable room 627 and ice making room (not shown) that is arranged adjacent to switching room 626.

Further, in the first embodiment, the description has been given based on joint member 633 having the H-shape including horizontal portion 633*a* and vertical portions 633*b* on both ends of horizontal portion 633*a*, and in which rail device 631 of vegetable room 627 and freezing room 628 are integrally fixed, however, a joint member including a vertical portion at each of vegetable room 627 and freezing room 628, can be used. In this case, in a refrigerator in which vegetable room 627 and freezing room 628 are not arranged on the above and below, a high quality drawer having very small ricketiness and which requires small operational force even upon application of the load can be provided. Moreover, compared to the case in which the plurality of rail device is fixed to a single joint member, in the case where the temperature ranges of the plurality of storage rooms differ, further heat transmission from the joint member can be prevented, and the increase in the consumption of electricity due to the heat leaking can be prevented.

Further, the first rails (fixed rails) of the pair on the left and right side may be joined by a plurality of joint device. In this case, by dividing the joint member into plural components, the joint member can be made smaller; thereby, the cost and the weight can be reduced.

Second Embodiment

Figure 11:
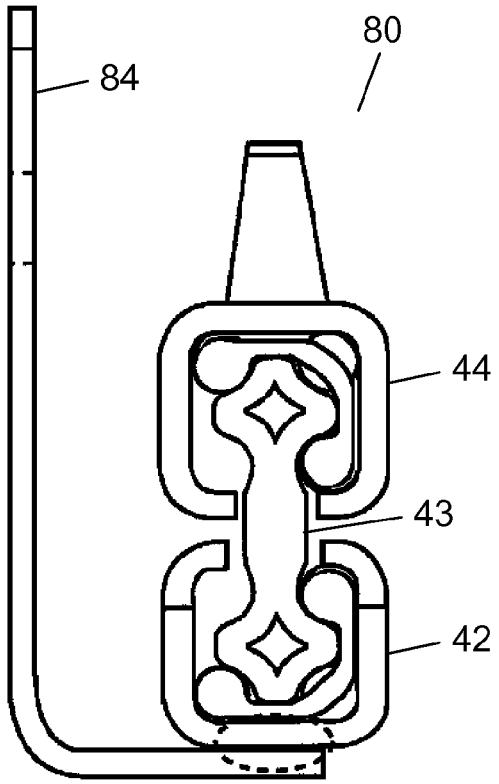
FIG. 11 is a front view showing a configuration outline of a rail device according to a second embodiment of the present invention.

FIG. 11 is a front view schematically showing a configuration outline of a rail device according to a second embodiment of the present invention.

Rail device 80 according to the second embodiment has a different joint position between first rail (cabinet rail) 42 and bracket 84, if compared with rail device 40 according to the first embodiment.

Specifically, the bracket 84 is formed into L-shape as a whole. Further, a lower surface of the first rail (cabinet rail) 42 and the bracket 84 are joined with each other by spot welding (a part surrounded by dot line of FIG. 11).

Namely, the bracket 84 supports the first rail (cabinet rail) 42 from a lower side.

Thus, strength against a vertical load added to the rail device 80 is improved.

Further, the load is added from mainly a vertical direction, to a joining face between first rail (cabinet rail) 42 and bracket 84. Therefore, reliability of this joined part is improved.

Further, bracket 84 has one less bending point, compared with bracket 41 in the first embodiment. Namely, bracket 84 can be manufactured with a smaller number of steps than bracket 41.

Thus, rail device 80 according to the second embodiment has high strength against the vertical load mainly from the vertical direction, and reliability.

Thus, even in a case that rail device 80 supports a storage room having large capacity so as to be fully opened, deflection of rail device 80 is prevented, and usability of the storage room is maintained.

Third Embodiment

Figure 12:
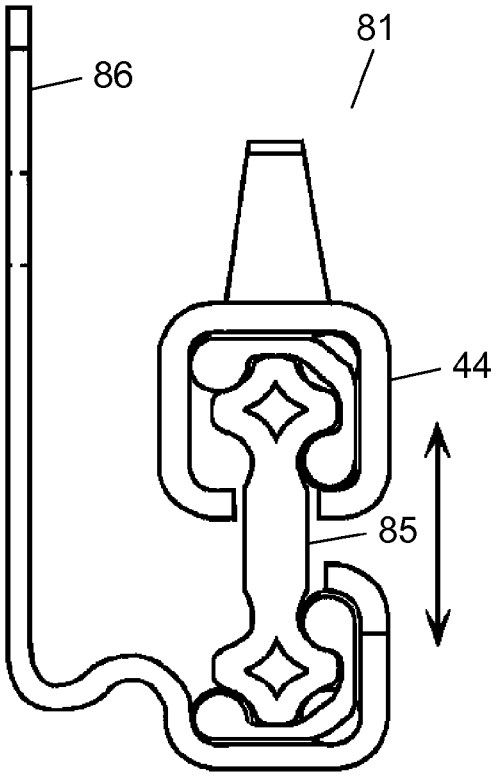
FIG. 12 is a front view showing a configuration outline of rail device 81 according to a third embodiment of the present invention.

FIG. 12 is a front view showing a configuration outline of rail device 81 according to a third embodiment of the present invention.

Rail device 81 according to the third embodiment has first rail (cabinet rail) 86 with the same shape as a shape of conventional fixed rail 4031*a* (see FIG. 42).

Namely, unlike first rail 42 according to the first embodiment, first rail (cabinet rail) 86 is directly fixed to inner box 70.

Further, unlike first rail (cabinet rail) 42, a sectional shape of first rail (cabinet rail) 86 is not symmetrical to the center line. However, a vertical dimension of second rail (middle rail) 85 is longer than a vertical dimension of second rail 43 according to the first embodiment.

Thus, a cross sectional secondary moment of second rail (middle rail) 85 is greater than a cross sectional secondary moment of second rail (middle rail) 43. Namely, second rail (middle rail) 85 has a higher strength against bending than second rail (middle rail) 43.

For example, the cross sectional secondary moment around a center axis, which is required for second rail (middle rail) 85, is calculated in consideration of a position and a magnitude of the load added to rail device 81.

Further, based on the calculated cross sectional secondary moment, and a section shape of second rail (middle rail) 85 including section shapes of an upper flange and a lower flange of second rail (middle rail) 85, the vertical dimension of second rail (middle rail) 85 required for the calculated cross sectional secondary moment is obtained.

By setting an actual dimension in a vertical direction of second rail (middle rail) 85 to be longer than the dimension obtained as described above, an actual cross sectional secondary moment becomes greater than a value of the calculated cross sectional secondary moment.

Thus, by setting the dimension in the vertical direction of second rail (middle rail) to be longer, the strength of second rail (middle rail) 85 against bending can be improved.

Thus, even in a case that rail device 81 supports the storage room having large capacity so as to be fully opened, the deflection of rail device 81 is prevented, and the usability of the storage room is maintained.

Specifically, according to the third embodiment of the present invention, a fall prevention part of the rail device is constituted so that by setting the dimension in the vertical direction of second rail (middle rail) 85 to be longer than a specified dimension, the cross sectional secondary moment in the sectional surface vertical to the longitudinal direction becomes greater than a specified value. With this configuration, the deflection of the second rail (middle rail) is prevented and the usability of the storage room is maintained, even in a case of supporting the storage room having large capacity so as to be fully opened, by varying the dimension of second rail (middle rail) 85 so as to increase the cross sectional secondary moment of second rail (middle rail) 85.

Fourth Embodiment

Figure 13:
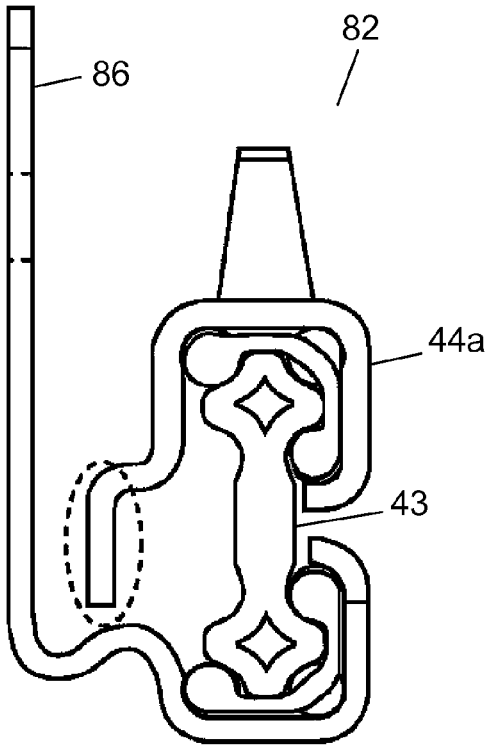
FIG. 13 is a front view showing a configuration outline of a rail device according to a fourth embodiment of the present invention.

FIG. 13 is a front view showing a configuration outline a rail device according to a fourth embodiment of the present invention.

Rail device 82 according to the fourth embodiment has first rail (cabinet rail) 86 having the same shape as the shape of conventional fixed rail 4031*a* (see FIG. 42).

Further, a flange at inner box 70 side (left side in FIG. 13) of third rail (top rail) 44*a* is longer than third rail 44 of the first embodiment (a part surrounded by dot line in FIG. 13).

Specifically, as shown in FIG. 13, third rail (top rail) 44*a* has downward flanges at longitudinally right and left sides of a flange on second rail 43.

Further, the flange at inner surface side (left side in FIG. 13) of inner box 70 of the right and left flanges, is extended downward from the other flange.

Thus, the cross sectional secondary moment of third rail (top rail) 44*a* becomes greater than the cross sectional secondary moment of third rail 44. Namely, third rail (top rail) 44*a* has a higher strength against bending than third rail 44.

Thus, even in a case that rail device 82 supports the storage room having large capacity so as to be fully opened, the deflection of rail device 82 is prevented, and the usability of the storage room is maintained.

Specifically, according to the fourth embodiment of the present invention, the fall prevention part of the rail device is constituted so that the flanges of third rail (top rail) 44*a* are set as downward flanges at longitudinally right and left sides of the flange on second rail 43, and the flange on the inner surface side of the right and left flanges is extended downward from the other flange. With this configuration, the deflection of the third rail is prevented and the usability of the storage room is maintained, even in a case of supporting the storage room having large capacity so as to be fully opened, by changing the shape of the sectional surface of third rail (top rail) 44*a*, so as to increase the cross sectional secondary moment of third rail (top rail) 44*a*.

Fifth Embodiment

Figure 14:
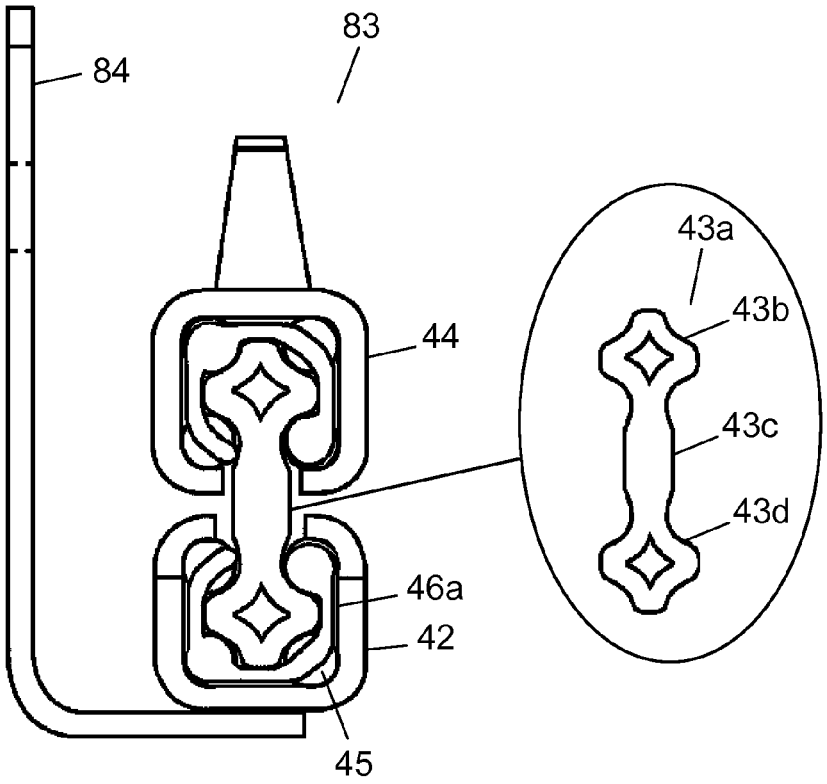
FIG. 14 is a front view showing a configuration outline of a rail device according to a fifth embodiment of the present invention.

FIG. 14 is a front view showing a configuration outline of a rail device according to a fifth embodiment of the present invention.

Similarly to rail device 80 according to the second embodiment, rail device 83 according to the fifth embodiment has bracket 84 formed into L-shape as a whole.

Further, a lower surface of first rail (cabinet rail) 42 and bracket 84 are joined with each other by spot-welding, and bracket 84 supports first rail (cabinet rail) 42 from the lower side.

However, a supporting form in which first rail (cabinet rail) 42 and third rail (top rail) 44 support second rail (middle rail) 43*a*, is different from supporting forms in the first to fourth embodiments.

Specifically, as shown in FIG. 14, when each part of second rail (middle rail) 43*a* is formed as upper flange 43*b*, base plate 43*c*, and lower flange 43*d*, the supporting form shown below is obtained.

That is, first rail (cabinet rail) 42 supports a part around lower flange 43*d*, through a plurality of bearings 45 from four directions on the sectional surface. Thus, second rail (middle rail) 43 is held movably in a longitudinal direction.

Further, third rail (top rail) 44 supports a part around upper flange 43*b*, through the plurality of bearings 45 from four directions on the sectional surface. Thus, second rail (middle rail) 43 is held movably in the longitudinal direction.

Namely, when the first embodiment and the fourth embodiment are compared, second rail (middle rail) 43*a* is supported from more directions in a relation between first rail (cabinet rail) 42 and third rail (top rail) 44.

Thus, the strength against a force in an inward direction (right direction in FIG. 9) of a joint part between third rail (top rail) 44 and first rail (cabinet rail) 42, and second rail (middle rail) 43*a*, is improved.

Thus, even in a case that rail device 83 supports the storage room having large capacity so as to be fully opened, the deflection of rail device 83 is prevented, and the usability of the storage room is maintained.

Note that if second rail (middle rail) 43*a* is supported from four directions, by at least one of first rail (cabinet rail) 42 and third rail (top rail) 44, the strength of rail device 83 is more improved than a case of being supported from three directions.

As described above, the first to fifth embodiments have been described. However, each kind of technical characteristic described in each description and figure may be variously combined.

For example, holder rail 48 shown in FIG. 3 may be used, so that rail device 80 according to the second embodiment is fixed to inner box 70. Thus, inward inclination of rail device 80 and the deflection such as warp of rail device 80 are prevented.

Further, a similar effect is obtained even by using holder rail 48 for fixing the rail device according to each of the third to fifth embodiments, to inner box 70.

Further, for example, a rib similar to bracket 41 of the first embodiment may be provided to a bent part of first rail (cabinet rail) 86 according to the third embodiment. Thus, the strength of first rail (cabinet rail) 86 against bending is improved.

Further, for example, all technical characteristics of each rail device according to the second to fifth embodiments may be combined.

Namely, as described in the second embodiment, a lower surface of first rail (cabinet rail) 42 and L-shaped bracket 84 are joined with each other by spot-welding. Further, as described in the third embodiment, second rail (middle rail) 85 having an elongated vertical dimension, and as described in the fourth embodiment, third rail (top rail) 44*a* having an elongated flange part, are used.

Further, as described in the fifth embodiment, a plurality of bearings 45 are arranged, so that second rail (middle rail) 85 is supported from four directions in the sectional surface, by first rail (cabinet rail) 42 and third rail (top rail) 44*a*.

Thus, the rail device realizing a drawer type storage room with satisfactory usability can be provided, by combining each kind of technical characteristic to enhance reliability of the rail device.

Further, each kind of the rail device according to the first to fifth embodiments can also be used as a drawing mechanism in not only vegetable room 56 and freezing room 57 but also ice making room 54 and switching room 55, being drawer type storage rooms.

Sixth Embodiment

A refrigerator according to a sixth embodiment of the present invention will be described below with reference to the drawings.

Figure 15:
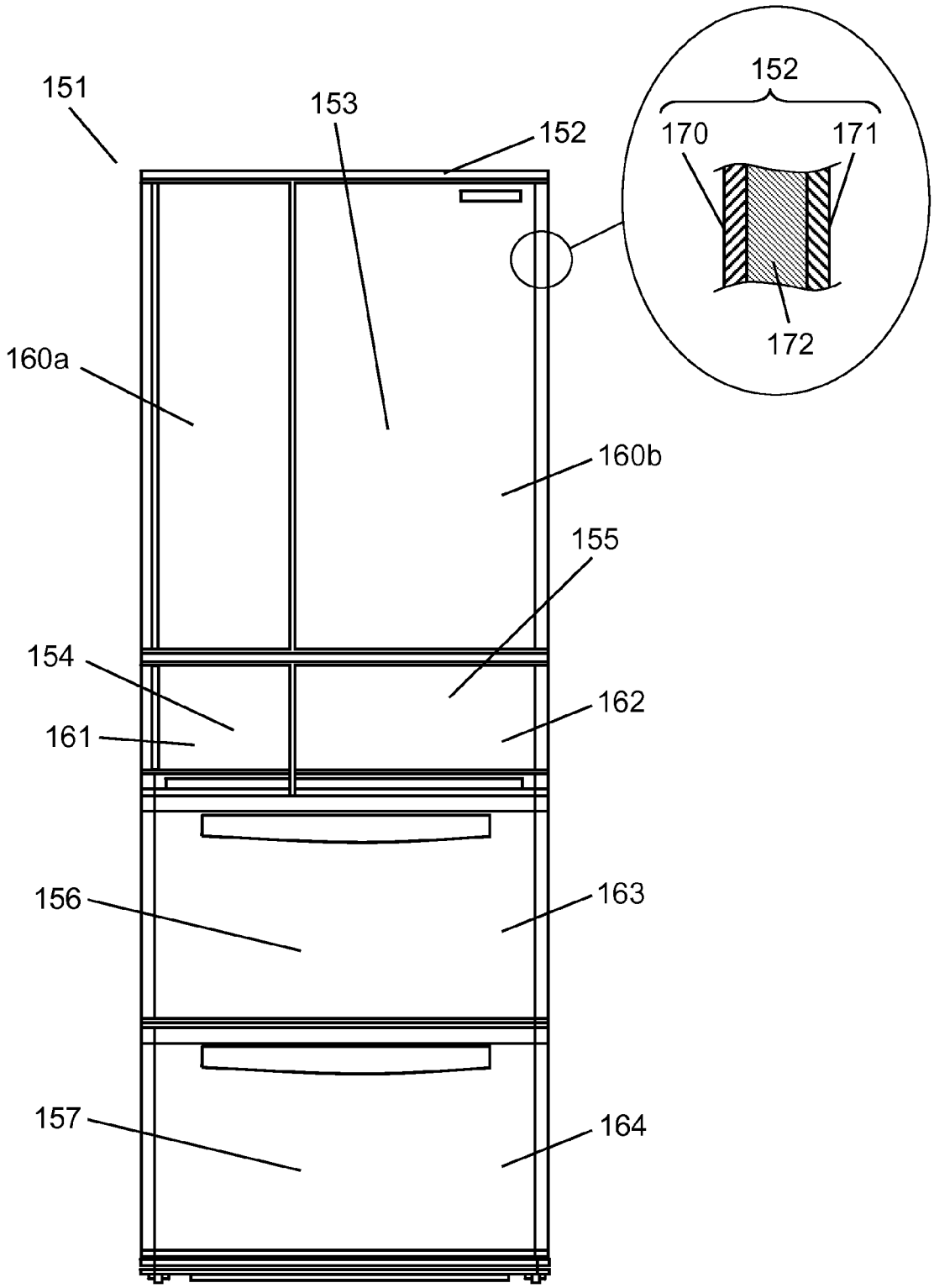
FIG. 15 is a front view of a refrigerator according to a sixth embodiment of the present invention.

FIG. 15 is a front view of the refrigerator according to the sixth embodiment of the present invention.

As shown in FIG. 15, refrigerator 151 is a refrigerator having double-hinged doors and has the storage room partitioned into a plurality of regions in heat insulated box 152.

Specifically, from an upper part, as the storage room, refrigerating room 153, ice making room 154, switching room 155 attached to the ice making room 154 and capable of varying a temperature within a room, vegetable room 156, and freezing room 157 are provided.

An opening part of each storage room is provided with a thermally insulated door filled with a foaming and heat insulating material such as urethane. Specifically, left door 160*a* and right door 160*b* for openably closing the opening part of heat insulated box 152, is provided to refrigerating room 153.

Further, drawer type doors 161, 162, 163, and 164 are provided to ice making room 154, switching room 155, vegetable room 156, and freezing room 157, respectively. Of these storage rooms, the storage rooms excluding refrigerating room 153 are drawer type storage rooms.

Further, as shown in FIG. 15, heat insulated box 152 is formed of a heat insulating wall, in a state that a space is formed by inner box 170 formed by vacuum-molding a resin body such as ABS, and outer box 171 made of a metal material such as precoat steel plate, and this space is filled with foam heat insulator 172.

A cooler (not shown) and a fan (not shown) are provided to lower surfaces of vegetable room 156 and freezing room 157. Then, the cooler is driven by a compressor (not shown) installed in a lower part of a main body of refrigerator 151, and cooled air is sent to each storage room from the cooler. Further, every storage room is controlled to be a specified temperature.

Figure 16:
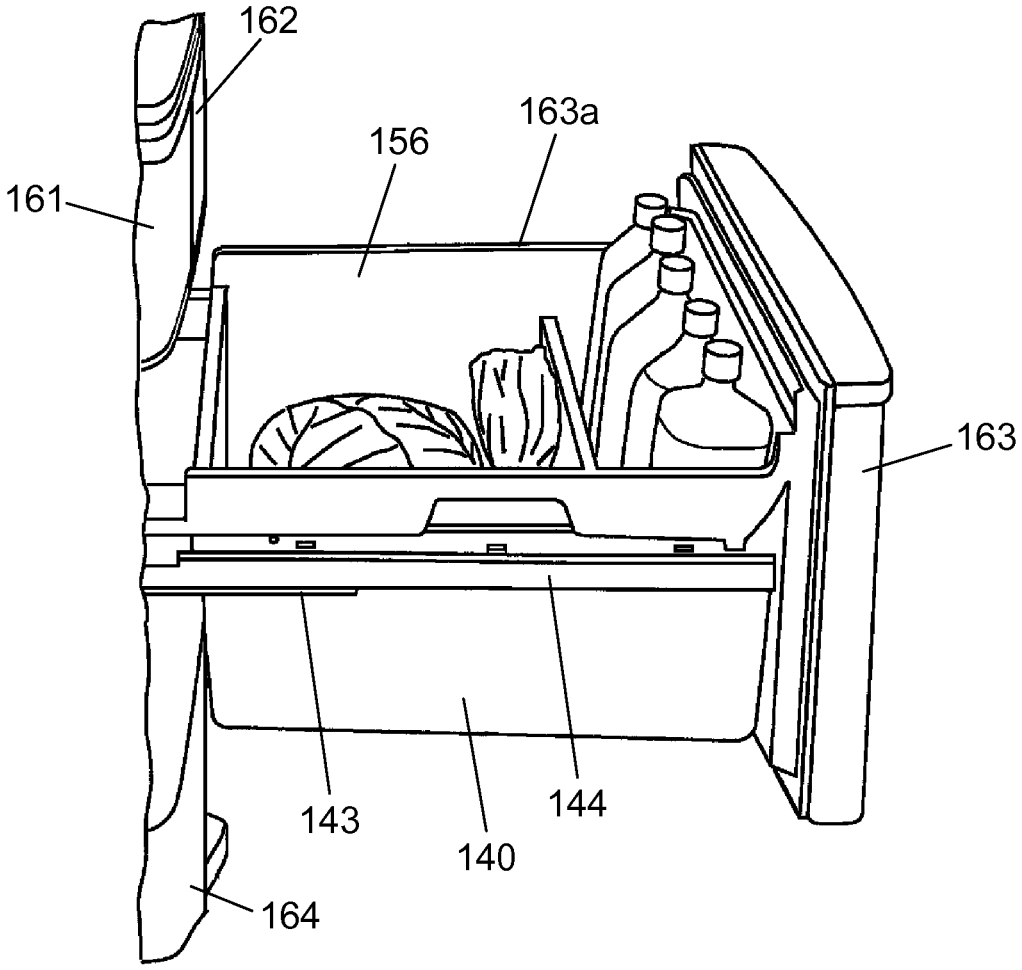
FIG. 16 is a perspective view showing a state that a vegetable room is drawn out from the refrigerator according to the sixth embodiment of the present invention.

FIG. 16 is a perspective view showing a state that the vegetable room is drawn out from the refrigerator according to the sixth embodiment.

As shown in FIG. 16, vegetable room 156 is a drawer type storage room, and storage container 163*a*, by which vegetable room 156 is formed, is provided in heat insulated box 152 drawably by rail device 140.

Specifically, right and left (front side and back side in FIG. 14) of storage container 163*a* is supported by third rail (top rail) 144 that can be moved in front and rear directions of refrigerator 151, via second rail (middle rail) 143.

In addition, second rail (middle rail) 143 is movably supported by first rail (cabinet rail) 142 not shown in FIG. 16. Further, first rail (cabinet rail) 142 is fixed to the inner surface side of inner box 170.

An end portion of third rail (top rail) 144 for supporting each of the right and left of storage container 163*a*, is connected to door 163. Further, a maximum drawable distance of door 163 is a length capable of completely opening storage container 163*a*.

Namely, when vegetable room 156 is fully opened, the maximum drawable distance is a length in which an end face of a back (left side in FIG. 14) of storage container 163*a* is positioned forward from a front faces of door 161 and door 162 immediately above vegetable room 156.

In this case, storage of foods into the back of storage container 163*a*, and taking out of the foods from the back of storage container 163*a* are facilitated. Further, when storage container 163*a* is attached or detached, upper doors 161 and 162 are not interfered with storage container 163*a*. Therefore, the attachment and detachment of storage container 163*a* can be facilitated.

In addition, the maximum drawable distance of freezing room 157 is also determined in the same way as vegetable room 156, and a user can easily attach and detach the storage container by which freezing room 157 is formed.

Vegetable room 156 and freezing room 157 are drawn out to a position by extension of rail device 140.

Figure 17:
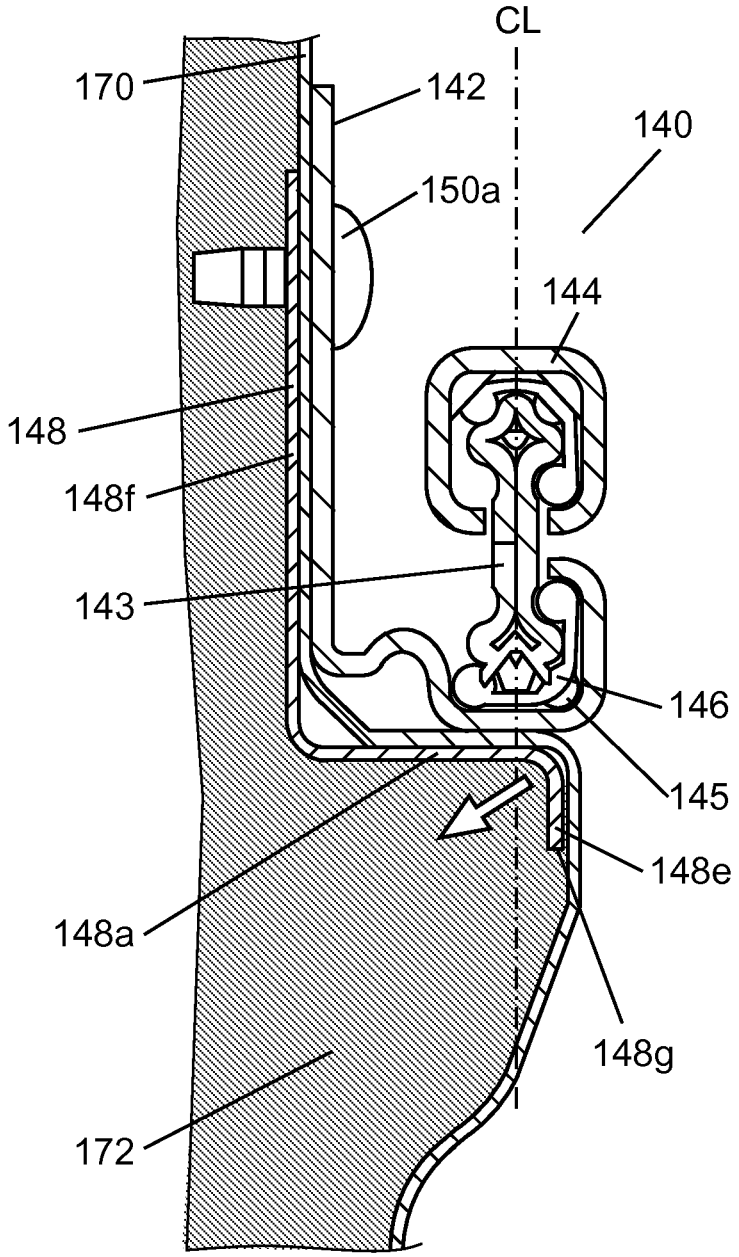
FIG. 17 is a section view showing a configuration outline of rail device 140 according to the sixth embodiment of the present invention.

FIG. 17 is a section view showing a configuration outline of rail device 140 according to the sixth embodiment of the present invention.

As shown in FIG. 17, rail device 140 is a device for movably supporting the storage container, by which the drawer type storage room is formed, in front and rear directions, and has first rail (cabinet rail) 142, second rail (middle rail) 143, and third rail (top rail) 144.

First rail (cabinet rail) 142, second rail (middle rail) 143, and third rail (top rail) 144 have elongated shapes, and are arranged so that longitudinal directions thereof are the same.

Further, first rail (cabinet rail) 142 is fastened to holder rail 148 with screws 150*a*, with inner box 170 held between. Thus, rail device 140 is fixed to the inner surface of inner box 170. Holder rail 148 is an example of auxiliary members in the refrigerator of the present invention, and is a member for fixing rail device 140 to the inner surface of inner box 170. Holder rail 148 is disposed at foam heat insulator 172 side, and specifically the holder rail 148 is embedded in foam heat insulator 172.

As shown in FIG. 17, holder rail 148 has flange part 148*a* extended just under a lower surface of first rail (cabinet rail) 142. Thus, the downward warp deflecting to the lower side of first rail (cabinet rail) 142 can be prevented. Specifically, holder rail 148 has flange part 148*a* extended to at least a center position of the lower surface of first rail (cabinet rail) 142. Then, holder rail 148 has vertical flange part 148*e* obtained by bending a tip end of flange part 148*a* downward almost at a right angle in a vertical direction.

First rail (cabinet rail) 142 is an example of the first rail in the refrigerator of the present invention.

Rail device 140 is constituted in such a manner that first rail (cabinet rail) 142 is fixed to the inner surface of inner box 170 and storage container 163*a* is directly or indirectly supported by third rail (top rail) 144 so as to slide in the front and rear directions.

The section shape of first rail (cabinet rail) 142 is not symmetrical to the center line.

Second rail (middle rail) 143 is an example of second rail in the refrigerator of the present invention. Second rail (middle rail) 143 has the sectional surface vertical to the longitudinal direction formed into I-shape, and has a protruded flange rightward and leftward disposed at upper and lower sides in the longitudinal direction.

The lower flange of the upper and lower flanges is movably held in the longitudinal direction by first rail (cabinet rail) 142.

Third rail (top rail) 144 is an example of the third rail in the refrigerator of the present invention, and is a rail for supporting the container that forms the drawer type storage room such as storage container 163*a*.

Third rail (top rail) 144 has the sectional surface U-shape, and holds the flange on second rail (middle rail) 143 movably in the longitudinal direction.

Specifically, each of first rail (cabinet rail) 142 and third rail (top rail) 144 movably holds second rail (middle rail) 143 via plural bearings held by ball gauge 146. Here, bearing 145 is an example of a sliding member of the refrigerator of the present invention.

More specifically, a part around the lower flange out of the upper and lower flanges of second rail (middle rail) 143 is held by first rail (cabinet rail) 142 via plural bearings 145.

Further, by holding second rail (middle rail) 143 from three directions through the bearings 145 on the sectional surface of first rail (cabinet rail) 142, second rail (middle rail) 143 is held by first rail 142 movably in the longitudinal direction.

Moreover, a part of second rail (middle rail) 143 around the upper flange is held by third rail (top rail) 144 through the bearings 145. In addition, by holding second rail (middle rail) 143 from three directions via bearings 145 on the sectional surface of third rail (top rail) 144, second rail (middle rail) 143 is held movably by third rail (top rail) 144 in the longitudinal direction.

First rail (cabinet rail) 142, second rail (middle rail) 143, and third rail (top rail) 144 are thus combined to allow second rail (middle rail) 143 to be moved on first rail (cabinet rail) 142 in the longitudinal direction thereof.

Further, third rail (top rail) 144 can be moved on second rail (middle rail) 143 in the longitudinal direction thereof. Namely, third rail (top rail) 144 can be moved on first rail (cabinet rail) 142 in the longitudinal direction thereof through second rail (middle rail) 143.

In such a movement, second rail (middle rail) 143 and third rail (top rail) 144 can be smoothly moved by rotation of the bearings 145.

The fall prevention part of the rail device according to the present invention will be described below.

As shown in FIG. 42, when a load is applied to conventional rail device 4031, rail device 4031 is likely to be deflected in a direction shown by the arrow. Namely, fixed rail 4031*a* attempts to be opened.

However, as shown in FIG. 17, holder rail 148 has flange part 148*a* extending to at least the center position of the lower surface of first rail (cabinet rail) 142. Therefore, the center position with respect to a bottom surface of first rail (cabinet rail) 142 in the lower part of first rail (cabinet rail) 142, is received by holder rail 148. Further, holder rail 148 is disposed at foam heat insulator 172 side, and holder rail 148 is embedded in foam heat insulator 172. Therefore, a contact area between holder rail 148 and foam heat insulator 172 becomes large. Accordingly, the vertically downward deflection of rail device 140, can be prevented by resistance caused by contacting foam heat insulator 172. Namely, by devising the shape of holder rail 148 for fixing rail device 140 to inner box 170, material strength of holder rail 148 itself is improved and also the deflection of holder rail 148 in the vertical direction within foam heat insulator 172, can be prevented. Therefore, vertical inclination of rail device 140 caused by the load applied to rail device 140 can be prevented. As a result, the opening of first rail (cabinet rail) 142 can be prevented. Namely, holder rail 148 that functions to fix rail device 140 can also function to reinforce rail device 140.

Further, on the bottom surface of rail device 140, holder rail 148 has vertical flange part 148*e* extending in the same direction as the direction of adding force to rail device 140 when a drawer door is drawn out. Therefore, as the shape of holder rail 148, the strength is improved by increasing the vertical cross sectional secondary moment, and a contact area with foaming and foam heat insulator 172 in a horizontal direction of vertical flange part 148*e* of holder rail 148 is increased, thus making it possible to suppress the deflection, such as allowing vertical flange part 148*e* to move in the horizontal direction (shown by arrow in FIG. 17), by resistance caused by contact with foaming and foam heat insulator 172. Namely, by devising the shape of the holder rail for fixing the rail device to the inner box, the material strength of the holder rail itself can be improved, and also the deflection of the holder rail in the horizontal direction within the foaming and heat insulating material can be prevented. Thus, the inclination of the rail device in the horizontal direction when the load is applied to the rail device can be prevented.

As described above, the shape of holder rail 148 is devised, for fixing rail device 140 to inner box 170. Namely, according to the sixth embodiment, holder rail 148 is disposed at foaming and foam heat insulator 172 side of inner box 170 in which rail device 140 is provided, having flange part 148*a* extending to at least the center position of the lower surface of first rail (cabinet rail) 142. This configuration suppresses the deflection, such as vertical inclination of rail device 140 when the load is applied to rail device 140, can be prevented.

Namely, holder rail 148 which originally has a function of fixing rail device 140 can also have a function of reinforcing rail device 140.

Figure 18:
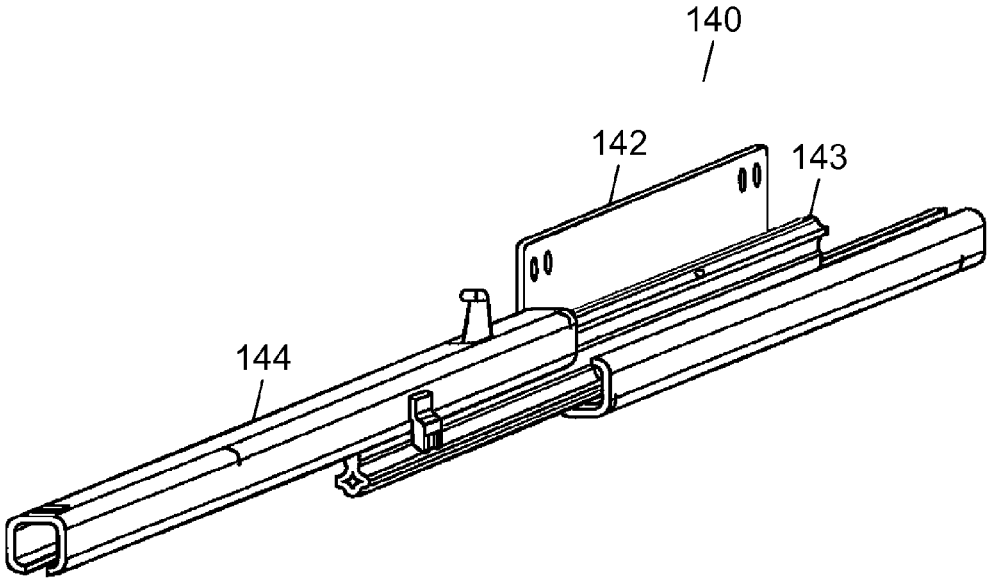
FIG. 18 is a perspective view showing an appearance of the rail device according to the sixth embodiment of the present invention.

FIG. 18 is a perspective view showing an appearance of the rail device according to the sixth embodiment of the present invention. As shown in FIG. 18, third rail (top rail) 144 moves with respect to first rail (cabinet rail) 142 through second rail (middle rail) 143. Namely, contraction and extension of rail device 140 as a whole occurs.

Specifically, in a case of vegetable room 156, by drawing out drawer door 163 by a user, right and left third rails (top rails) 144 connected to door 163, are drawn out.

Thus, as shown in FIG. 16, storage container 163*a* supported by third rails (top rails) 144 is drawn out to outside of heat insulated box 152. Namely, vegetable room 156 is fully opened.

Further, lengths of first rail (cabinet rail) 142, second rail (middle rail) 143, and third rail (top rail) 144 are determined such that the deep end side of storage container 163*a* is positioned forward from the front face of the door directly above vegetable room 156 when the storage container 163*a* is drawn to the maximum drawn position.

Thus, refrigerator 151 according to the sixth embodiment capable of fully opening vegetable room 156 constituting the drawer type storage room attains usability such as smoothness of a drawer, by having various technical characteristics of rail device 140.

Figure 19:
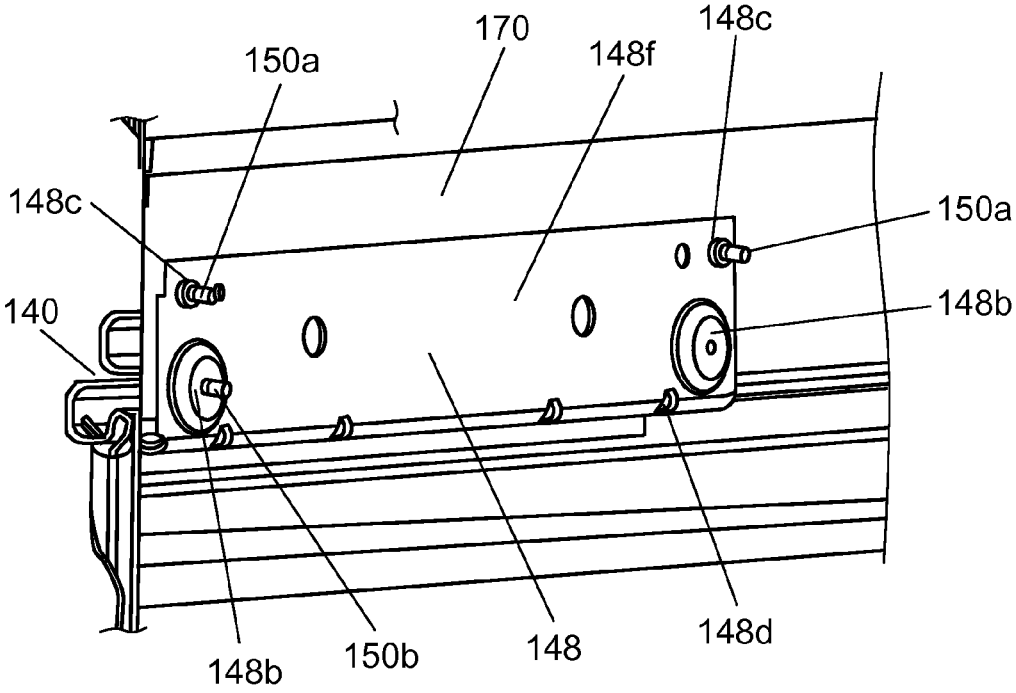
FIG. 19 is a perspective view showing a state that a holder rail is attached in the sixth embodiment of the present invention.

FIG. 19 is a perspective view showing an attachment state of the holder rail according to the sixth embodiment of the present invention. As shown in FIG. 19, holder rail 148 is attached to the reverse side of inner box 170.

Specifically, first, fixing part 148*b* of the auxiliary member to be fixed to inner box 170 provided to holder rail 148 is aligned to a hole provided to inner box 170 and fixed with screws 150*b*. Thereafter, space between inner box 170 and outer box 171 is filled with foaming and foam heat insulator 172, such as urethane, to embed holder rail 148 in foaming and foam heat insulator 172 in a state of being fixed to the back surface of inner box 170, and holder rail 148 is more firmly fixed to inner box 170 by solidifying foaming and foam heat insulator 172. Thereafter, rail device 140 is disposed in inner box 170, then a hole (not shown) provided to first rail (cabinet rail) 142, and fixing part 148*c* of the rail device provided to holder rail 148 are aligned with each other and fixed by screws 150*a*, so that rail device 140 is fixed to inner box 170.

Figure 20:
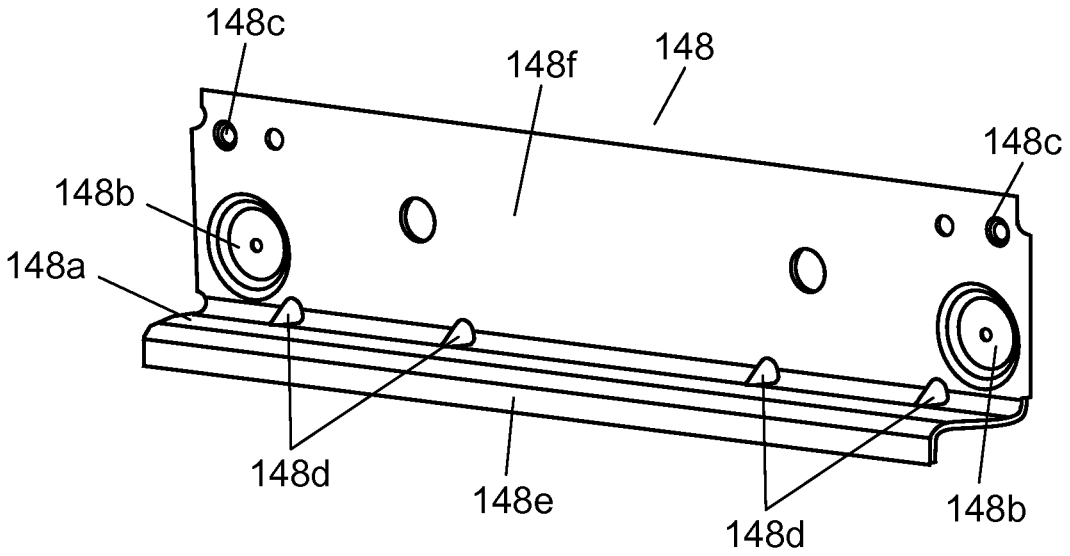
FIG. 20 is a perspective view showing the holder rail according to the sixth embodiment of the present invention.

FIG. 20 is a perspective view showing the holder rail according to the sixth embodiment of the present invention. Flange part 148*a* provided to holder rail 148 is set in a state of receiving a downward load applied to rail device 140 extended in the longitudinal direction, when door 163 is drawn out. At this moment, flange part 148*a* moves so as to expand an angle which is defined by side surface 148*f* of holder rail 148, being a fitting face of holder rail 148 having fixing part 148*b* of the reinforcing part and fixing part 148*c* of the rail device, and a face having flange part 148*a*. Owing to the deflection to a direction in which the angle formed by the above two faces is expanded, warp of rail device 140 is generated, thus damaging operability during opening and closing the drawer door.

Thus, by devising the shape of holder rail 148 to enhance reliability of the rail device, the rail device realizing the drawer type storage room with good usability can be provided.

As described above, holder rail 148 has flange part 148*a* extended to at least the center position of the lower surface of first rail (cabinet rail) 142, thereby receiving the center position of first rail (cabinet rail) 142 by holder rail 148 in a lower part of first rail (cabinet rail) 142, and also increasing the contact area between holder rail 148 and foam heat insulator 172. This makes it possible to suppress the vertically downward deflection of rail device 140 by the resistance caused by contact with foam heat insulator 172. Namely, by devising the shape of holder rail 148 to fix rail device 140 to inner box 170, the material strength of holder rail 148 itself is improved, and the vertical deflection of holder rail 148 within foam heat insulator 172 can be prevented. This configuration suppresses the deflection such as vertical inclination of rail device 140 when the load is applied to rail device 140, and as a result, the opening of first rail (cabinet rail) 142 can be prevented. Namely, holder rail 148 which originally has a function of fixing rail device 140, can also have a function of reinforcing the rail device 140.

Further, on the bottom surface of the rail device 140, holder rail 148 has vertical flange part 148*e* extending in the same direction as the direction of adding force to rail device 140 when a drawer door is drawn out. Therefore, as the shape of holder rail 148, the strength is improved by increasing the vertical cross sectional secondary moment, and a contact area with foam heat insulator 172 in the horizontal direction of vertical flange part 148*e* of holder rail 148 is increased, thus making it possible to suppress the deflection such as allowing vertical flange part 148*e* to move in the horizontal direction (shown by arrow in FIG. 17), by the resistance caused by contact with foam heat insulator 172. Namely, by devising the shape of the holder rail for fixing the rail device to the inner box, the material strength of the holder rail itself can be improved, and also the deflection of holder rail 148 in the horizontal direction within foam heat insulator 172 can be prevented. Thus, the inclination of the rail device in the horizontal direction when the load is applied to the rail device, can be prevented.

Namely, inwardly bent flange part 148*a* of holder rail 148, is extended to the center position of the lower surface of first rail (cabinet rail) 142.

Thus, an amount of the inward inclination of rail device 140, and an amount of vertical warp are prevented. Note that a length of inwardly bent flange part 148*a* of holder rail 148, is preferably a length exceeding a center of first rail (cabinet rail) 142 in the right and left directions.

Thus, lots of foods, etc, are stored in vegetable room 156 with large capacity, and as shown in FIG. 16, even in a full-openable case, smoothness during taking in and out of goods into/from vegetable room 156 is not lost. In addition, a user can easily attach and detach storage container 163*a* for cleaning storage container 163*a*.

Further, the rail device of freezing room 157 may have the same configuration as the configuration of vegetable room 156.

Thus, according to the sixth embodiment, refrigerator 151 includes the drawer type storage room, and even if the capacity of the storage room is large, excellent usability of the refrigerator is not lost.

Further, according to the sixth embodiment, the rail device is used as a drawing mechanism not only in vegetable room 156 and freezing room 157, but also in ice making room 154 and switching room 155, being the drawer type storage rooms.

Further, as shown in FIG. 17, the upper face of flange part 148*a* of holder rail 148 and the lower surface of inner box 170 are brought into contact with each other directly, not through a heat insulating material. Therefore, when the load is applied to rail device 140, the deflection of rail device 140 due to the load can be prevented not through soft foam heat insulator 172 but by holder rail 148 made of a strong material, thus making it possible to surely obtain a reinforcing effect of holder rail 148.

Further, since holder rail 148 can be directly attached to a face of the inner box, an attachment position of holder rail 148 is easily controlled. Accordingly, holder rail 148 can be surely attached to a desired specified position, and the reinforcing effect of holder rail 148 can be surely obtained.

Further, as shown in FIG. 17, the lower surface of first rail (cabinet rail) 142 and the upper face of inner box 170 are brought into direct contact with each other. Therefore, when the load is applied to rail device 140, and a space exists between the lower surface of first rail (cabinet rail) 142 and the upper face of inner box 170, the rail device continues to be deflected with no inhabitance. However, by direct contact between the lower surface of first rail (cabinet rail) 142 and the upper face of inner box 170, there is no space between the lower surface of first rail (cabinet rail) 142 and the upper face of inner box 170, and the deflection of rail device 140 due to the load can be prevented by holder rail 148 attached in foam heat insulator 172 of inner box 170. Thus, the reinforcing effect of holder rail 148 can be surely obtained.

However, under an influence of variation in the attachment step of the rail device and variation of products, etc, direct contact is not necessarily made between the lower surface of first rail (cabinet rail) 142 and the upper face of inner box 170. However, if the space between the lower surface of first rail (cabinet rail) 142 and the upper face of inner box 170 is 1 mm or less, deterioration of the reinforcing effect of holder rail 148 is small, compared with a case of the direct contact, and if the space between the lower surface of first rail (cabinet rail) 142 and the upper face of inner box 170 is 1 mm or less, almost the same action effect as the effect in a case of the direct contact, can be obtained.

Further, as shown in FIG. 17, on the bottom surface side of the rail device 140, holder rail 148 has flange part 148*e* extended in the same direction as the direction of adding the force to the rail device when the drawer door is drawn out. Therefore, as the shape of holder rail 148, the strength is improved by increasing the vertical cross sectional secondary moment, and the contact area with foam heat insulator 172 in a horizontal direction of vertical flange part 148*e* of holder rail 148 is increased, thus making it possible to suppress the deflection such as allowing vertical flange part 148*e* of holder rail 148 to move in the horizontal direction, by the resistance caused by contact with foam heat insulator 172. Namely, by devising the shape of the holder rail for fixing rail device 148 to the inner box, the material strength of holder rail 148 itself can be improved, and also the deflection of the holder rail in the horizontal direction within foam heat insulator 172 of holder rail 148 can be prevented. Thus, the inclination of the rail device in the horizontal direction can be prevented when the load is applied to the rail device.

Further, as shown in FIG. 19, by molding holder rail 148 with a metal material, the strength required for fixing part 148*c* of the rail device provided to holder rail 148 can be easily secured, and fixture of the rail device, which is an original use object, can be surely performed. Namely, holder rail 148 that has a function of fixing and reinforcing the rail device, can be molded by one component.

Further, as shown in FIG. 20, holder rail 148 has reinforcing shape 148*d* in a bent portion between two flat surfaces with a certain angle therebetween. Therefore, the deflection of the bent portion of holder rail 148 caused by the load applied to flange part 148*a* of holder rail 148 can be prevented by the shape of the holder rail itself, thus making it possible to improve the strength of holder rail 148 and suppressing the deflection of rail device 140.

Further, holder rail 148 has a shape usable on both right and left sides. Therefore, there is no necessity for using holder rail 148 selectively when right and left holder rails 148 are attached to inner box 170, thus making it possible to improve operability and reduce a cost required for a mold for molding holder rail 148.

Further as shown in FIG. 20, a specific distance is set between lower surface 148*g* of the vertical flange part and inner box 170 opposed to lower surface 148*g* of the vertical flange part. Therefore, when the load is applied to the rail device, holder rail 148 is also influenced by the deflection of the rail due to the load. Therefore, there is a specific distance between lower surface 148*g* of the vertical flange part of holder rail 148 that is likely to deflect in the same direction as the direction of the load applied to the rail device, and inner box 170. Then, lower surface 148*g* of the vertical flange part and inner box 170 are not brought into contact with each other directly, thus allowing foam heat insulator 172 to exist. Accordingly, the shape of a surface of inner box 170 can be maintained satisfactorily without causing a breakage such as piercing inner box 170 by lower surface 148*g* of the vertical flange part of holder rail 148, due to the deflection of holder rail 148.

In this case, if the specific distance is 1 mm or less, when the load is applied to the rail device, the holder rail is also influenced by the deflection of the rail, and there is a high possibility that the breakage occurs, such as piercing inner box 170 by lower surface 148*g* of the vertical flange part of holder rail 148. It may be hardly possible that the deflection of the holder rail exceeds 5 mm, which is caused by the deflection of the rail device that ordinarily occurs by the load applied to the rail device. Therefore, to increase the specific distance, is to expand a convex shape formed inside of the refrigerator by inner box 170 and foam heat insulator 172, thereby making inside capacity small. Accordingly, the specific distance is preferably set to 1 mm or more and 5 mm or less.

Figure 21:
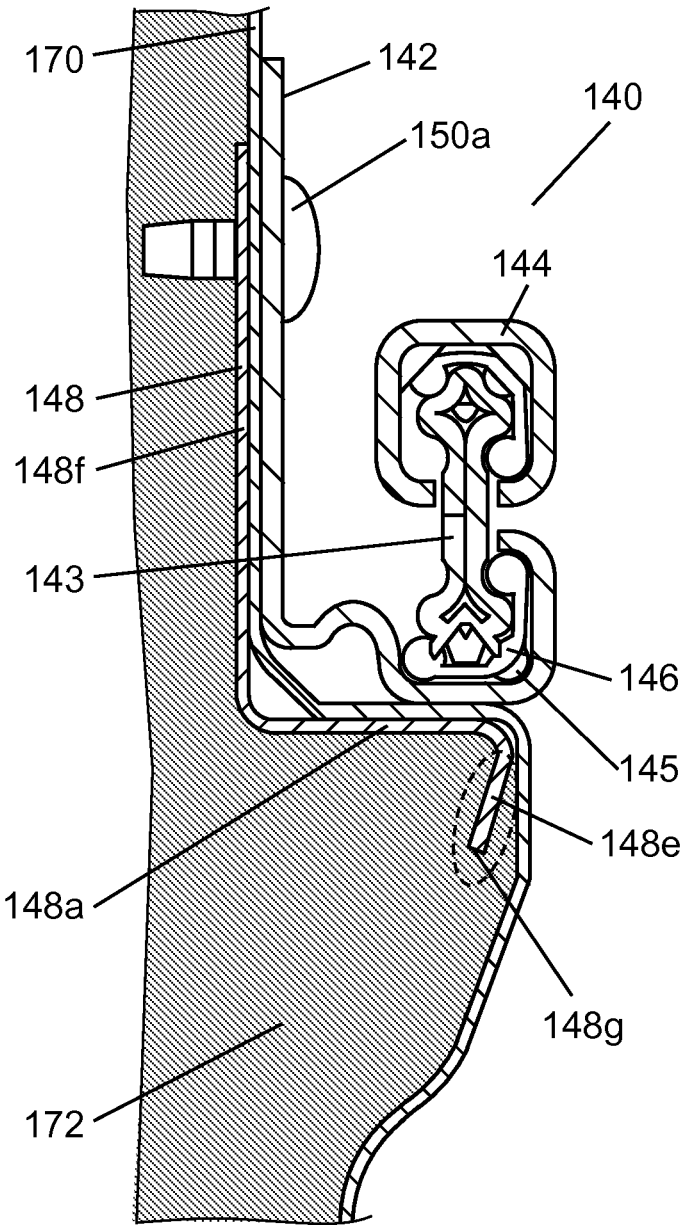
FIG. 21 is a section view showing a configuration outline of a different rail device according to the sixth embodiment of the present invention.

FIG. 21 is a sectional view showing a configuration outline of a different rail device according to the sixth embodiment of the present invention. As is surrounded by a dot line portion of FIG. 21, vertical flange part 148*e* is inclined to the opposite side to the inside of the refrigerator (left side in FIG. 21), namely so as to be away from inner box 170. Therefore, when the load is applied to the rail device, holder rail 148 is also influenced by the deflection of the rail, thus suppressing the inward deflection of vertical flange part 148*e* of holder rail 148 deflecting to the inside of the storage room where inner box 170 exists. Then, more surely inner box 170 does not exist and foam heat insulator 172 exists in an advancing direction of vertical flange part 148*e* of holder rail 148. Accordingly, the shape of inner box 170 can be more satisfactorily maintained without causing breakage such as piercing inner box 170 by lower surface 148*g* of the vertical flange part due to the deflection of holder rail 148.

Note that according to the sixth embodiment, two fixing parts 148*b* of the auxiliary member are provided respectively to front side and rear side of one holder rail 148 one by one. However, only fixing part 148*b* at the front side of holder rail 148 is fixed by screws 150*b*. This is because almost no downward deflection of the rail occurs at the rear side in the longitudinal direction, and almost no deflection of the holder rail occurs, and therefore from the viewpoint of reinforcement, even if fixing part 148*b* of the auxiliary member is provided to one point of the front side where the strength is required, reinforcing effect can be sufficiently obtained.

Further, fixture by screws 150*b* is performed for fixing holder rail 148 to the inner box before foaming, and holder rail 148 can be surely fixed to a desired position even in the inner box before foaming, although holder rail 148 is embedded in foam heat insulator 172 after filling foam heat insulator 172, thus making it possible to surely obtain the reinforcing effect of holder rail 148. Further, as described above, holder rail 148 is finally attached to a side surface of inner box 170, then embedded in foam heat insulator 172, and exists as a firm one completely fixed to inner box 170 after foaming. Therefore, even one side of fixing part 148*b* is sufficiently useful for fixing holder rail 148 before foaming to inner box 170. Accordingly, fixing part 148*b* of the auxiliary member may be fixed at only one point.

As described above, two fixing parts 148*b* of the auxiliary member are provided respectively to front side and rear side one by one in one holder rail 148. However, according to the sixth embodiment, fixing part 148*b* may be fixed only at the front side of holder rail 148 by screws 150*b*.

However, in order to have more strength, the rear side of holder rail 148 may also be fixed by screws 150*b*.

Further, fixing part 148*b* of the auxiliary member exists at a position closer to flange part 148*a* than fixing part 148*c* of the rail device. Therefore, when the load is applied to the rail device, the deflection of holder rail 148 influenced by the deflection of the rail can be further effectively prevented.

Namely, when fixing part 148*b* of the auxiliary member exists farther from flange part 148*a* than fixing part 148*c* of the rail device, the deflection of the holder rail influenced by the deflection of the rail occurs, with fixing part 148*c* of the rail device as a fulcrum. The deflection easily occurs as the fulcrum is far from a point to which the load is applied. Therefore, the fulcrum for deflecting holder rail 148 is set as not fixing part 148*c* of the rail device but as fixing part 148*b* of the auxiliary member, thus making fixing part 148*b* of the auxiliary member closer to flange part 148*a*, being the point to which the load is applied. This makes it possible to suppress the deflection of holder rail 148 and as a result, the reinforcement of the rail device is achieved.

Note that according to the sixth embodiment, two fixing parts 148*c* of the rail device are provided respectively to front side and rear side of one holder rail 148 one by one, and are fixed by two screws 150*a*. However, two or more fixing parts 148*c* of the rail device, for example three fixing parts 148*c* of the rail device may be provided to front side, rear side, and intermediate side, and may be fixed with three screws.

Seventh Embodiment

Figure 22:
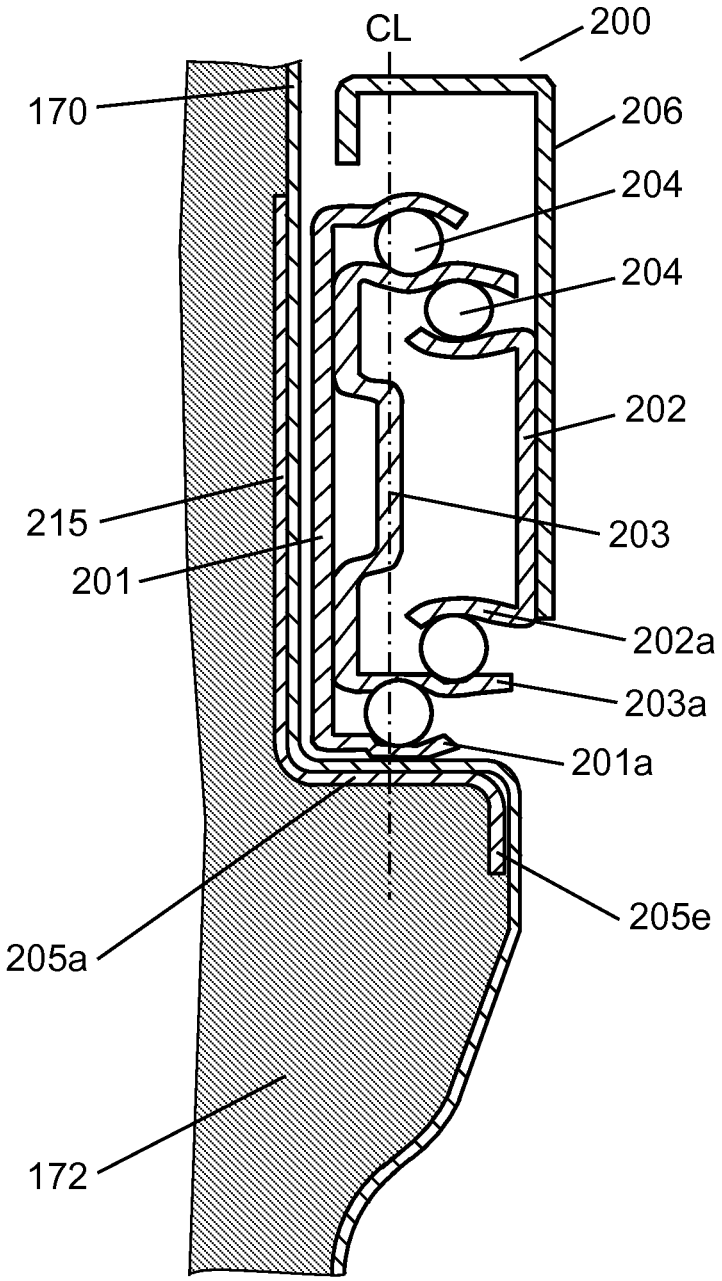
FIG. 22 is a section view showing a configuration outline of a rail device according to a seventh embodiment of the present invention.

FIG. 22 is a sectional view showing a configuration outline of a rail device according to a seventh embodiment of the present invention.

The rail device according to the seventh embodiment has a different configuration, compared with the rail device of the sixth embodiment. Specifically, as shown in FIG. 22, unlike rail device 40 vertically overlapped into three stages as shown in FIG. 3, rail device 200 of the seventh embodiment has three rails arranged in three rows horizontally. Here, mainly a different point from the sixth embodiment will be described.

As shown in FIG. 22, specifically, rail device 200 is constituted of first rail (fixed rail) 201 provided with flange part 201*a* extending inward on upper and lower sides of a plate member; third rail (moving rail) 202 having narrower width than a height dimension of first rail (fixed rail) 201 fixed to outside of a support frame (not shown) through support metal fittings 206, with flange part 202*a* extending outward from its upper and lower sides; and second rail (intermediate rail) 203 provided between the inside and outside rails 201 and 202, having a height dimension smaller than first rail (fixed rail) 201 and larger than moving rail 202, with flange part 203*a* provided inward from its upper and lower sides.

Namely, rail device 200 has the first rail fixed to the inner surface of the inner box, with flange parts 201*a* extending inward from the upper and lower sides of the plate member; the third rail with narrower width than the height dimension of first rail (fixed rail) 201 fixed to the outside of the support frame (not shown) supporting the container through support metal fittings 206, with flange parts 202*a* extended outward from its upper and lower sides; and the second rail provided between first rail (fixed rail) 201 and third rail (moving rail) 202, having the height dimension smaller than first rail (fixed rail) 201 and larger than third rail (moving rail) 202, with flange parts 203*a* provided inward from its upper and lower sides.

Second rail (intermediate rail) 203 is substantially made integral with first rail (fixed rail) 201 and third rail (moving rail) 202 via ball bearing 204 inserted into each of flange parts 201*a*, 203*a*, and 202*a*, and is held to be longitudinally slidable. Thus, by sliding of second rail (intermediate rail) 203 within first rail (fixed rail) 201 and sliding of third rail (moving rail) 202 within second rail (intermediate rail) 203, third rail (moving rail) 202 is drawn out by two stages.

Accordingly, owing to a holding mechanism among rails 201, 202, and 203, the container held by third rail (moving rail) 202 in a state of being drawn out through the support frame (not shown), is largely drawn out in a full open state so that its rear end reaches an opening part of a front face of the storage room.

Further, first rail (fixed rail) 201 is fastened to holder rail 205 with screws (not shown), with inner box 170 held between. Thus, rail device 200 is fixed to the inner surface of inner box 170. Holder rail 205 is an example of the auxiliary member in the refrigerator of the present invention, and is a member for fixing rail device 200 to the inner surface of inner box 170. Holder rail 205 is disposed at foam heat insulator 172 side, and specifically holder rail 205 is embedded in foaming and heat insulating material 172.

As shown in FIG. 22, holder rail 205 has flange part 205*a* extended just under the lower surface of first rail (fixed rail) 201. Thus, the downward warp of first rail (fixed rail) 201 can be prevented. Specifically, holder rail 205 has flange part 205*a* extended to at least the center position of the lower surface of first rail (fixed rail) 201. In addition, holder rail 205 has vertical flange part 205*e* with its tip end bent downward almost at a right angle in a vertical direction.

The fall prevention part of the rail device according to the present invention will be described below.

As shown in FIG. 42, when the load is applied to conventional rail device 4031, rail device 4031 is likely to be deflected in a direction shown by the arrow. Namely, first rail 4031*a* is likely to open.

However, as shown in FIG. 22, holder rail 205 has flange part 205*a* extending to at least the center position of the lower surface of first rail (fixed rail) 201. Therefore, the center position with respect to a bottom surface of first rail (fixed rail) 201 in the lower part of first rail (fixed rail) 201, is received by holder rail 205. Further, holder rail 205 is disposed at foam heat insulator 172 side and holder rail 205 is embedded in foam heat insulator 172. Therefore, a contact area between holder rail 205 and foam heat insulator 172 becomes large. Accordingly, the vertically downward deflection of rail device 200 can be prevented by resistance caused by contact with foam heat insulator 172. Namely, by devising the shape of holder rail 205 for fixing rail device 200 to inner box 170, material strength of holder rail 205 itself is improved and also the deflection of holder rail 205 in the vertical direction within foam heat insulator 172 can be prevented. Therefore, vertical inclination of rail device 200 caused by the load applied to rail device 200 can be prevented. As a result, opening of first rail (fixed rail) 201 can be prevented. Namely, holder rail 205 that functions to fix rail device 200 can also function to reinforce rail device 200.

Further, on the bottom surface of rail device 200, holder rail 205 has vertical flange part 205*e* extending in the same direction as the direction of adding force to rail device 200 when a drawer door is drawn out. Therefore, as the shape of holder rail 205, the strength is improved by increasing the vertical cross sectional secondary moment, and a contact area with foam heat insulator 172 in a horizontal direction of vertical flange part 205*e* of holder rail 205 is increased, thus making it possible to suppress the deflection such as allowing vertical flange part 205*e* to move in the horizontal direction, by resistance caused by contact with foam heat insulator 172. Namely, by devising the shape of the holder rail for fixing the rail device to the inner box, the material strength of the holder rail itself can be improved, and also the deflection of the holder rail in the horizontal direction within the foaming and heat insulating material can be prevented. Thus, the inclination of the rail device in the horizontal direction caused by the load applied to the rail device can be prevented.

Thus, by devising the shape of holder rail 205 for fixing rail device 200 to inner box 170, namely according to the seventh embodiment, as the fall prevention part of the rail device, by disposing holder rail 205 at foam heat insulator 172 side of inner box 170 in which rail device 200 is provided, and having flange part 205*a* extended to at least the center position of the lower surface of first rail (fixed rail) 201, the deflection such as inclination of rail device 200 caused by the load applied to rail device 200 can be prevented.

Namely, holder rail 205 which originally has a function of fixing rail device 200, can also have a function of reinforcing rail device 200.

Further, as shown in FIG. 22, the upper face of flange part 205*a* of holder rail 205 and the lower surface of inner box 170 are brought into contact with each other directly not across a heat insulating material. Therefore, when the load is applied to rail device 200, the deflection of rail device 200 due to the load can be prevented not through soft foam heat insulator 172 but by holder rail 205 made of a strong material, thus making it possible to surely obtain a reinforcing effect of holder rail 205.

Further, since holder rail 205 can be directly attached to the face of the inner box, an attachment position of holder rail 205 is easily controlled. Accordingly holder rail 205 is surely attached to a desired specified position, and the reinforcing effect of holder rail 205 can be surely obtained.

Further, as shown in FIG. 22, the lower surface of first rail (fixed rail) 201 (more specifically, the lower surface of lower flange part 201*a* of first rail (fixed rail) 201) and the upper face of inner box 170 are brought into direct contact with each other. Therefore, when the load is applied to rail device 200, and a space exists between the lower surface of first rail (fixed rail) 201 and the upper face of inner box 170, the rail device continues to be deflected with no inhabitance. However, by direct contact between the lower surface of first rail (fixed rail) 201 and upper face of inner box 170, there is no space between the lower surface of first rail (fixed rail) 201 and the upper face of inner box 170, and the deflection of rail device 200 due to the load can be prevented by holder rail 205 attached in foam heat insulator 172 of inner box 170. Thus, the reinforcing effect of holder rail 205 can be surely obtained.

However, under an influence of variation in the attachment step of the rail device and variation of products, etc, direct contact is not necessarily made between the lower surface of first rail (fixed rail) 201 and the upper face of inner box 170 in some cases. However, if the space between the lower surface of first rail (fixed rail) 201 and the upper face of inner box 170 is 1 mm or less, deterioration of the reinforcing effect of holder rail 205 is small, compared with a case of the direct contact, and if the space between the lower surface of first rail (fixed rail) 201 and upper face of the inner box 170 is 1 mm or less, almost the same action effect as the effect in a case of the direct contact, can be obtained.

According to the seventh embodiment as well, the holder rail is molded with metal material. The holder rail has a reinforcing shape in a bent part between two flat surfaces with a certain angle therebetween. The holder rail has a shape so as to be usable on both right and left sides. A specified distance is set between the lower surface of the vertical flange part and the inner box opposed to the lower surface of the vertical flange part. The vertical flange part is inclined to the opposite side to the inside of the refrigerator. These arrangements provide the same action effect as that of the sixth embodiment.

Further, each length of first rail (fixed rail) 201, second rail (intermediate rail) 203, and third rail (moving rail) 202, is determined such that the deep end side of the storage container is positioned forward from the front face of the door directly above the vegetable room, when the storage container is drawn out to a maximum drawing out position.

Thus, the refrigerator according to the seventh embodiment capable of fully opening the vegetable room constituting the drawer type storage room attains usability such as smoothness of a drawer, by having various technical characteristics of rail device 200.

Figure 23:
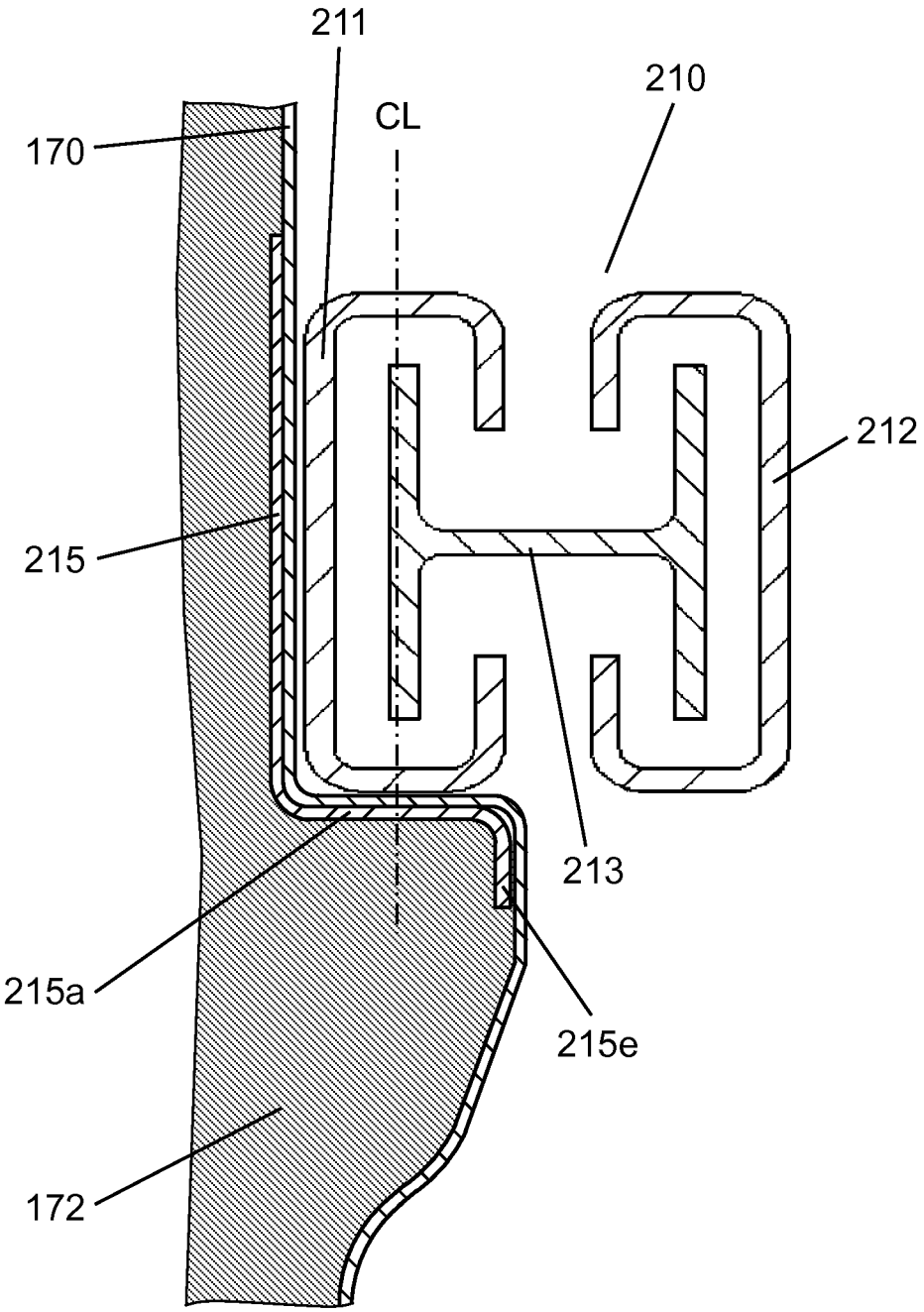
FIG. 23 is a section view showing a configuration outline of a different rail device according to the seventh embodiment of the present invention.

FIG. 23 is a section view showing a configuration outline of a different rail device according to the seventh embodiment of the present invention.

As shown in FIG. 23, in the same way as rail device 200 shown in FIG. 22, rail device 210 of the seventh embodiment has three rails arranged in three rows horizontally, unlike rail device 40 vertically overlapped into three stages as shown in FIG. 3.

Specifically, second rail (intermediate rail) 213 with its section shape formed into H-shape, is movable with respect to first rail (fixed rail) 211, and third rail (moving rail) 212 is movable with respect to second rail (intermediate rail) 213, thus forming an expansible rail device as a whole. Note that in FIG. 23, the bearing, being a sliding member, is not shown.

In rail device 210, as shown in FIG. 23, in the same way as rail device 200 of FIG. 22, holder rail 215 has flange part 215*a* extended to at least the center position of the lower surface of first rail (fixed rail) 211. Therefore, the center position of a bottom surface of first rail (fixed rail) 211 in the lower part of first rail (fixed rail) 211, is received by holder rail 215. Further, holder rail 215 is disposed at foam heat insulator 172 side and holder rail 215 is embedded in foam heat insulator 172. Therefore, a contact area between holder rail 215 and foam heat insulator 172 becomes large. Accordingly, the vertically downward deflection of rail device 210, can be prevented by resistance caused by contact with foam heat insulator 172. Namely, by devising the shape of holder rail 215 for fixing rail device 210 to inner box 170, the material strength of holder rail 215 itself is improved and also the deflection of the holder rail 215 in the vertical direction within foam heat insulator 172, can be prevented. Therefore, vertical inclination of rail device 210 when the load is applied to rail device 210, can be prevented. As a result, the opening of first rail (fixed rail) 211 can be prevented. Namely, holder rail 215 that functions to fix rail device 210, can also function to reinforce rail device 210.

Further, holder rail 215 has vertical flange part 215*e* extending in the same direction as the direction of adding force to rail device 210 when a drawer door is drawn out toward the bottom surface of rail device 210. Therefore, as the shape of holder rail 215, the strength is improved by increasing the vertical cross sectional secondary moment, and a contact area with foam heat insulator 172 in a horizontal direction of vertical flange part 215*e* of holder rail 215 is increased, thus making it possible to suppress the deflection such as allowing vertical flange part 215*e* to move in the horizontal direction, by the resistance caused by contact with foam heat insulator 172. Namely, by devising the shape of the holder rail for fixing the rail device to the inner box, the material strength of the holder rail itself can be improved, and also the deflection of the holder rail in the horizontal direction within the foaming and heat insulating material can be prevented. Thus, the inclination of the rail device in the horizontal direction when the load is applied to the rail device, can be prevented.

Further, as shown in FIG. 23, the upper face of flange part 215*a* of holder rail 215 and the lower surface of inner box 170 are brought into contact with each other directly not through the heat insulating material. Therefore, when the load is applied to rail device 210, the deflection of rail device 210 due to the load can be prevented not through soft foam heat insulator 172 but by holder rail 215 made of a strong material, thus making it possible to surely obtain a reinforcing effect of holder rail 215.

Further, since holder rail 215 can be directly attached to the face of the inner box, an attachment position of holder rail 215 is easily controlled. Accordingly holder rail 215 is surely attached to a desired specified position, and the reinforcing effect of holder rail 215 can be surely obtained.

Further, as shown in FIG. 23, the lower surface of first rail (fixed rail) 211 and the upper face of inner box 170 are brought into direct contact with each other. Therefore, when the load is applied to rail device 210, and a space exists between the lower surface of first rail (fixed rail) 211 and the upper face of inner box 170, rail device 210 continues to be deflected with no inhabitance. However, by direct contact between the lower surface of first rail (fixed rail) 211 and the upper face of inner box 170, there is no space between the lower surface of first rail (fixed rail) 211 and the upper face of inner box 170, and the deflection of rail device 210 due to the load can be prevented by holder rail 215 attached to foam heat insulator 172 of inner box 170. Thus, the reinforcing effect of holder rail 215 can be surely obtained.

However, under an influence of variation in the attachment step of the rail device 210 and variation of products, etc, direct contact is not necessarily made between the lower surface of first rail (fixed rail) 211 and the upper face of inner box 170 in some cases. However, if the space between the lower surface of first rail (fixed rail) 211 and the upper face of inner box 170 is equal to or less than 1 mm, deterioration of the reinforcing effect of holder rail 215 is small, compared with a case of the direct contact, and if the space between the lower surface of first rail (fixed rail) 211 and the upper face of inner box 170 is equal to or less than 1 mm, almost the same action effect as the effect in a case of the direct contact, can be obtained.

Eighth Embodiment

In the first to seventh embodiments, the description has been given for a case that the storage container is drawn out by drawing out the drawer type door (namely, the storage container is drawn out integrally with the drawer type door).

As another embodiment of the drawer type storage room, there is a type not having the drawer type door but drawing out the storage container from the opening part of the storage room by opening a hinge-type door (the storage container itself is drawn out alone), and this type will be described in an eighth embodiment.

Figure 24:
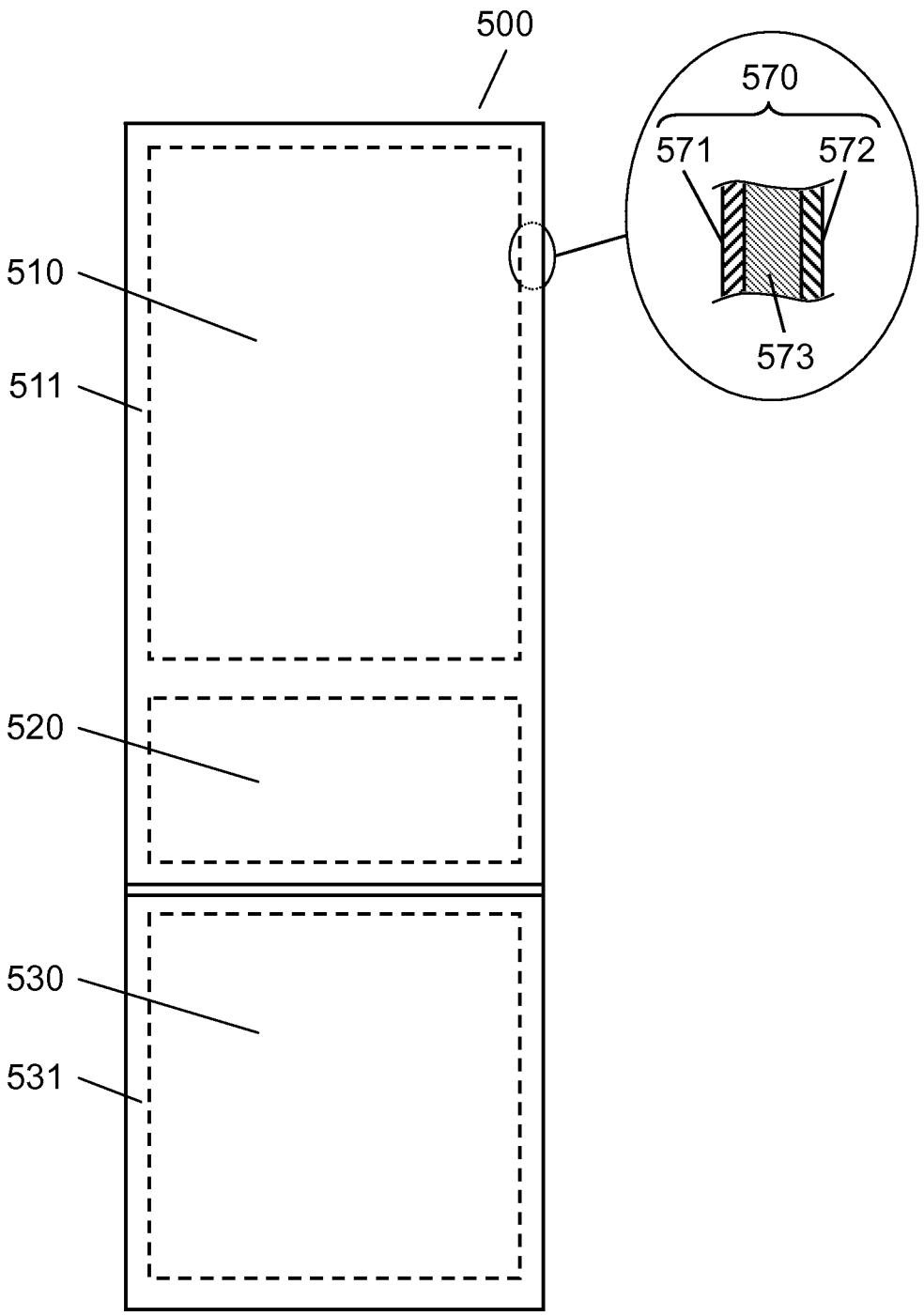
FIG. 24 is a front view of a refrigerator according to an eighth embodiment of the present invention.

FIG. 24 is a front view of the refrigerator according to the eighth embodiment of the present invention. As shown in FIG. 24, refrigerator 500 includes two doors and includes a storage room partitioned into three regions in heat insulated box 570.

Heat insulated box 570 is composed of a heat insulating wall in which a space is formed by inner box 571 made by vacuum-molding a resin sheet such as ABS, and outer box 572 made of a metal material such as precoat steel plate, and this space is filled with foam heat insulator 573.

The aforementioned three storage rooms are included in heat insulated box 570. Specifically, refrigerator 500 includes refrigerating room 510, vegetable room 520, and freezing room 530. Note that in the figure, rectangular dot line indicates the opening part of each storage room. Further, a drawer type container as will be described later is contained in vegetable room 520.

A thermally insulated door filled with a foaming and heat insulating material such as urethane is provided to the opening part of each storage room.

Specifically, hinge type first door 511 is provided, for openably closing the opening parts of refrigerating room 510 and vegetable room 520. A hinge is provided to an end portion of first door 511 at user's left hand, so as to be turned around a vertical turning shaft.

Drawer type second door 531 is also provided to freezing room 530.

In refrigerator 500 of this embodiment having such a basic configuration, refrigerating room 510 is cooled by a direct cooling system and vegetable room 520 and freezing room 530 are cooled by an indirect cooling system.

Figure 25:
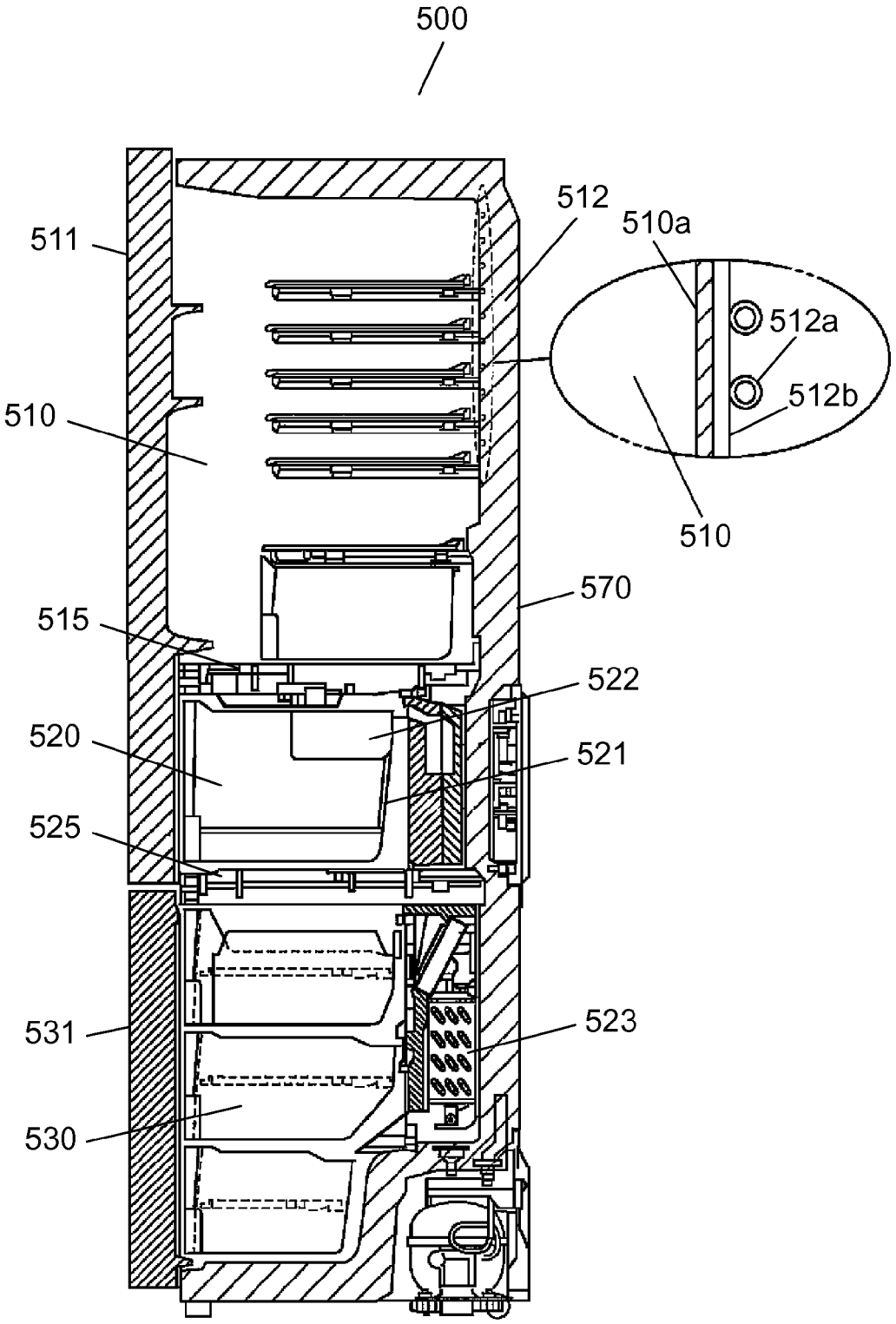
FIG. 25 is a longitudinal section view of the refrigerator according to the eighth embodiment.

FIG. 25 is a vertical section view of the refrigerator according to the eighth embodiment of the present invention. As shown in FIG. 25, refrigerating room 510 and vegetable room 520 are partitioned by upper partitioning body 515 in heat insulated box 570. Further, vegetable room 520 and freezing room 530 are partitioned by lower partitioning body 525.

In addition, refrigerator 500 includes two coolers. Specifically, first cooler 512 is provided in a reverse side of back surface 510*a* of refrigerating room 510. Back surface 510*a* of refrigerating room 510 is cooled by heat conduction from first cooler 512. Air inside of refrigerating room 510 is cooled by cooled back surface 510*a*.

First cooler 512 has cooling pipe 512*a* and metal plate 512*b*. Back surface 510*a* of refrigerating room 510 is directly cooled by metal plate 512*b* attached to the reverse side of back surface 510*a* in contact with back surface 510*a*.

In addition, refrigerator 500 includes second cooler 532 in the reverse side of the back surface of freezing room 530. Inside of freezing room 530 is cooled by circulating cooled air discharged from second cooler 532.

The cooled air discharged from second cooler 532 is also supplied to vegetable room 520, and under opening and closing control of a damper, for example, a temperature zone is maintained to be the temperature zone between the temperature zone of refrigerating room 510 and the temperature zone of freezing room 530.

Further, drawer type storage case 521 is stored in vegetable room 520. The user can draw out storage case 521 by opening first door 511.

Note that storage case 521 described in the eighth embodiment corresponds to the storage container described in the first to seventh embodiments.

Refrigerator 500 of the eighth embodiment has characteristics that foods, etc, can be easily taken in and out into/from storage case 521, and attachment and detachment of storage case 521 can be easily performed. Storage case 521 and its drawing out configuration will be described hereafter, with reference to FIG. 26 and FIG. 27.

Figure 26:
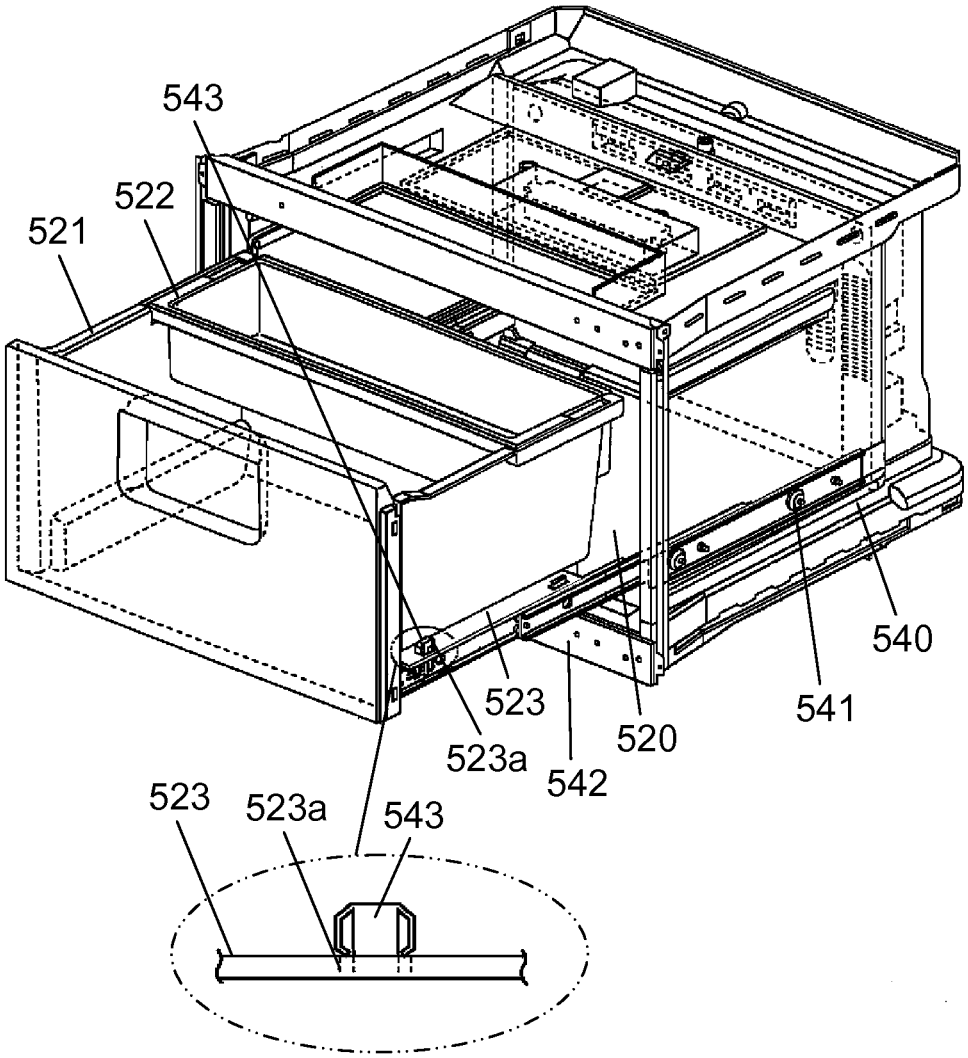
FIG. 26 is an enlarged perspective view showing an appearance of a storage case according to the eighth embodiment.

FIG. 26 is an expanded perspective view showing an appearance of the storage case according to the eighth embodiment.

As shown in FIG. 26, storage case 521 is supported by rail device 542. Further, rail device 542 has a elongated shape in front and rear directions, and is supported slidably in the front and rear directions by fixing member 541 fixed to vegetable room 520.

Specifically, storage case 521 has holding part 523 at both ends in right and left directions, and more specifically at both ends in right and left directions in a lower part of storage case 521, so as to protrude outward.

Further, attachment holes 523*a* are formed in holding part 523, so that storage case 521 is detachably attached to rail device 542.

Rail device 542 includes protrusions 543 protruding upward so as to be engaged with attachment holes 523*a*. Each of protrusions 543 of right and left rail device 542 of storage case 521 can be inserted and removed into/from attachment holes 523*a*.

Thus, drawer unit 540 supports storage case 521 detachably in a vertical direction.

Further, storage case 521 is formed of a light transmitting resin capable of recognizing a stored matter in storage case 521 from a side of storage case 521. Namely, storage case 521 is made of a resin with relatively high transparency.

Thus, for example, the kind and the number of the foods stored in storage case 521 can be easily recognized from the side of storage case 521.

Further, small case 522 is detachably attached to an upper portion and rear portion of storage case 521. Thus, for example, storage case 521 and small case 522 can be selectively used. Moreover, for example, the deflection of storage case 521 when heavy food is stored in storage case 521, can be prevented by small case 22.

In addition, drawer unit 540 is constituted of right and left rail device 542 of storage case 521, and fixing member 541.

Note that drawer unit 540 described in the eighth embodiment corresponds to the rail device described in the first to seventh embodiments.

Figure 27:
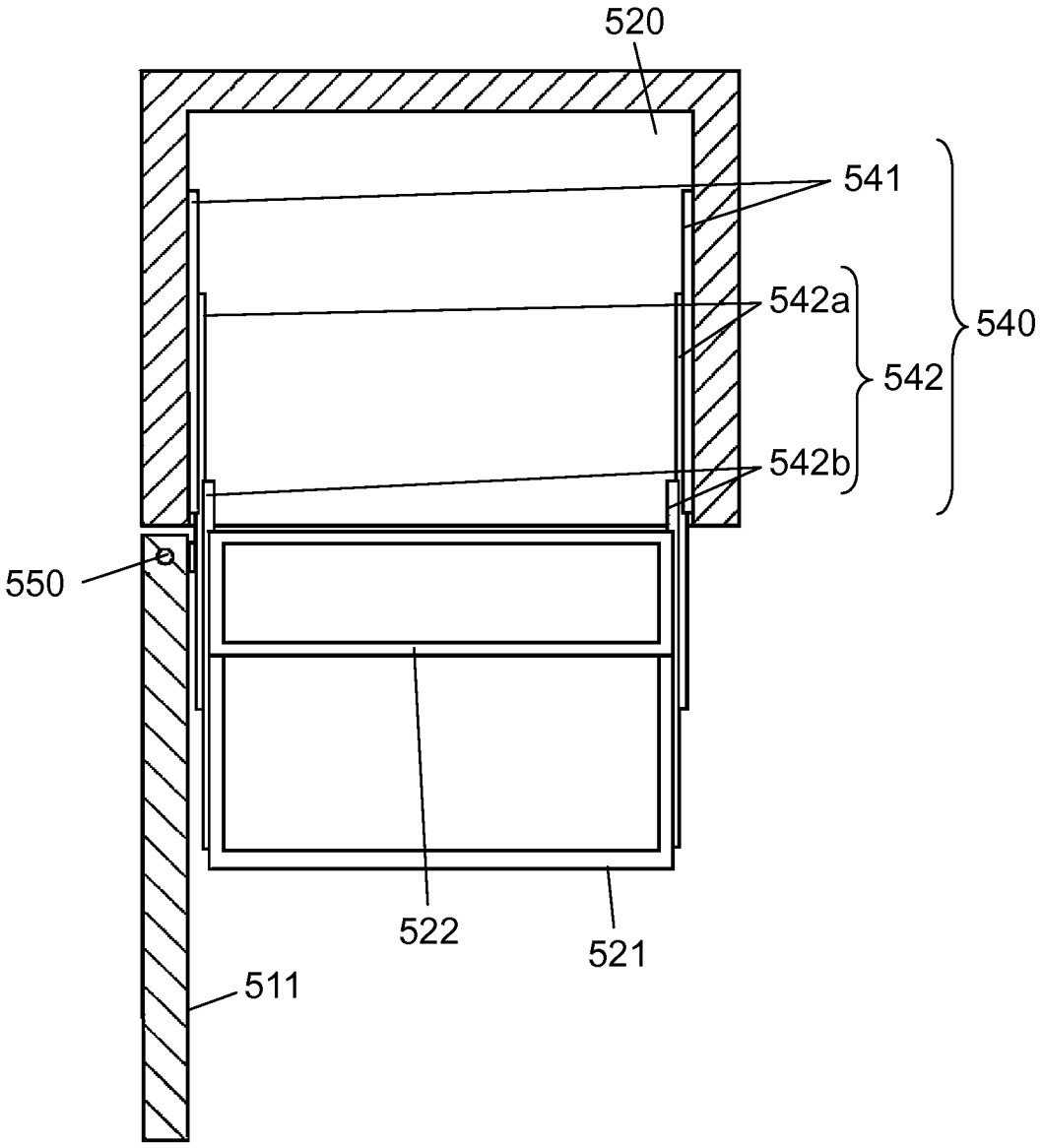
FIG. 27 is a planar section view showing storage case 521 and drawer unit 540 according to the eighth embodiment.

FIG. 27 is a planar section view showing storage case 521 and drawer unit 540 according to the eighth embodiment of the present invention.

As shown in FIG. 27, drawer unit 540 has first rail (fixing member) 541 and rail device 542, disposed at right and left side of storage case 521, respectively.

Further, each of two rail device 542 is constituted of second rail (middle rail) 542*a* and third rail (support rail) 542*b*, respectively.

Third rail (support rail) 542*b* is a rail for directly supporting storage case 521, and is slidable in the front and rear directions of second rail (middle rail) 542*a*. Also, second rail (middle rail) 542*a* is slidable in the front and rear directions of first rail (fixing member) 541.

With such a configuration of rail device 542, drawer unit 540 can be extended and contracted as a whole in the front and rear directions.

Specifically, when first door 511 is turned around turning shaft 550 of the hinge as shown in FIG. 27, namely, when first door 511 is opened, drawer unit 540 is extended by being drawn by the user, and storage case 521 is drawn out from vegetable room 520.

Further, a maximum drawn out distance of storage case 521 is a distance sufficient to improve the usability of storage case 521.

Further, by using the rail device described in the first to seventh embodiments, instead of drawer unit 540 described in the eighth embodiment, it becomes difficult to draw out storage case 521 when a force is applied to the rail device, thus suppressing the deflection of the rail dived and maintaining satisfactory usability of the storage room.

Namely, as described in the eighth embodiment, even in a type of the refrigerator including one way hinge type door (pivoted door), and drawing out the storage container from the opening part of the storage room, by opening the hinge type door (the storage container itself is drawn out alone), the storage container is directly or indirectly supported by the third rail, and is drawn out. Therefore, the storage container is included in the drawer type storage room, and needless to say, the storage container is also included in the present invention.

Ninth Embodiment

A refrigerator having three doors is described as a ninth embodiment.

A different point from the eighth embodiment exists in a point that three doors are provided, and description will be given mainly of the different point.

Figure 28:
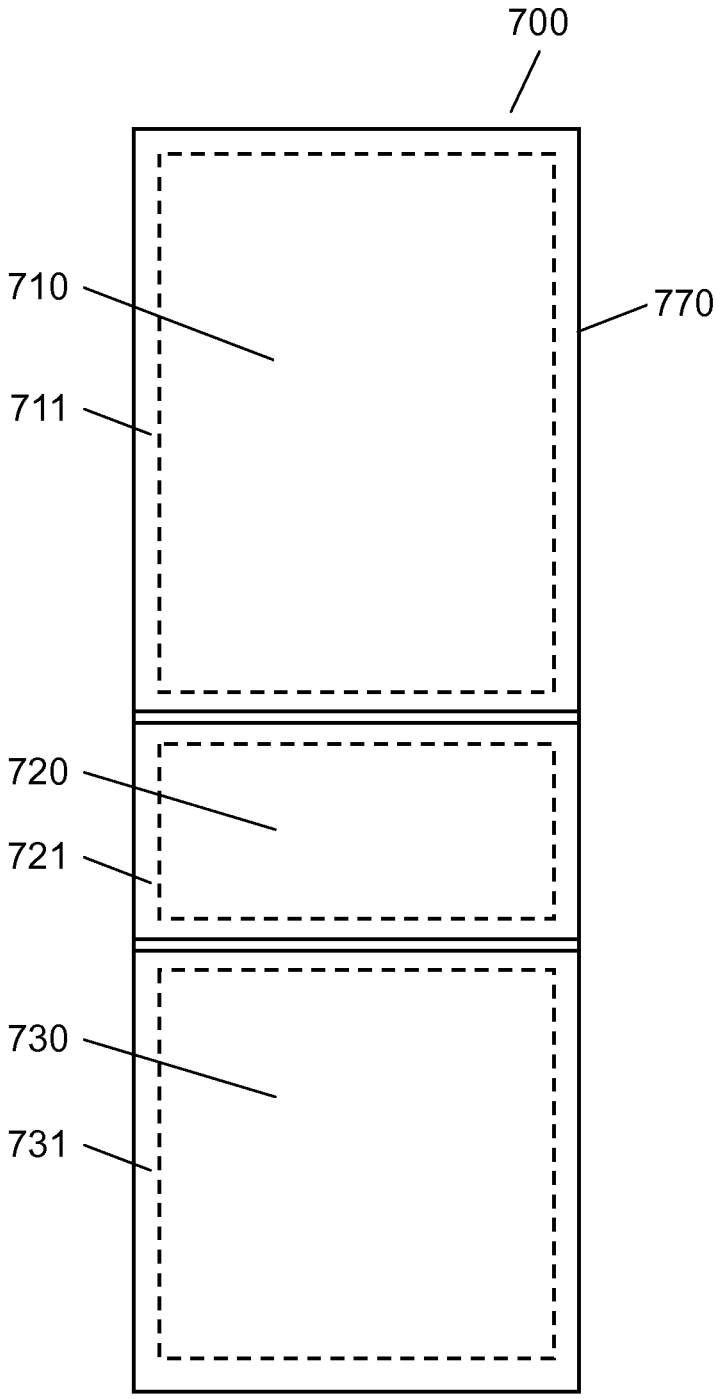
FIG. 28 is a front view of a refrigerator according to a ninth embodiment of the present invention.

FIG. 28 is a front elevational view of the refrigerator according to the ninth embodiment of the present invention.

As shown in FIG. 28, refrigerator 700 is a refrigerator provided with three doors, and is provided with three storage rooms within heat insulated box 770.

Specifically, refrigerator 700 is provided with refrigerating room 710, vegetable room 720 in which a temperature inside the room can be changed, and freezing room 730.

A thermal insulating door is provided in an opening portion of each of the storage rooms. Specifically, refrigerator 700 is provided with upper door 711 closing the opening portion of refrigerating room 710 so as to freely open and close it, middle door 721 closing the opening portion of vegetable room 720 so as to freely open and close, and lower door 731 closing the opening portion of freezing room 730 so as to freely open and close. In FIG. 28, a rectangular dotted line expresses the opening portion of each of the storage rooms.

Further, upper door 711 and middle door 721 are constructed by a hinge type door, are provided with hinges respectively in their left end portions as one faces, and rotate around axes of rotation in a vertical direction.

Further, a cooling system of each of three storage rooms is the same as that of the eighth embodiment. In other words, refrigerating room 710 is cooled by a direct cooling system, and vegetable room 720 and freezing room 730 are cooled by an indirect cooling system.

Further, a drawer storage case (not shown) is accommodated in vegetable room 720 in the same manner as that of the eighth embodiment, and is detachably supported to a drawer unit (not shown).

However, refrigerator 700 according to the ninth embodiment is provided with the door in each of refrigerating room 710 and vegetable room 720, as is different from refrigerator 700 according to the eighth embodiment.

In this case, a configuration which is hard to be opened in the case that a force is applied to the rail device can be achieved by applying the rail device described in the first to seventh embodiments mentioned above to the refrigerator described in the ninth embodiment, a deformation of the rail device can be prevented and an ease of use of the storage room can be maintained.

In other words, even in the case of such a type that a single swing hinge type door (a pivoted door) is provided, and the storage container is drawn out of the opening portion of the storage room by opening the hinge type door (the storage container itself is independently drawn out) as described in the ninth embodiment, the storage container is directly or indirectly supported to the third rail, and is drawn out, and this configuration is included in the drawer type storage room, and it goes without saying that it is included in the present invention.

In the eighth and ninth embodiments, the direct cooling system and the indirect cooling system are employed as the cooling system of three storage rooms. However, the cooling system of each of the storage rooms is not limited to any particular system at a time of executing the present invention.

For example, in refrigerator 500 according to the eighth embodiment, all of refrigerating room 510, vegetable room 520 and freezing room 530 may be cooled in accordance with the indirect cooling system. Same applies to refrigerator 700 according to the ninth embodiment.

Further, the kind of the storage rooms is not limited to the kinds described in the eighth and ninth embodiments. For example, vegetable room 520 and vegetable room 720 may be constructed by a storage room called as a temperature variable room which a user can set a temperature range.

Further, the hinge type door such as first door 511 and middle door 721 is of a so-called single swing type door. However, the hinge type door such as the first door 511 and middle door 721 may be of a gatefold type door in which two door plates arranged in right and left sides rotate around axes of rotation in the vicinity of outer end sides.

In other words, one first door 511 may be constructed by two door plates. Same applied to middle door 721.

In other words, the effect of preventing the rail device from being deformed which corresponds to the effect of the present invention can be achieved without depending on the kind of the storage room and the cooling system.

Tenth Embodiment

Figure 29:
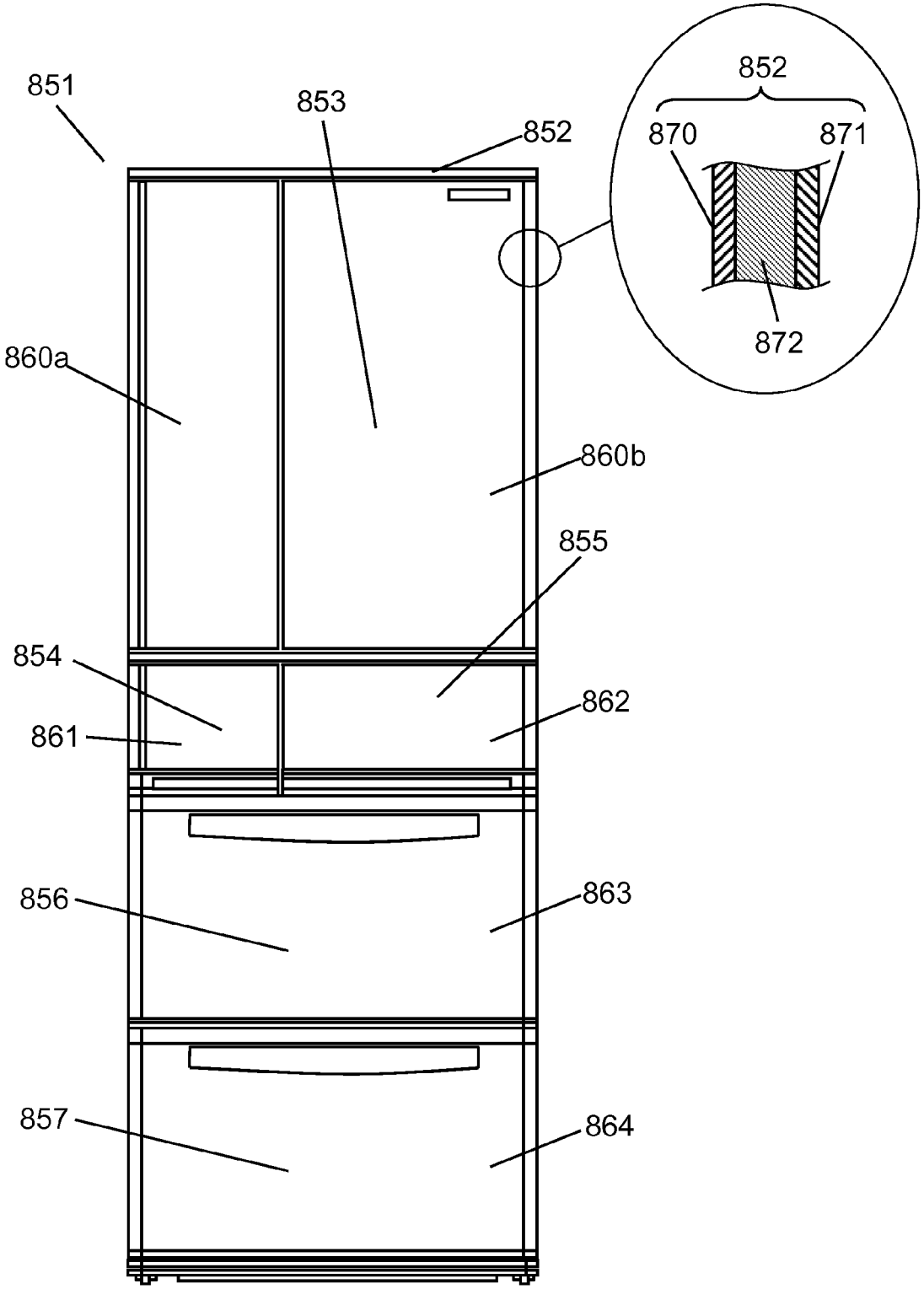
FIG. 29 is a front view of a refrigerator according to a tenth embodiment of the present invention.

FIG. 29 is a front elevational view of a refrigerator according to a tenth embodiment of the present invention.

As shown in FIG. 29, refrigerator 851 is a refrigerator which is provided with a gatefold type door, and is provided with a plurality of comparted storage rooms within heat insulated box 852.

Specifically, as the storage rooms, from the upper part, there are provided refrigerating room 853, ice making room 854, switching room 855 which is provided in line with the ice making room 854 and has a temperature within the room being changeable, vegetable room 856, and freezing room 857.

An opening portion of each of the storage rooms is provided with a thermal insulating door filled with a foaming and heat insulating material, for example, an urethane. Specifically, refrigerating room 853 is provided with left door **860*a* and right door 860*b* closing an opening portion of heat insulated box 852** so as to freely open and close.

Further, ice making room 854, switching room 855, vegetable room 856 and freezing room 857 are provided respectively with drawer type drawer door 861, door 862, door 863 and door 864.

The other storage rooms than refrigerating room 853 in these storage rooms are of the drawer type storage room.

Further, as shown in FIG. 29, heat insulated box 852 is constructed by a thermal insulating wall configured such that foam heat insulator 872 is filled in a space constructed by inner box 870 obtained by vacuum molding a resin body such as an ABS or the like and outer box 871 employing a metal material such as a precoat steel sheet or the like.

A cooler (not shown) and a fan (not shown) are provided in a rear side of vegetable room 856 and freezing room 857, the cooler is driven by a compressor installed in a main body lower portion of refrigerator 851, and a cooled air is fed to each of the storage rooms from the cooler. Further, the storage rooms are controlled so as to be cooled to a predetermined temperature per storage room.

Figure 30:
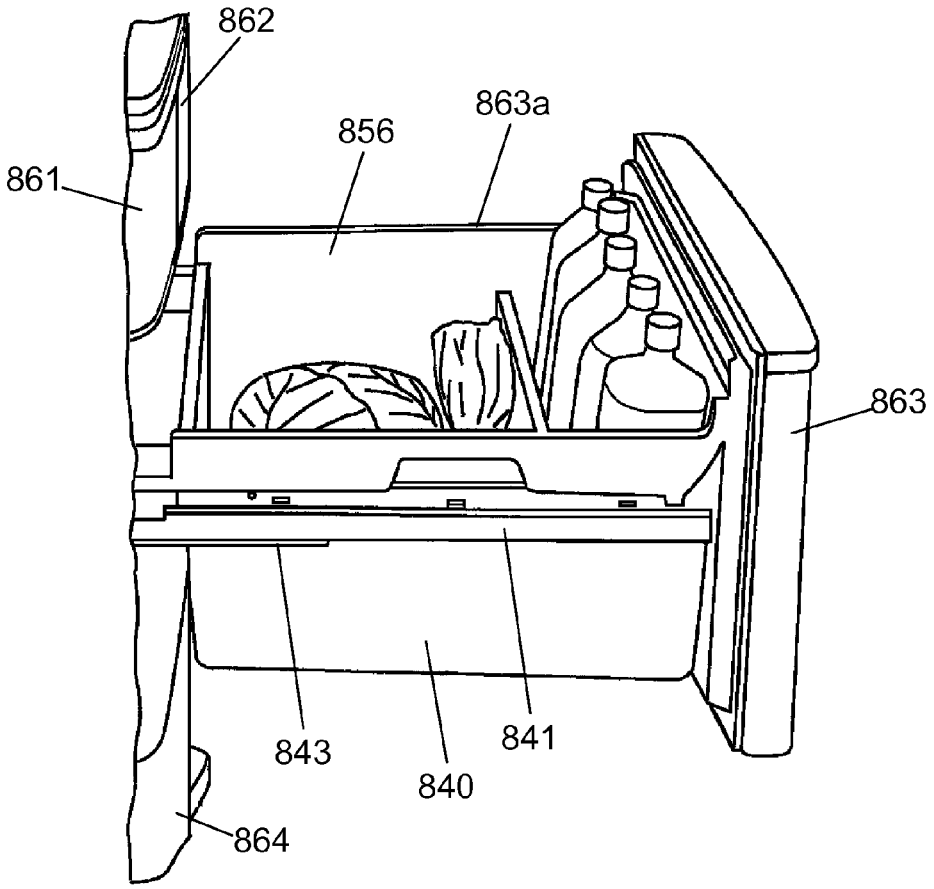
FIG. 30 is a perspective view showing a state that a vegetable room is drawn out from the refrigerator according to the tenth embodiment of the present invention.

FIG. 30 is a perspective view showing a state that the vegetable room is drawn out from the refrigerator according to the tenth embodiment of the present invention.

As shown in FIG. 30, vegetable room 856 is a drawer type storage room, and container 863*a* forming the vegetable room is provided in heat insulated box 852 so as to be capable of being taken in and out by rail device 840.

Specifically, container 863*a* is supported to door frame 841 which is bonded to third rail (top rail) 844 corresponding to a third rail (a moving rail) which is movable in a backward and forward direction of refrigerator 851 via second rail (middle rail) 843 corresponding to an intermediate rail, in its right and left sides (a near side and a far side in FIG. 30).

In this case, second rail (middle rail) 843 is movably supported to first rail (cabinet rail) 842 (not shown in FIG. 30) corresponding to a first rail (a fixed rail), and third rail (top rail) 844 is movably supported to second rail (middle rail) 843. Further, first rail (cabinet rail) 842 is fixed to inner surface of inner box 870.

Further, each of first rail (cabinet rail) 842, third rail (top rail) 844 and second rail (middle rail) 843 is supported by a rotation support member (not shown), and first rail (cabinet rail) 842 is fixed to a side wall of inner box 870 in a state that first rail (cabinet rail) 842, third rail (top rail) 844 and second rail (middle rail) 843 are previously assembled.

Door frame 841 supporting each of right and left sides of container 863*a* is fixedly coupled to drawer door 863 by using a screw.

Further, a maximum drawable distance of the drawer door 863 is a length at which the container 863*a* is completely open.

In other words, the maximum drawable distance is a length at which an end surface in the back (the left side in FIG. 30) of container 863*a* is positioned in front of a foreground portion of outer box 871 when the vegetable room 856 is fully opened.

In this case, it is easy to store a food product in the far side of container 863*a* and take out the food product from the far side of container 863*a*. Further, it is desirable to prevent container 863*a* from interfering with drawer door 861 and drawer door 862 in the upper portion, at a time of taking out and attaching container 863*a*. Accordingly, it is possible to easily take out and attach container 863*a*.

In this case, in freezing room 857, the maximum drawable distance is decided in the same manner as vegetable room 856, and the user can easily attach and detach the container forming freezing room 857.

Vegetable room 856 and freezing room 857 are drawn out to such a position on the basis of an elongation of rail device 840.

Figure 31:
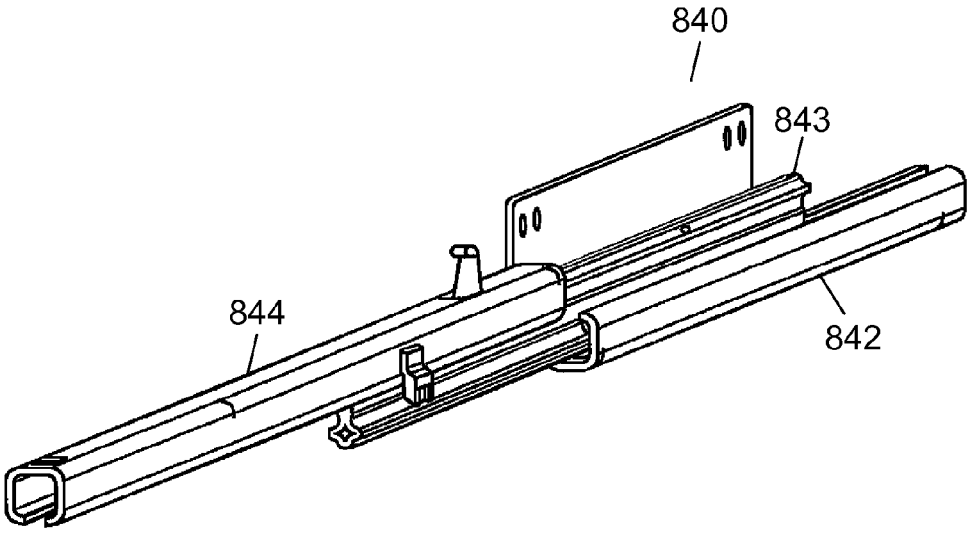
FIG. 31 is a perspective view showing an appearance of a rail device for the refrigerator according to the tenth embodiment of the present invention.

FIG. 31 is a perspective view showing an appearance of the rail device for the refrigerator according to the tenth embodiment of the present invention.

As shown in FIG. 31, third rail (top rail) 844 moves with respect to first rail (cabinet rail) 842 via second rail (middle rail) 843. In other words, rail device 840 is expanded and contracted as a whole.

Specifically, in the case of vegetable room 856, right and left door frames 841 and the third rail (top rail) 844 which are coupled to drawer door 863 are drawn out on the basis of the drawing operation of drawer door 863 by the user.

Accordingly, as shown in FIG. 30, container 863*a* supported to door frame 841 bonded to third rail (top rail) 844 is drawn out to an outer portion of heat insulated box 852. In other words, vegetable room 856 is fully opened.

Further, each of lengths of first rail (cabinet rail) 842, second rail (middle rail) 843 and third rail (top rail) 844 is a length at which a back end side of container 863*a* is positioned in front of foreground portion 871*a* of the outer box in the case that container 863*a* is drawn out to the maximum drawable position.

As described above, refrigerator 851 according to the tenth embodiment in which vegetable room 856 corresponding to the drawer type storage room can be fully opened does not lose a usability such as a smoothness of drawing or the like on the basis of various technical features of rail device 840.

Figure 32:
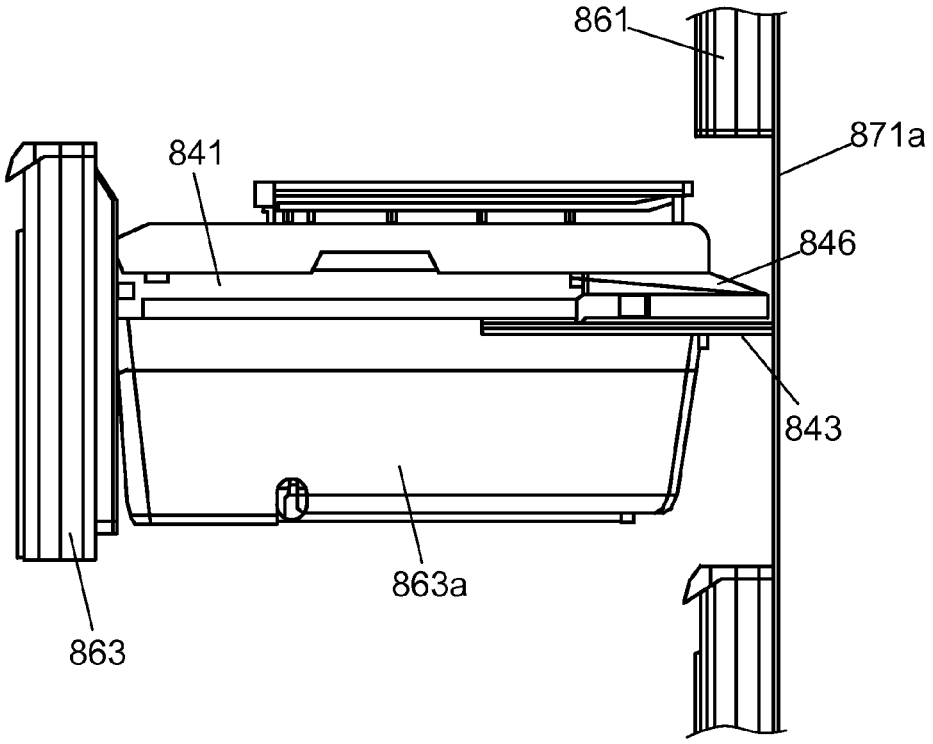
FIG. 32 is a side view showing the state that the vegetable room is drawn out from the refrigerator according to the tenth embodiment of the present invention.
Figure 33:
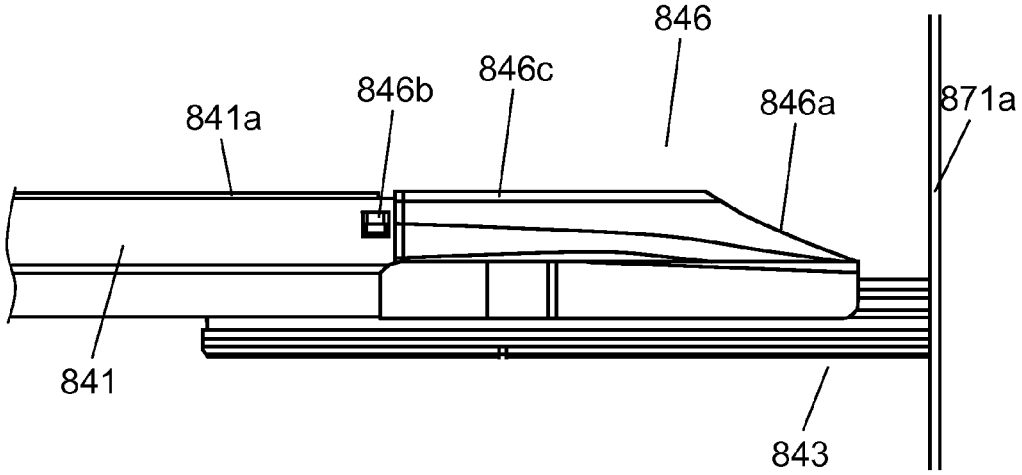
FIG. 33 is a side view of main components of the rail device for the refrigerator according to the tenth embodiment of the present invention.
Figure 34:
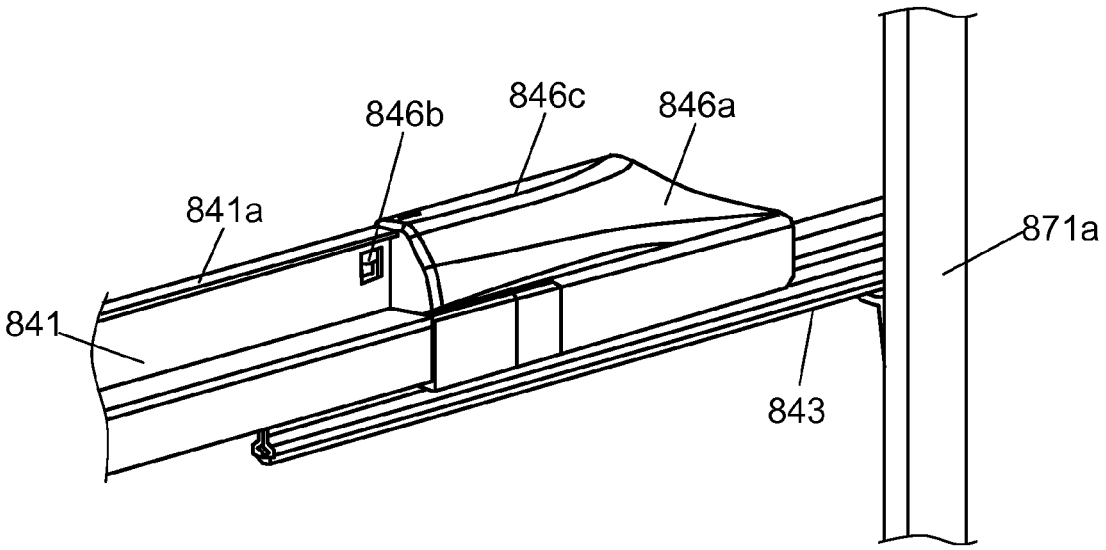
FIG. 34 is a perspective view of the main components of the rail device for the refrigerator according to the tenth embodiment of the present invention.

FIG. 32 is a side elevational view showing a state that the vegetable room is drawn out from the refrigerator according to the tenth embodiment of the present invention. FIG. 33 is a side elevational view of main components of the rail device for the refrigerator according to the tenth embodiment of the present invention. FIG. 34 is a perspective view of main components of the rail device for the refrigerator according to the tenth embodiment of the present invention.

As shown in FIG. 32, container 863*a* forming vegetable room 856 is provided so as to be capable of being taken in and out of heat insulated box 852 by rail device 840, and vegetable room 856 is fully opened.

Accordingly, the maximum drawable distance of drawer door 863 is a length at which container 863*a* is fully opened.

In other words, the maximum drawable distance is a length at which the end surface in the far side of container 863*a* is positioned in front of foreground portion 871*a* of the outer box at a time of fully opening vegetable room 856.

In this case, it is easy to store the food product in the far side of container 863*a*, and take out the food product from the far side of container 863*a*. Further, it is desirable to prevent container 863*a* from interfering with drawer door 861 and drawer door 862 in the upper portion at a time of taking out and attaching container 863*a*. Accordingly, it is possible to easily take out and attach container 863*a*.

In this case, in freezing room 857, the maximum drawable distance is decided in the same manner as vegetable room 856, and the user can easily attach and detach the container forming freezing room 857.

In this case, in the case of a state that drawer door 863 is drawn out to the maximum, the farthest portion corresponding to the side end surface of the storage room of third rail (top rail) 844 is positioned in front of foreground portion 871*a* of outer box 871, and the end surface in the far side of third rail (top rail) 844 comes to a state that it is exposed to an outer side of heat insulated box 852. Accordingly, it is desirable to protect an exposed portion in the farthest portion (the storage room side end surface) of the third rail (the moving rail).

Further, since the farthest portion corresponding to the storage room side end surface of door frame 841 formed by the metal material is also positioned in front of foreground portion 871*a* of the outer box, it is desirable to protect the exposed portion of the farthest portion (the storage room side end surface) of the third rail (the moving rail), at a time of taking into consideration the case that drawer door 863 is closed in a state that a finger is put in a gap generated between the end surface of the farthest portion of door frame 841 and foreground portion 871*a* of the outer box.

Accordingly, in order to enhance a safety, rail protection component 846 is installed to the storage room side end surface of third rail (top rail) 844.

Accordingly, it is possible to enhance the safety by concealing the storage room side end surface of third rail (top rail) 844. Further, it is possible to do away with the gap generated between the storage room side end surface of door frame 841 and foreground portion 871*a* of the outer box, and it is possible to enhance the safety.

However, there is a case that it is impossible to completely do away with the gap generated by the storage room side end surface of door frame 841 and foreground portion 871*a* of the outer box, by means of rail protection component 846.

As shown in FIGS. 33 and 34, there is a case that the drawing amount is increased to such a level that the storage room side end surface of rail protection component 846 attached to door frame 841 is positioned outside foreground portion 871*a* of the outer box, due to a tendency that a storage amount of the storage room is increased in recent years.

In this case, since a depth dimension of inner box 870 to which rail device 840 is fixed has a limit, it is impossible to elongate the depth of rail protection component 846. In other words, since the depth of rail protection component 846 can not be elongated, a gap is generated between the farthest portion of rail protection component 846 and foreground portion 871*a* of the outer box in a state that drawer door 863 is drawn out to the maximum. If drawer door 863 is closed in a state that the finger is put in the gap, there is a possibility that the finger is pinched therebetween.

In order to inhibit the finger from being pinched by the gap generated between the storage room side end surface of rail protection component 846 and foreground portion 871*a* of the outer box, the far side of rail protection component 846 is provided with inclined surface 846*a* formed as a shape obtained by combining an upward inclined surface and an outward inclined surface.

Accordingly, even if the finger is put in the gap generated between the farthest portion of rail protection component 846 and foreground portion 871*a* of outer box 871, inclined surface 846*a* of the rail protection component is formed as the shape obtained by combining the upward inclined surface and the outward inclined surface, it is possible to let out the finger to the outer side so as to be along the inclined surface from the gap generated between the farthest portion of rail protection component 846 and foreground portion 871*a* of the outer box, and it is possible to enhance a safety at a time of closing drawer door 863.

In this case, it is preferable that an angle of inclined surface 846*a* is an angle which is equal to or more than 10 degree and equal to or less than 45 degrees.

Specifically, if it is less than 10 degrees, a magnitude of inclined surface 846*a* provided in rail protection component 846 is enlarged and a magnitude of rail protection component 846 itself is enlarged. Therefore, there is a possibility that the shape can not be settled in a determined dimension, and since a shape thickness is thin in the leading end side of the inclined surface, it is hard to secure a strength of rail protection component 846.

Further, specifically, if it goes beyond 45 degrees, there is a possibility that the finger can not be smoothly pushed out to the outer side of inclined surface 846*a* in the case that the finger is put in the far side of rail protection component 846.

Accordingly, it is possible to enhance the safety without enlarging rail protection component 846 more than necessary, by setting the inclined surface to a degree which is equal to or more than 10 degrees and equal to or less than 45 degrees.

Further, inclined surface 846*a* is formed as the shape obtained by combining the upward inclined surface and outward inclined surface. In the case of being constructed only by the upward inclined surface, there is a possibility that the finger put in inclined surface 846*a* slips on rail protection component 846 at a time of closing drawer door 863, and comes into contact with the case put in the upper portion of rail protection component 846. Accordingly, the finger put in inclined surface 846*a* can slip on the rail protection component and can be let out so as to be pushed out to the outer side at the same time of being lifted up to the upper portion, at a time of closing drawer door 863, by combining the outward inclined surface therewith, so that it is possible to further secure the safety.

Further, door frame 841 is fixed to third rail (top rail) 844, and rail protection component 846 is firmly attached to the storage room side end surface of door frame 841. Rail protection component 846 is fixed to door frame 841 by inserting door frame attachment shape 846*b* provided in rail protection component 846 to a hole provided in door frame 841. Since it is possible to firmly attach rail protection component 846 to door frame 841, it is possible to bond drawer door 863 to which door frame 841 and rail protection component 846 are installed, to rail device 840 in the manufacturing process. Accordingly, it is possible to achieve an improvement of a workability.

Further, in the case of bonding drawer door 863 to which door frame 841 and rail protection component 846 are installed, to rail device 840, door frame 841 is inserted to a catch shape provided in third rail (top rail) 844 and thereafter door frame 841 and third rail (top rail) 844 are fixed by using a screw. At this time, since the fixing part of third rail (top rail) 844 and door frame 841 is formed as a catch shape, there is a possibility that a hand comes into contact with the catch shape at a time of opening and closing drawer door 863. Further, since the fixing part of door frame 841 and third rail (top rail) 844 is formed as a shape protruding from the surface even if the catch shape is not used, there is a possibility that the finger or the like comes into contact at a time of opening and closing the door.

Rail protection component 846 inhibits the hand or the like from coming into contact with the fixing part of door frame 841 and third rail (top rail) 844 at a time of opening and closing drawer door 863, by concealing the fixing part of door frame 841 and third rail (top rail) 844 as well as protecting the storage room side end surface of third rail (top rail) 844.

Further, rail protection component 846 is formed such a shape as to simultaneously conceal a suspended hole (not shown) for painting which is provided in the vicinity of the leading end portion of door frame 841. Generally, door frame 841 employs a metal material, and is painted for improving a visual appearance quality, a cleanliness and the like of the refrigerator. A hole (not shown) for suspending door frame 841 is necessary at a time of painting. A suspended painting work is carried out by inserting a rod or the like to the suspension hole for painting. In this case, since the rod for suspension is passed through the hole at a time of painting, a coating material is not attached to the hole, and a burr formed by the coating material is generated around the suspension hole.

It is not necessary to carry out a work for removing the burr formed around the suspension hole for painting of door frame 841, by concealing the suspension hole for painting of door frame 841, by means of rail protection component 846.

Further, in the suspension hole for painting of door frame 841 to which the coating material is not applied, a raw material is exposed and tends to be rusted, however, it is possible to inhibit the rust from being generated, by concealing the suspension hole for painting of door frame 841.

Further, in the case of coming into contact with rail device 840 installed within the freezing room, rail device 840 cooled to a refrigerating temperature range instantaneously freezes a water content included in the finger, and there is a possibility that the finger sticks to rail device 840. Further, there is a possibility that the rust is generated by the attachment of the water content or the like to exposed rail device 840. It is possible to inhibit the rust from being generated, by attaching rail protection component 846.

Further, since rail protection component 846 is provided with an upper surface 846*c* of the rail protection component approximately at the same height as upper surface 841*a* of the door frame, rail protection component 846 does not prevent container 863*a* from being attached, at a time of installing container 863*a* to door frame 841, and it is possible to achieve an improvement of a usability.

Further, since upper surface 846*c* of rail protection component 846 is at the position which is approximately the same height as upper surface 841*a* of door frame 841, it is possible to attach container 863*a* to rail protection component 846 as shown in FIG. 32, and it is possible to apply a load of container 863*a* to door frame 841 and rail protection component 846 with a good balance. As a result, it is possible to achieve an improvement of a durability of rail device 840.

Further, since container 863*a* can be attached to rail protection component 846, it is possible to change a relationship of the depths between door frame 841 and rail protection component 846 to an appropriate balance. For example, rail protection component 846 formed by the resin material is inferior in strength to door frame 841 formed by the metal material, however, in the case that a sufficient strength can be obtained even by making the length of door frame 841 short since rail device 840 is made of the metal material, it is possible to achieve a reduction of a weight of the refrigerator by making the depth of rail protection component 846 formed by the resin material long, and inversely making the depth of door frame 841 formed the metal material short. In other words, a freedom of selecting the lengths of door frame 841 and rail protection component 846 is enhanced.

Further, the material of rail protection component 846 is set to a resin material. Accordingly, even if the shape of rail protection component 846 is complicated, it is possible to form and it is easy to color, so that it is not necessary to coat. Further, since rail protection component 846 may be formed as a rounded shape, and the material itself has an elasticity, it is possible to relax a pain at a time of contacting even in the case that the finger or the like comes into contact with rail protection component 846.

Further, rail protection component 846 and door frame 841 are matched to similar colors. Accordingly, it is possible to install rail protection component 846 without accentuating. Further, a white color is mainly used within the refrigerator for giving the cleanliness as an impression, therefore, it is a mainstream to use door frame 841 coated as a white color. Since door frame 841 has the white color and the white color is mainly used in container 863*a*, it is desirable to coat rail protection component 846 in the white color in the tenth embodiment. Therefore, since rail protection component 846 employs a generally easily obtainable polypropylene resin, and the resin color itself is of a white, rail protection component 846 can be used without being colored.

As described above, since second rail (middle rail) 843 is employed, rail protection component 846 attached to the storage room side end surface of third rail (top rail) 844 protects the exposed portion of the farthest portion (the storage room side end surface) of third rail (top rail) 844 even in the case that the farthest portion (the storage room side end surface) of third rail (top rail) 844 is positioned outside foreground portion 871*a* of outer box 871, it is possible to prevent the hand from coming into contact with the end surface of third rail (top rail) 844 so as to enhance a safety. Further, even in the case of supporting a large capacity of storage room so as to be capable of opening fully, it is possible to keep an ease of use, a safety in use and an visual appearance quality of the storage room.

Next, a description will be given in detail of an internal configuration, an attaching way and the like of the rail protection component according to the present invention.

Figure 35:
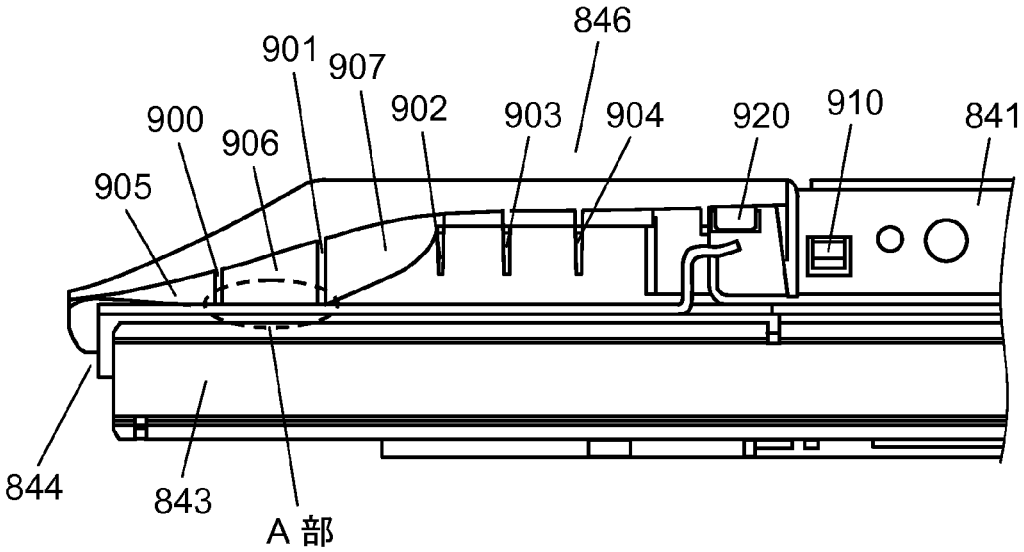
FIG. 35 is a section view showing a state that a rail protection component and a door frame are attached in the rail device for the refrigerator according to the tenth embodiment of the present invention.
Figure 36:
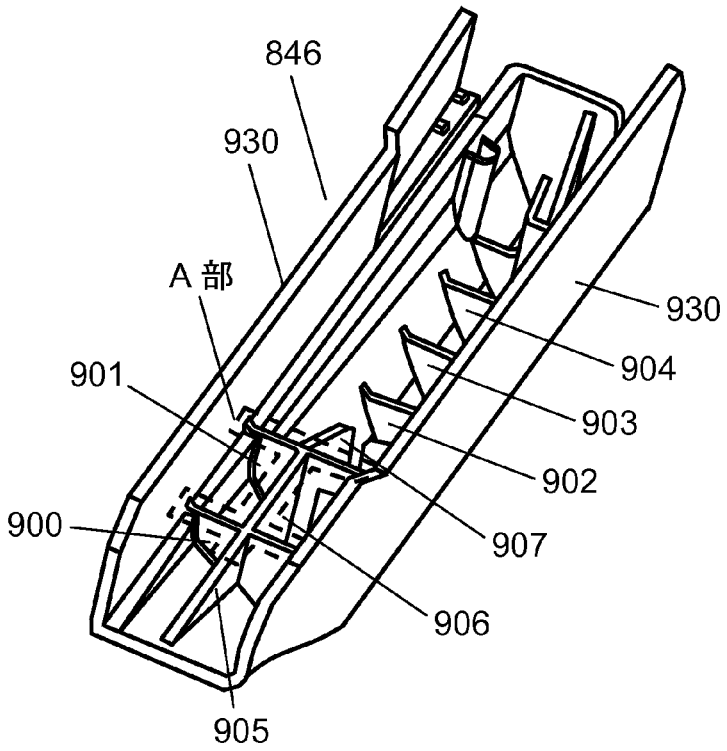
FIG. 36 is a perspective view seen from the back side of the rail protection component of the rail device for the refrigerator according to the tenth embodiment of the present invention.

FIG. 35 is a section view showing an attached state of the rail protection component of the rail device for the refrigerator and the door frame according to the tenth embodiment of the present invention. FIG. 36 is a perspective view of the rail protection component of the rail device for the refrigerator according to the tenth embodiment of the present invention as seen from a back surface.

As shown in FIG. 35, rail protection component 846 is attached and fixed to door frame 841 in such a manner as to be coated from above door frame 841. In other words, a direction in which the load is applied and an attaching direction of the rail protection component are set to the same direction. Accordingly, it is possible to easily attach at a time of attaching rail protection component 846, and it is possible to comparatively easily secure the strength of rail protection component 846 with respect to the load applied from the upper portion of rail protection component 846, in the case that container 863*a* is fixed onto rail protection component 846.

Further, as shown in FIGS. 35 and 36, in rail protection component 846, at least a part of rail protection component 846 is brought into contact with third rail (moving rail) 844 (refer to a dotted line A portion in FIG. 35 and a dotted line A portion in FIG. 36). Therefore, in the case that container 846*a* is fixed onto rail protection component 846, it is possible to support by third rail (moving rail) 844 corresponding to a rigid body with respect to the load applied from the upper portion of rail protection component 846, and it is possible to easily secure the strength of rail protection component 846.

More specifically, lower surfaces of ribs 900, 901, 905 and 906 mentioned below are brought into contact with the upper surface of third rail (moving rail) 844.

Further, as shown in FIGS. 35 and 36, a rib is provided in an inner side of rail protection component 846. More specifically, ribs 905, 906 and 907 integrally formed with rail protection component 846 are provided in the inner side of rail protection component 846 in sequence from a front side (a leading end of the inclined portion) in parallel to a longitudinal direction (a depth direction of the refrigerator). Further, ribs 900 and 901 integrally formed with rail protection component 846 are provided in the forward portion in the inner side of rail protection component 846, at a predetermined distance in sequence from the front side (the leading end of the inclined portion) in a vertical direction to the longitudinal direction (the depth direction of the refrigerator), and ribs 902, 903 and 904 integrally formed with rail protection component 846 are provided in a rearward portion at a predetermined distance in sequence from the front side (the leading end of the inclined portion) in the vertical direction to the longitudinal direction (the depth direction of the refrigerator). Accordingly, it is possible to prevent rail protection component 846 itself from being deformed, and it is possible to easily secure the strength of rail protection component 846 with respect to the load applied from the upper portion of rail protection component 846, in the case that container 863*a* is fixed onto rail protection component 846.

In other words, ribs 900, 901, 902, 903 and 904 provided in the vertical direction to the longitudinal direction of rail protection component 846 (the depth direction of the refrigerator) are configured such that their side surfaces are joined so as to make side surface 930 of rail protection component 846 hard to be opened to an outer side, it is possible to easily secure the strength of rail protection component 846 with respect to the load applied from the upper portion of rail protection component 846, rail protection component 846 is hard to be detached, and it is possible to securely protect the end surface of the rail device. In other words, rail protection component 846 formed by the resin material is inferior in strength to the door frame formed by the metal material, however, it is possible to compensate a reduction of the strength by providing the rib in the inner side of rail protection component 846.

Further, as shown in FIG. 35, rail protection component 846 is provided with fitting portions bonding rail protection component 846 and door frame 841 at a plurality of (specifically two) positions. Specifically, fitting portions 910 and 920 are proved in the vicinity of the rear end of rail protection component 846, and the fitting holes are provided respectively at corresponding positions to fitting portions 910 and 920 in door frame 841. Accordingly, an attaching strength of rail protection component 846 is improved by fitting these fitting portions 910 and 920 to the fitting holes respectively provided at the corresponding positions, and rail protection component 846 is hard to be detached even if the load is applied from a lateral direction, a vertical direction and a diagonal direction, so that it is possible to securely protect the end surface of the rail device.

In the tenth embodiment, rail protection component 846 is configured such that the inner portion has a space (that is, it is linearly contact by the rib), however, at least a part of the inner portion may be configured such that a space is not provided (that is, a resin is filled so as to form a surface contact).

Eleventh Embodiment

Figure 37:
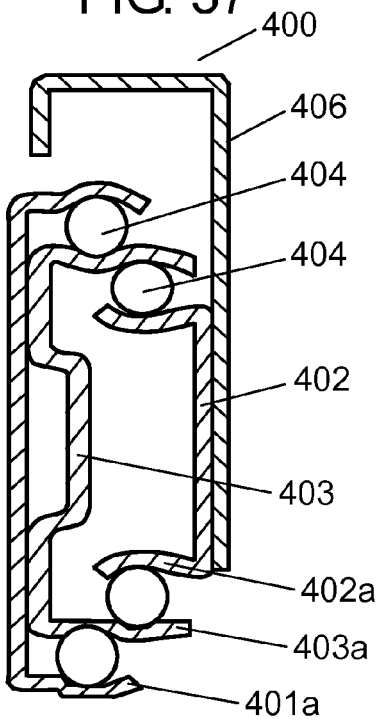
FIG. 37 is a section view showing the overview of a rail device for a refrigerator according to an eleventh embodiment of the present invention.

FIG. 37 is a section view showing a configuration outline of a rail device for a refrigerator according to an eleventh embodiment of the present invention.

Comparing the rail device according to the eleventh embodiment with the rail device according to the tenth embodiment, it is different in the configuration of the rail device. Specifically, as shown in FIG. 37, the rail device according to the eleventh embodiment is different from rail device 840 layered up and down in three stages, for example, as shown in FIG. 31, and the rail device has three rails which are arranged side by side in three rows. In this case, a description will be given mainly of a different point from the tenth embodiment.

As shown in FIG. 37, specifically, rail device 400 is constructed by first rail (fixed rail) 401 provided with collar portion 401*a* extending in an inward direction in upper and lower sides of a tabular body, third rail (moving rail) 402 which is fixed to an outer side of a support frame (not shown) supporting a container (not shown) via support bracket 406, is narrower than a height of first rail (fixed rail) 401, and has collar portion 402*a* extending in an outward direction of upper and lower sides thereof, and second rail (intermediate rail) 403 which is provided between inner and outer rails 401 and 402, has a height being smaller than first rail (fixed rail) 401 and larger than third rail (moving rail) 402, and is provided with collar portion 403*a* in an inner direction from upper and lower sides thereof.

Specifically, intermediate rail 403 is movable with respect to first rail (fixed rail) 401, and third rail (moving rail) 402 is movable with respect to second rail (intermediate rail) 403, thereby being expandable as a whole.

Figure 38:
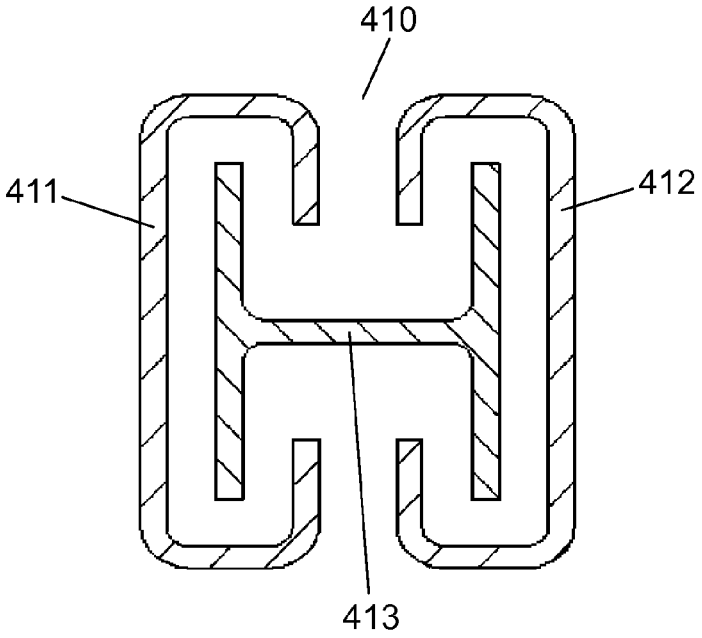
FIG. 38 is a section view showing the overview of a different rail device for the refrigerator according to the eleventh embodiment of the present invention.

FIG. 38 is a section view showing a configuration outline of a different rail device for the refrigerator according to the eleventh embodiment of the present invention.

Different rail device 410 according to the eleventh embodiment is different in the configuration of the rail device in comparison with rail device 840 according to the tenth embodiment. Specifically, as shown in FIG. 38, different rail device 410 according to the eleventh embodiment is different from rail device 840 layered up and down in three stages, for example, as shown in FIG. 31, and the rail device has three rails which are arranged side by side in three rows. In this case, a description will be given mainly of a different point from the tenth embodiment.

As shown in FIG. 38, specifically, in rail device 410, since intermediate rail 413 in which a section shape is formed as H shape is movable with respect to first rail (fixed rail) 411, and third rail (moving rail) 412 is movable with respect to second rail (intermediate rail) 413, rail device 410 is expandable as a whole. In this case, a bearing corresponding to a slidable member is omitted in FIG. 38.

As shown in FIGS. 37 and 38, various shapes exist in the shape of the rail device, however, in a refrigerator provided with a drawer type storage room, and a drawer door positioned in a front face of the storage room, the refrigerator being provided with a rail device having a first rail (a fixed rail), a third rail (a moving rail) and a second rail (an intermediate rail) which are arranged such that longitudinal directions are identical and are formed as an elongated shape, and supporting a container forming the storage room so as to be movable backward and forward, a rail protection component attached to a storage room side end surface of the third rail (the moving rail) protects an exposed portion of a farthest portion (the storage room side end surface) of the third rail (the moving rail) on the basis of the provision of rail protection component 846, whereby it is possible to prevent the hand from coming into contact with the end surface of the third rail (the moving rail), it is possible to enhance a safety, and it is possible to keep an ease of use of the storage room, a safety on use, and a visual appearance quality even in the case of supporting a large capacity of storage room so as to be capable of fully opening.

Further, since rail protection component 846 is provided with inclined surface 846*a* in the rear end portion, a drawing amount is increased, and the drawer door is drawn out until the farthest portion of the rail protection component is positioned in the outer side of the foreground portion of the outer box, so that even in the case that the finger is put in the gap formed between the farthest portion of the rail protection component and the foreground portion of the outer box, it is possible to let out the finger so as to push out to the outer side, by the inclined surface, and it is possible to enhance the safety at a time of closing the drawer door.

Twelfth Embodiment

Figure 39:
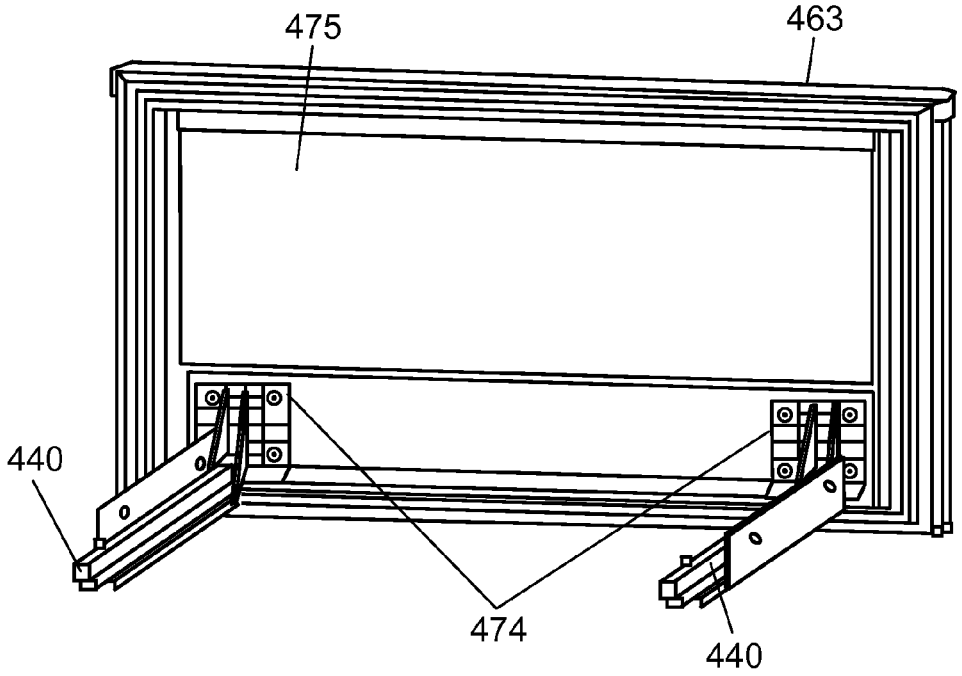
FIG. 39 is a perspective view showing a method for installing a rail device according to a twelfth embodiment of the present invention.
Figure 40:
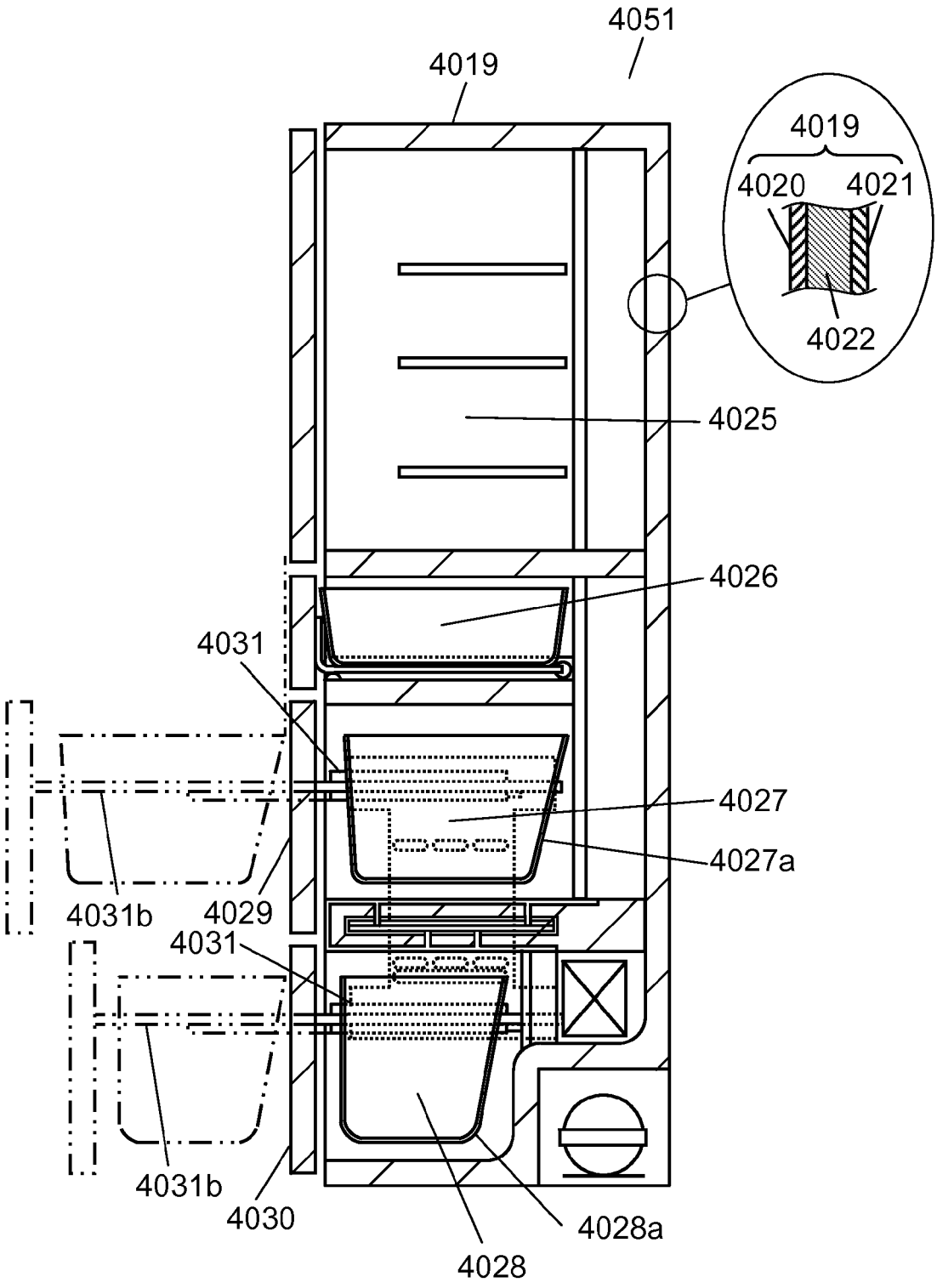
FIG. 40 is a view showing a side section of a conventional refrigerator.
Figure 41:
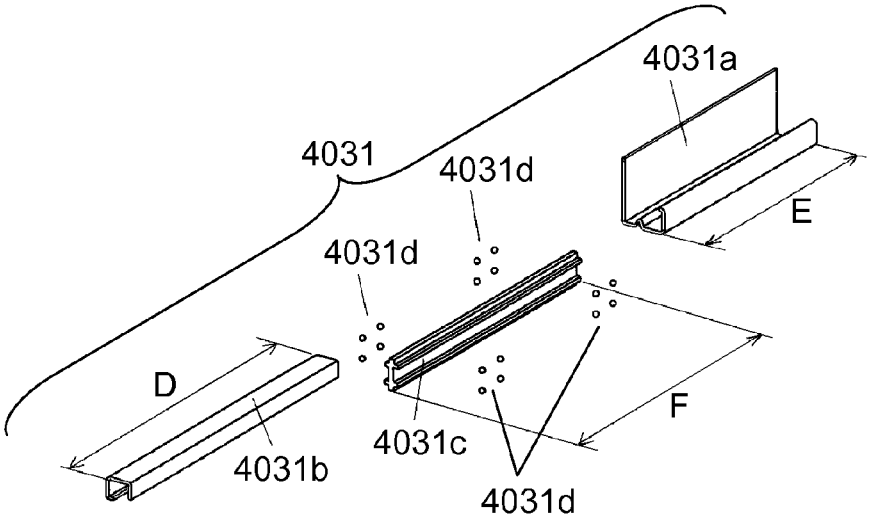
FIG. 41 is an exploded view of rail device 4031 in conventional refrigerator 4051.

FIG. 39 is a perspective view showing a method for attaching a rail device according to a twelfth embodiment of the present invention.

A door of the refrigerator is formed by a door outer plate (not shown), door inner plate 475 and a foaming and heat insulating material filled between them. Rail device 440 is connected to rail fixing part 474 attached to door inner plate 475. Further, door inner plate 475 may provided with such a shape as rail fixing part 474, and door inner plate 475 and the rail fixing part may be formed as door inner plate 475 corresponding to an integrated part.

In the twelfth embodiment, rail device 440 is fixed without using door frame 841 shown in the tenth embodiment. A shape for protecting an end surface of the rail device can be provided by covering rail device 440 by container 863*a*, however, there is a case that it is hard to protect the end surface of rail device 440 only by container 863*a*, according to a convenience of the depth in the refrigerator. Further, if the end surface in the far side of rail device 440 is protected by container 863*a*, it is hard to position a far end side of container 863*a* in front of the front face of the door in the just above portion of the storage room, and container 863*a* interferes with door 861 in an upper portion at a time of taking out and attaching container 863*a*, thereby deteriorating an unloading performance of container 863*a*.

Further, even if container 863*a* is detached for cleaning, it is possible to secure a safety of the rail device regardless of existence of container 863*a*.

Accordingly, even in the case that door frame 841 is not used, it is possible to protect the end surface of the rail by installing rail protection component 846, and it is possible to secure a safety of the drawer door of the refrigerator.

As described above, it is possible to provide the rail device achieving the drawer type storage room having the ease of use, by installing the rail protection component.

Further, the various rail devices according to the tenth to twelfth embodiments can be used as the drawer mechanism in ice making room 854 and switching room 855 corresponding to the drawer type storage room, in addition to vegetable room 856 and freezing room 857.

INDUSTRIAL APPLICABILITY

As described above, since the refrigerator according to the present invention can provide the refrigerator provided with the drawer type storage room, in which the ease of use is not lost even in the case the capacity of the storage room is large, it is possible to be applied to various kinds of refrigerators having various magnitudes such as the refrigerator for home use and for business use.

Further, the rail device according to the present invention is appropriate for the drawer mechanism of the storage room in the various kinds of refrigerators having the various magnitudes such as for home use and for business use, is not limited to the refrigerator, but can be applied to any configuration having a drawer mechanism without being limited to the food product, for example, a system kitchen, a kitchen cabinet, a dish washer, a desk and the like.

The invention claimed is:

1. A refrigerator comprising:

a heat insulated box formed by an inner box, an outer box and a foam heat insulator filled between the inner box and the outer box;

a drawer type storage room, and a fixing member having an upper vertically extending portion extending upwardly from a middle portion, a lower vertically extending portion extending downwardly from the middle portion, wherein the lower vertically extending portion is substantially parallel with the upper vertically extending portion such that the lower vertically extending portion is entirely below the upper vertically extending portion, the upper vertically extending portion having an upper terminal end and the lower vertically extending portion having a lower terminal end, wherein the upper vertically extending portion is fixed to an inner surface of the inner box, and the lower terminal end faces downward, wherein a rail device, which is formed in an elongated shape and attached to the fixing member, has a first rail, a second rail and a third rail, and supports a storage container on the third rail so as to be movable forward and backward, is provided within the storage room, the lower vertically extending portion and the lower terminal are positioned on one side of the rail device, the lower vertically extending portion includes a first vertically oriented side surface fixed to the first rail and a second vertically oriented side surface opposite the first vertically oriented side surface, facing away from the rail device, and spaced horizontally from the inner surface of the inner box, and the lower terminal end extends between the first vertically oriented side surface and the second vertically oriented side surface, wherein the lower terminal end of the fixing member is located at substantially the same height as a bottom surface of the first rail along an entire length of the fixing member in a longitudinal direction of the elongated shape of the rail device.

2. The refrigerator according to claim 1, further comprising an auxiliary member fixed to the upper vertically extending portion of the fixing member, the inner box is disposed between the auxiliary member and the upper vertically extending portion and the auxiliary member has a flange that extends below the bottom surface of the first rail.

3. The refrigerator according to claim 2, wherein the flange of the auxiliary device includes an upper surface, the inner box includes a lower surface, and the lower surface of the inner box is in direct contact with the upper surface of the flange.

4. The refrigerator according to claim 2, wherein the inner box includes an upper surface, and the bottom surface of the first rail is in direct contact with the upper surface of the inner box.

5. The refrigerator according to claim 2, wherein the auxiliary member has a vertical flange part extending parallel to the upper vertically extending portion of the fixing member.

6. The refrigerator according to claim 2, wherein the auxiliary member is formed by a metal material.

7. The refrigerator according to claim 1, wherein the second rail has upper and lower longitudinal flanges protruding right and left in each of upper and lower sides, the first rail has first flanges provided so as to extend to a height beyond the lower longitudinal flanges of the second rail in right and left sides and the third rail is held so as to be movably supported by the upper longitudinal flanges of the second rail via a slidable member, and the rail device directly or indirectly supports the storage container with the third rail so as to slide forward and backward.

8. The refrigerator according to claim 1, wherein a length of each of the first rail, the second rail and the third rail is such that a far end side of the storage container is positioned in front of a front face of a door of the storage room when the storage container is drawn out to a maximum drawable position.

9. The refrigerator according to claim 1, wherein the second rail has upper and lower longitudinal flanges protruding right and left in each of upper and lower sides, the first rail and the second rail are slidable relative to one another via a slidable member between the first rail and the lower longitudinal flanges of the second rail;

the third rail is slidably supported on the upper longitudinal flanges of the second rail via another the slidable member, the third rail device supports the storage container so that the storage container can slide forward and backward.

10. The refrigerator according to 4, wherein the first rail and the fixing member are fixed by spot welding.

11. The refrigerator according to claim 1, wherein the lower terminal end of the lower vertically extending portion of the fixing member does not extend under the first rail.

12. The refrigerator according to claim 1, wherein the first rail makes face-contact with the first vertically oriented side surface of the lower vertically extending portion in a vertical direction.

* * * * *